US008851711B2

(12) United States Patent
Ladewig et al.

(10) Patent No.: US 8,851,711 B2
(45) Date of Patent: Oct. 7, 2014

(54) HEAT SINK FOR A LIGHTING SYSTEM

(75) Inventors: Christopher Ladewig, Fayetteville, GA (US); Christopher Michael Bryant, Social Circle, GA (US); Philip Dean Winters, Senoia, GA (US)

(73) Assignee: Cooper Technologies Company, Houston, TX (US)

( * ) Notice: Subject to any disclaimer, the term of this patent is extended or adjusted under 35 U.S.C. 154(b) by 50 days.

(21) Appl. No.: 13/562,061

(22) Filed: Jul. 30, 2012

(65) Prior Publication Data

US 2013/0027936 A1 Jan. 31, 2013

Related U.S. Application Data

(60) Provisional application No. 61/513,376, filed on Jul. 29, 2011.

(51) Int. Cl.

| | |
|---|---|
| ***F21V 29/00*** | (2006.01) |
| ***F21S 2/00*** | (2006.01) |
| *F21W 131/103* | (2006.01) |
| *F21V 15/01* | (2006.01) |
| *F21Y 105/00* | (2006.01) |
| *F21S 8/08* | (2006.01) |
| *F21Y 101/02* | (2006.01) |

(52) U.S. Cl.

CPC ..... *F21S 2/00* (2013.01); *F21W 2131/103* (2013.01); *F21V 29/267* (2013.01); *F21S 2/005* (2013.01); *F21V 15/013* (2013.01); *F21V 29/262* (2013.01); *F21Y 2105/001* (2013.01); *F21V 29/225* (2013.01); *F21S 8/086* (2013.01); *F21Y 2101/02* (2013.01); *F21V 29/2293* (2013.01)

USPC ..... 362/294; 362/373; 362/249.02

(58) Field of Classification Search

CPC ... F21V 29/26–29/267; F21V 29/20–29/2262; F21V 29/2293; F21V 29/00; F21V 29/002; F21V 29/004; F21V 29/02; F21V 29/022

USPC ..... 362/294, 373, 249.02

See application file for complete search history.

(56) References Cited

U.S. PATENT DOCUMENTS

| | | | | |
|---|---|---|---|---|
| 7,766,513 | B2 * | 8/2010 | Zhang et al. | 362/294 |
| 8,087,807 | B2 * | 1/2012 | Liu et al. | 362/373 |
| 8,360,613 | B2 * | 1/2013 | Little, Jr. | 362/294 |
| 2008/0078524 | A1 | 4/2008 | Wilcox et al. | |
| 2008/0080196 | A1 * | 4/2008 | Ruud et al. | 362/373 |
| 2009/0129075 | A1 * | 5/2009 | Shuai et al. | 362/234 |
| 2009/0251898 | A1 | 10/2009 | Kinnune et al. | |
| 2010/0118534 | A1 | 5/2010 | Lo | |

FOREIGN PATENT DOCUMENTS

| | | |
|---|---|---|
| EP | 2327930 | 6/2011 |
| KR | 10-2009-0124643 | 12/2009 |

OTHER PUBLICATIONS

PCT Search Report for PCT/US2012/048873, mailed on Jan. 29, 2013.

* cited by examiner

*Primary Examiner* — Mariceli Santiago
(74) *Attorney, Agent, or Firm* — King & Spalding

(57) ABSTRACT

A heat sink module is provided for transferring heat from at least one light source in a modular lighting system. The heat sink module may include an integral molded body defining: at least one heat transfer element extending generally in a first direction; at least one molded wiring channel configured for routing wiring to the at least one light source; and at least one air flow opening configured to allow ambient air flow through the heat sink body.

22 Claims, 50 Drawing Sheets

HEAT SINK FOR A LIGHTING SYSTEM

RELATED APPLICATIONS

This application claims priority from U.S. Provisional Application No. 61/513,376 filed on Jul. 29, 2011; all of which is hereby incorporated by reference in its entirety.

FIELD OF THE DISCLOSURE

The present disclosure relates to heat sinks, for example, molded heat sink modules for use in a modular lighting system.

BACKGROUND OF THE DISCLOSURE

In recent years, there has been substantial interest in energy-efficient technology including energy efficient lighting. Light-emitting diode (LED) technology has the potential to operate efficiently, but may produce unwanted and/or undesirable heat. For example, heat may reduce the emission, efficiency, and/or operability of a light-emitting diode (LED). Existing heat management strategies may be expensive to implement and/or incompletely effective. Certain conventional lighting systems may include a heat sink, e.g., a finned heat sink, formed by an extrusion technique.

SUMMARY

The present disclosure relates, in some embodiments, to modular lighting systems having one or more heat sink modules for removing, dissipating, and/or otherwise transferring heat away from a light source, e.g., one or more LED lights.

In one embodiment, a heat sink module for transferring heat from at least one light source in a modular lighting system may comprise an integral molded body. The integral molded body of the heat sink module may define at least one heat transfer element extending generally in a first direction; at least one molded wiring channel configured for routing wiring to the at least one light source; at least one air flow opening configured to allow ambient air flow through the heat sink body.

In another embodiment, a heat sink module for transferring heat from at least one light source in a modular lighting system may comprise an integral molded body. The integral molded body of the heat sink module may define a first end and a second end opposite the first end; a generally planar base portion extending generally in a first plane and configured for thermal coupling with at least one light source; at least one heat transfer element extending from the generally planar base portion in a first direction generally perpendicular to the first plane, and further extending between the first and second ends in a second direction; and first and second lateral sides extending between the first and second ends, each of the first and second lateral sides including connection structures for connecting the heat sink module to a similar adjacent heat sink module.

In another embodiment, a modular lighting system may comprise a support structure; a plurality of heat sink modules physically supported by the support structure; and one or more light source modules coupled to the plurality of heat sink modules; wherein the plurality of heat sink modules are arranged in a modular manner such that the heat sink modules in the modular lighting system is variable; and wherein each heat sink module is an integral molded structure defining at least one opening or passageway.

In another embodiment, a modular lighting system may comprise a support structure; a plurality of heat sink modules coupled to each other and physically supported by the support structure in a modular manner; and a plurality of light source modules coupled to the plurality of heat sink modules, wherein each light source module is secured to mounting points on at least two of the heat sink modules.

In another embodiment, a method for assembling a modular lighting system may comprise providing a support structure; assembling a plurality of heat sink modules such that each heat sink module engages with at least one other heat sink module; mounting the plurality of heat sink modules to the support structure, such that the support structure physically supports the plurality of heat sink modules; and securing a plurality of light source modules to the plurality of heat sink modules, such that each light source module is secured to mounting points on at least two of the heat sink modules.

In another embodiment, a housing apparatus for use in a lighting system may comprise a housing body and a channel-type connection structure coupled to or formed in the housing body. The channel-type connection structure may define a channel having a generally U-shaped cross-section and extending along a length in a first direction perpendicular to the U-shaped cross-section. The channel-type connection structure may be configured to receive and engage at least one first connector inserted in the generally U-shaped channel in an axial direction generally parallel to the first direction, and further configured to receive and engage at least one second connector inserted in the generally U-shaped channel in a perpendicular direction generally perpendicular to the first direction.

In another embodiment, a lighting system may comprise one or more light sources, a housing for one or more electronic components associated with the one or more light sources. The housing may comprise a housing body extending in a first direction, and one or more channel-type connection structures coupled to or formed in the housing body, each channel-type connection structure defining a channel that extends in the first direction. Each of the electronic components may be secured to at least one of the channel-type connection structures by one or more first connector inserted in the channel in a perpendicular direction generally perpendicular to the first direction. The channel defined by each channel-type connection structure may be further configured to receive and engage one or more second connectors in an axial direction generally parallel to the first direction.

BRIEF DESCRIPTION OF THE DRAWINGS

Some embodiments of the disclosure may be understood by referring, in part, to the present disclosure and the accompanying drawings, wherein:

FIG. 1I is a perspective view from above of an end cap of the lighting system of FIG. 1A;

DETAILED DESCRIPTION

Figure 1A:
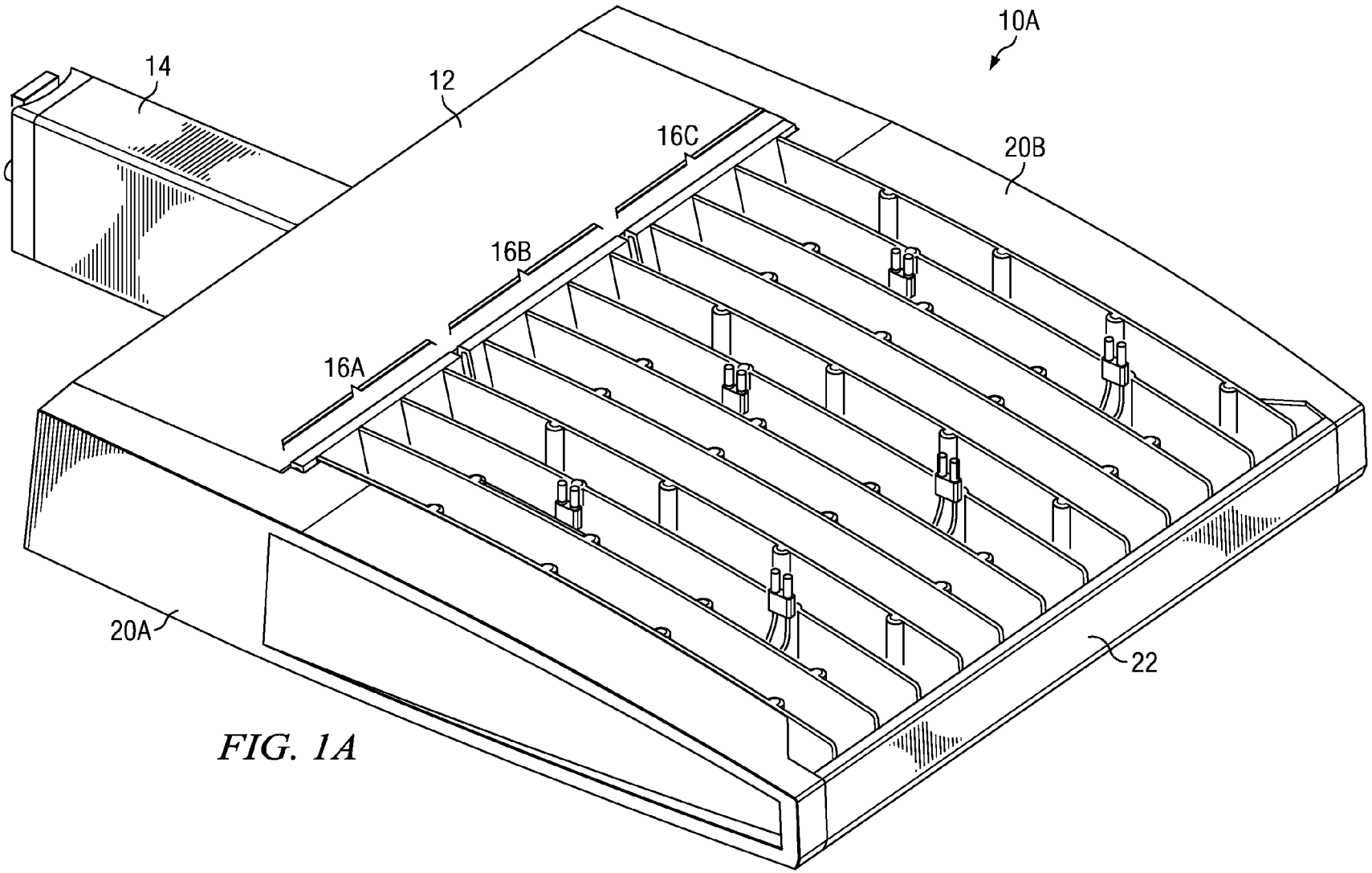
FIG. 1A is a perspective assembled view of a first modular lighting system configured with three heat sink modules, according to an example embodiment of the disclosure.

The present disclosure relates to lighting systems, for example, modular lighting systems having one or more heat sink modules for removing, dissipating, and/or otherwise transferring heat away from one or more light sources, e.g., one or more LED lights.

In some embodiments, a lighting system may includes a plurality of modules assembled together in a modular manner, to form a modular lighting system. Each module may include (a) at least one heat sink and/or (b) at least one light source module (e.g., an LED panel including an LED and printed circuit board). In some embodiments, a modular lighting system may include a support housing and multiple heat sink modules connected to the support housing and/or to each other. One or more light source modules may be thermally coupled to such multiple heat sink modules. The one or more light source modules may be coupled to the heat sink modules in any suitable configuration, e.g., in a one-to-one coupling arrangement, a one-to-multiple coupling configuration, a multiple-to-one coupling configuration, or a multiple-to-multiple coupling configuration. In embodiments or configurations in which light source modules are coupled to heat sink modules in a one-to-one arrangement, each light source module and associated heat sink module may be referred to herein as a light source/heat sink module, such that the lighting system includes multiple light source/heat sink modules connected to a support housing and/or to each other.

The heat sink modules may be in thermal communication with heat-generating components of the lighting system, including the light source modules and/or other heat-generating components of the lighting system (e.g., control circuitry, transformers, batteries, etc.) in order to transfer heat away from such components. For example, the heat sink modules may be designed to transfer heat from the heat-generating components to the ambient surroundings. In some embodiments, the heat sink modules may operate to buffer, control, regulate, moderate and/or otherwise manage heat generated by such heat-generating components in order to maintain such components at a stable temperature and/or within an operational temperature range.

In some embodiments, a light source module may comprise an LED panel, which may include one or more LEDs mounted to a printed circuit board (PCB). Each LED panel may have any suitable shape and size, and may be mounted to one or more heat sink modules. Further, any suitable number of LED panels may be mounted to each heat sink module. For example, as discussed below with respect to certain example embodiments or configurations, each individual LED panel may straddle adjacent heat sink modules and be physically mounted to the adjacent heat sink modules, which may provide increased structural support or rigidity to the lighting system. In other embodiments or configurations, each individual LED panel may be mounted to a single heat sink module.

In some embodiments, the footprint of each heat sink module may have substantially the same shape and/or dimensions as the footprint of each LED panel. For example, a heat sink and an LED panel may have substantially the same shape and footprint (e.g., a square). In other embodiments, the footprint of each heat sink module may have a substantially different shape and/or dimensions as the footprint of each LED panel.

For example, a heat sink configured to cool multiple LED panels may have a substantially larger footprint than each LED panel. Further, the size, number, and configuration of light source modules (e.g., LED panels) and/or heat sink modules may be adjusted to achieve a desired illumination and/or the thermal regulation.

As discussed above, in some embodiments, heat sink modules are configured to be arranged in modular form. Each heat sink module may be configured for mounting to, coupling to, to other otherwise engaging with a shared housing and/or one or more other heat sink modules of the lighting system in any suitable, e.g., by permanent, semi-permanent, or removable or releasable connections. For example, each heat sink module may include connection portions or structures configured for engagement with connection portions or structures of a shared housing and/or one or more other heat sink modules, either by direct engagement between such connection portions or structures (e.g., by tongue-and-groove engagement, protrusion-recess engagement, protrusion-slot engagement, etc.) or using any suitable connectors (e.g., screws, bolts, pins, clips, etc.), adhesive, or in any other suitable manner.

A lighting system may include a support housing and multiple heat sink modules arranged in any suitable manner, e.g., in one or more arrays of heat sink modules supported by the support housing and/or by adjacent heat sink modules. For example, a lighting system may include an array of heat sink modules that are each directly coupled to and supported by the support housing. In such embodiments, the heat sink modules may or may not also be coupled to each other. As another example, a lighting system may include an array of heat sink modules connected to each other, with only one heat sink module in the array being directly coupled to the support housing, such that the heat sink module array is supported by the support housing in a cantilevered manner. As another example, multiple heat sink module arrays may be supported by the support housing in such a cantilevered manner, with the multiple arrays of heat sink modules extending from multiple different sides of the support housing. Thus, in such embodiments, each heat sink module may be configured with sufficient structural integrity to support itself, one or more other heat sink modules, and/or one or more light source modules.

Each array of heat sink module may include any suitable number of heat sinks. In some embodiments, e.g., where the heat sink arrays are cantilevered from the support housing, the number of heat sink modules in each array may be selected or varied as desired, without modifying or replacing the support housing. In other embodiments, e.g., where each individual heat sink is directly coupled to the support housing, the support housing may be selected or modified to accommodate a variable number of heat sink modules. In such embodiments, the support housing may be formed by extrusion, such that the support housing may simply be extruded to the appropriate length to accommodate the desired number of heat sink modules.

It should be understood that in other embodiments, the support housing and heat sink modules may be arranged in any other suitable manner.

The support housing and heat sink modules may include any suitable features. For example, heat sink modules may include any one or more of the following features (a) heat transfer structures (e.g., fins or other heat transfer surfaces); (b) air flow passageways that allow ambient air to flow through the heat sink modules or between adjacent heat sink modules, e.g., for increased convective heat transfer; (c) heat transfer conduits of an active or passive heat transfer system for communicating one or more heat transfer fluids (e.g., water), for increased heat transfer away from heat-generating devices; (d) wiring passageways for routing electrical wiring of the lighting system; (e) connection portions or structures for connecting or facilitating the connection of a heat sink module to the support housing and/or to one or more other heat sink modules; and/or (f) any other suitable features. These features are discussed in more detail below.

In some embodiments, each heat sink module may include fins, protrusions, or any other heat transfer structures that provide increased surface area for promoting heat transfer to the surrounding environment, e.g., by convection. Such heat transfer structures may have any suitable shape, size, and orientation.

In some embodiments, each heat sink module may include one or more air flow openings that allow ambient air flow through the body of the heat sink module, to promote heat transfer to the surrounding environment, e.g., by convection. As used herein, an "air flow opening" means an opening through an individual heat sink module, which opening has a perimeter that is completely surrounded or enclosed by structural elements of the heat sink module, such that the opening is integral to the heat sink. Thus, an air flow opening is distinguished, for example, from an open-sided recess formed in a side or edge of a structural element. Example air flow openings are shown in FIG. 1E, indicated at 92A and 92B.

Air flow openings may be defined by any slots, openings, channels or other structures or features to define an enclosed-perimeter opening. In some embodiments, each heat sink module has a body that extends generally in a first plane, and one or more air flow openings through the body of the heat sink module in a direction generally perpendicular to the first plane. For example, a lighting system may include heat sink modules that extend generally horizontally (when installed for use), with each heat sink modules including air flow openings that define generally vertical air flow passageways through the heat sink modules.

In some embodiments, each heat sink module may include heat transfer conduits of an active or passive heat transfer system for communicating one or more heat transfer fluids (e.g., water), for increased heat transfer away from heat-generating devices. Such heat transfer conduits may include heat pipes or any other suitable conduits through which one or more heat transfer fluids are circulated.

In some embodiments, each heat sink module may define wiring passageways for routing electrical wiring of the lighting system, e.g., wiring connecting a power source with one or more light source modules. Each heat sink module may include one or more recesses, channels, slots, openings, or other features to define such wiring passageways for routing electrical wiring of the lighting system. For example, a heat sink module may include features that define one or more wiring passageways configured such that electrical wiring may be hidden from view and/or protected from damage, e.g., behind one or more light panels. In embodiments in which heat sink modules includes elongated fins or other heat transfer structures, such wiring passageways may extend parallel to, perpendicular to, or in any other direction relative to the direction of elongation of the heat transfer structures.

In some embodiments, heat sink modules may include connection portions or structures suitable for coupling multiple heat sink modules to each other and/or to a support housing. For example, each heat sink module may include a connection structure (e.g., a protrusion) shaped and positioned for engaging with a connection structure (e.g., a slot or recess) formed in an adjacent heat sink module, such that the connection structures may be used to connect multiple heat sink module in a row. Alternatively, each heat sink module may include multiple connection structures (e.g., protrusions) shaped and positioned for engaging with multiple connection structures (e.g., slots or recesses) formed an adjacent heat sink module, such that the connection structures may be used to connect multiple heat sink module in a row.

For example, a lighting system may include an array of heat sink modules connected in the following manner. A first heat sink module may include a protrusion or multiple spaced-apart protrusions on a first edge (e.g., a leading edge) a recess or multiple spaced-apart recesses on a second edge (e.g., a trailing edge opposite the leading edge). A second heat sink module may be placed such that its leading edge engages with the trailing edge of the first heat sink module, specifically, such that the protrusion(s) on the leading edge of the second heat sink module engage with corresponding recess(es) on the trailing edge of the first heat sink module. In some embodiments, such protrusions and recesses may be configured with recesses, holes, ribs, ridges, and/or any other features to couple the two heat sink modules together and/or one or more fasteners (e.g., screws, bolts, pins, clips, etc.) may be used to further couple the heat sink modules. One or more additional heat sink modules may be coupled to the array in a similar manner. For example, a third heat sink module may be placed such that its leading edge engages with the trailing edge of the second heat sink module, and so on, in order to assemble an array of any suitable number of heat sink modules.

The support housing of the lighting system may comprise any structure or structures configured to provide structural support to one or more heat sink modules and/or to house or provide protection for electronic components of the lighting system, e.g., one or more power supplies (e.g., LED drivers), controllers, surge monitors, terminal blocks, daylight sensors, photo controls, wiring, wiring connections, etc. In some embodiments, the support housing may act as a heat sink or otherwise provide heat transfer from heat-generating components housed in the support housing to the surrounding environment and/or from the heat sink modules to the surrounding environment. In some embodiments, the support housing may include any of the features discussed above regarding the heat sink modules, e.g., heat transfer structures, air flow passageways, heat transfer conduits, wiring passageways, connection portions or structures, etc.

Heat sink modules and the support housing may be formed using any suitable manufacturing process or processes, e.g., molding, extrusion, machining, etc. Each heat sink module may be formed as a single, integral structure, or may be formed by assembling multiple structural components.

In some embodiments, each heat sink module is formed as a single, integral structure using a molding process, e.g., a die cast process. In such embodiments, a molding process is used to form an integral molded heat sink module including any one or more of the various features discussed above—(a) heat transfer structures (e.g., fins, etc.), (b) air flow passageways, (c) heat transfer conduits, (d) wiring passageways, (e) connection portions or structures, and/or (f) any other suitable features. One or more features formed by the molding process may be difficult or realistically impossible to form by an extrusion process. For example, certain passageways, conduits, or other structures of a molded heat sink module that can be formed by a molding process cannot feasibly be formed by an extrusion process, without additional machining or assembly of components.

In some embodiments, the support housing is formed by an extrusion process. Thus, the dimension of the support housing may be varied in the direction of extrusion to accommodate a variable number and/or size of heat sink modules, without requiring significant tooling adjustments. For example, the support housing may be extruded to a first length to accommodate two heat sink modules, or to a second length to accommodate three heat sink modules, etc. Thus, a lighting system may accommodate a variable number or size of heat sink modules simply by selecting a support housing extruded to the appropriate length. Thus, an existing assembled lighting system may be adjusted to accommodate a different number of heat sink modules simply by replacing the existing support housing extruded to one length with a new support housing extruded to a different length.

Further, as discussed below, the support housing may include one or more extruded channel-type connection structures configured to receive coupling screws or other connectors, e.g., for securing electronics or other devices or structures to the support housing.

In some embodiments, a lighting system includes an extruded support housing and a plurality of molded heat sink modules, in contrast to certain conventional lighting systems that include a molded support housing and an extruded heat sink module.

In some embodiments, an LED lighting system (e.g., an outdoor LED luminaire) may comprise a support housing, a plurality of heat sink modules supported by the support housing, and one or more LED panels supported by the heat sink modules. The heat sink modules and/or the support housing are configured to dissipate heat generated by the LEDs. The LED lighting system may be scaled, by assembling a desired number of heat sinks and LED panels, to provide a desired light output.

In some embodiments, the heat sink modules may be adjusted laterally (e.g., side-to-side) with respect to the support structure, e.g., to center the heat sink assembly with respect to an extension arm and/or a light pole or other mounting structure. For example, in the example embodiments shown in FIGS. 1-3, heat sink modules may be adjusted and secured at various lateral positions on a support structure as desired, in order to center or otherwise arrange the heat sink modules with respect to the support structure, extension arm, light pole, etc.

Figure 1B:
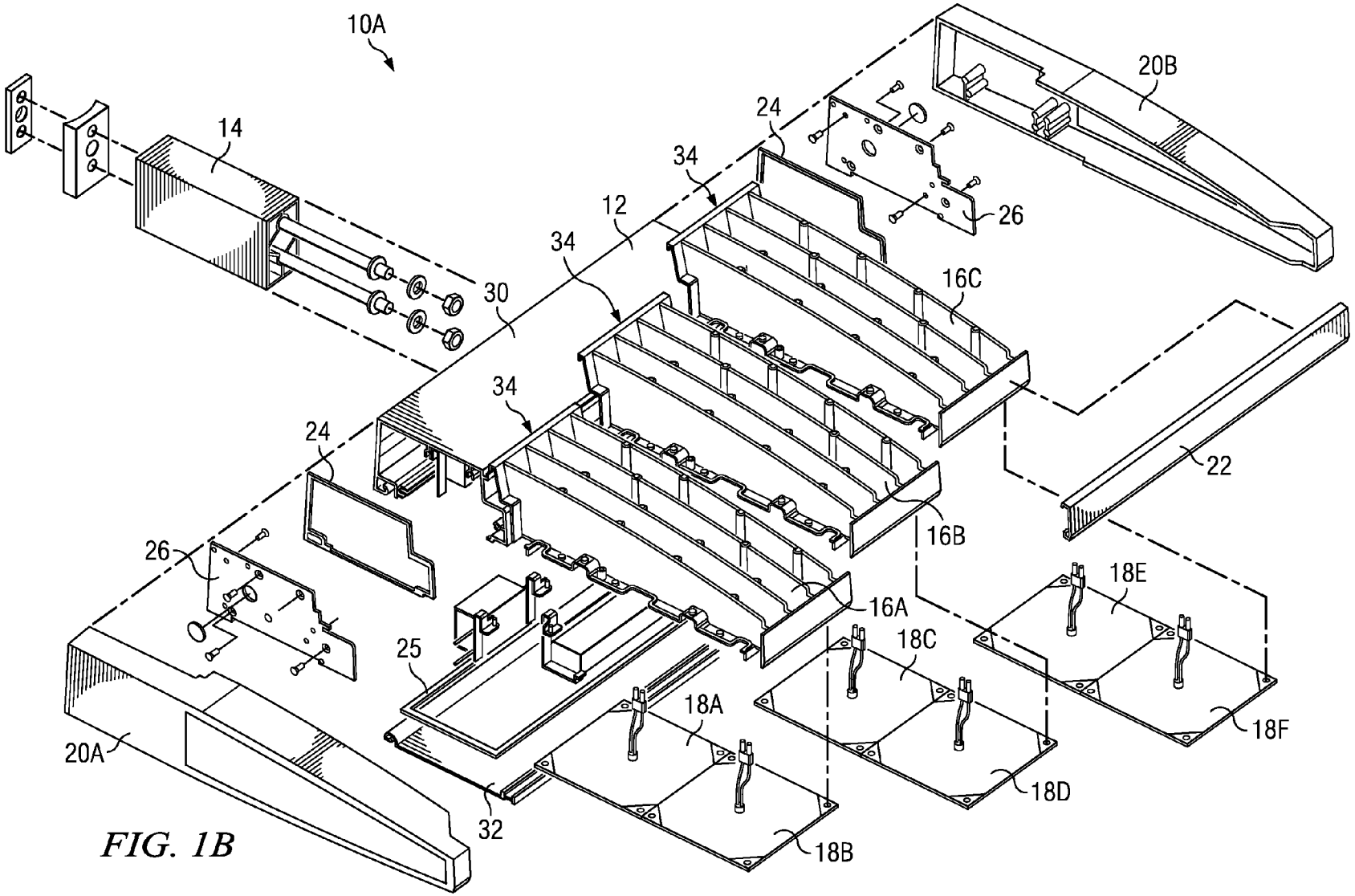
FIG. 1B is a perspective exploded view of the lighting system of FIG. 1A.
Figure 1C:
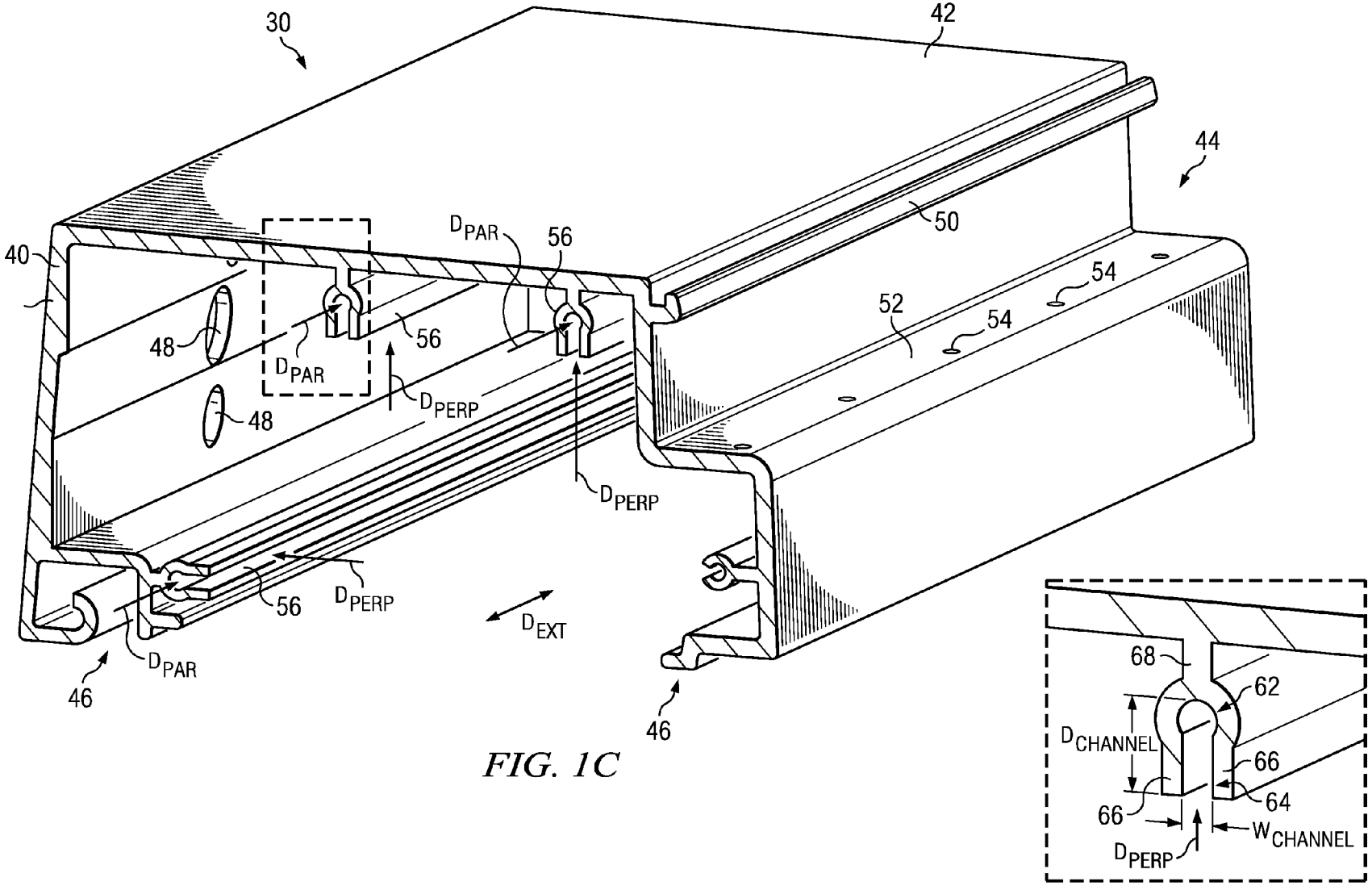
FIG. 1C is a perspective view of a housing of the lighting system of FIG. 1A, which may house electronics and provide physical support for a plurality of heat sink modules.
Figure 1D:
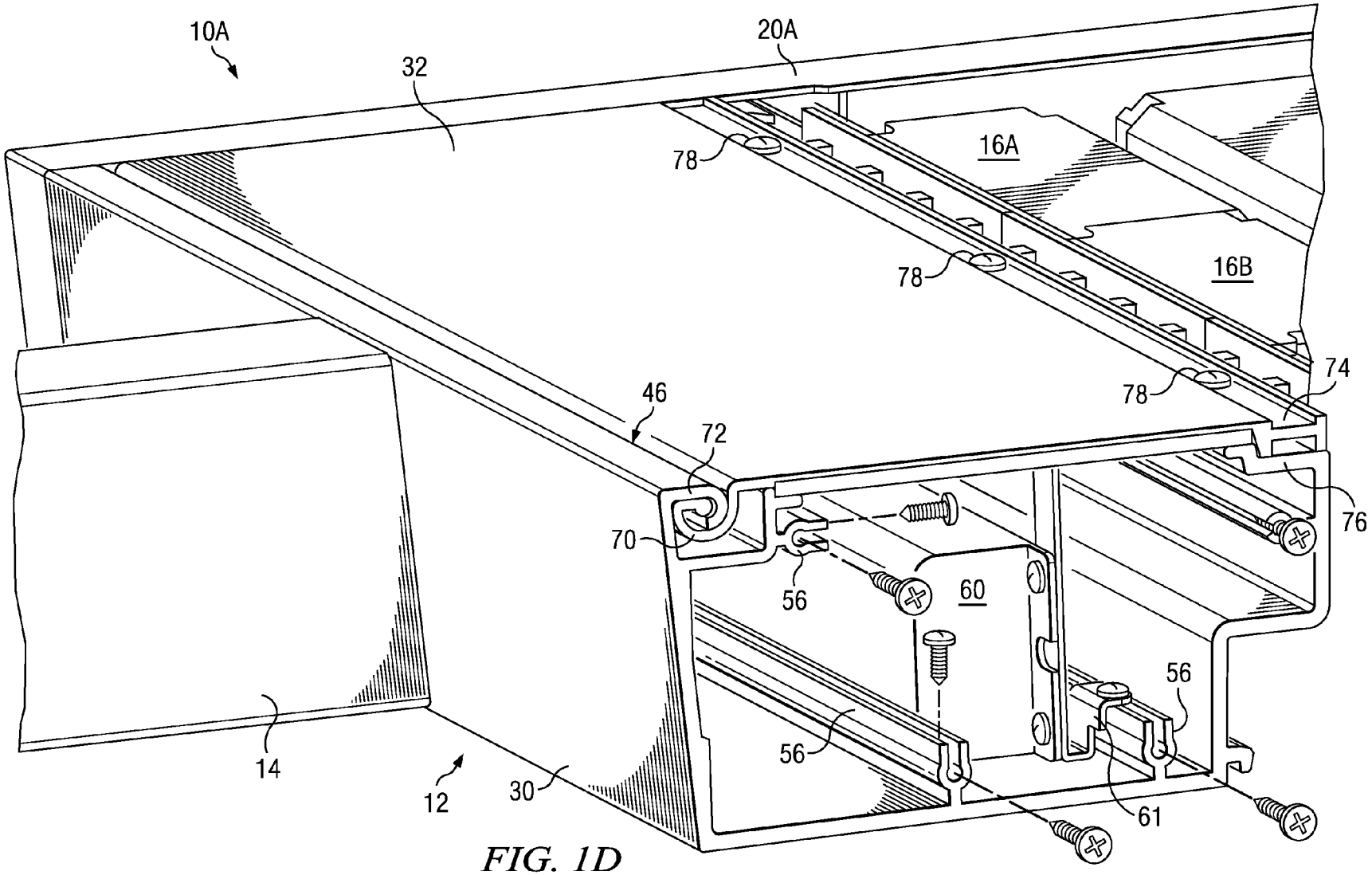
FIG. 1D is a perspective view of the housing shown in FIG. 1C, showing screw channels used for coupling various structures or components to the housing, according to an example embodiment.
Figure 1E:
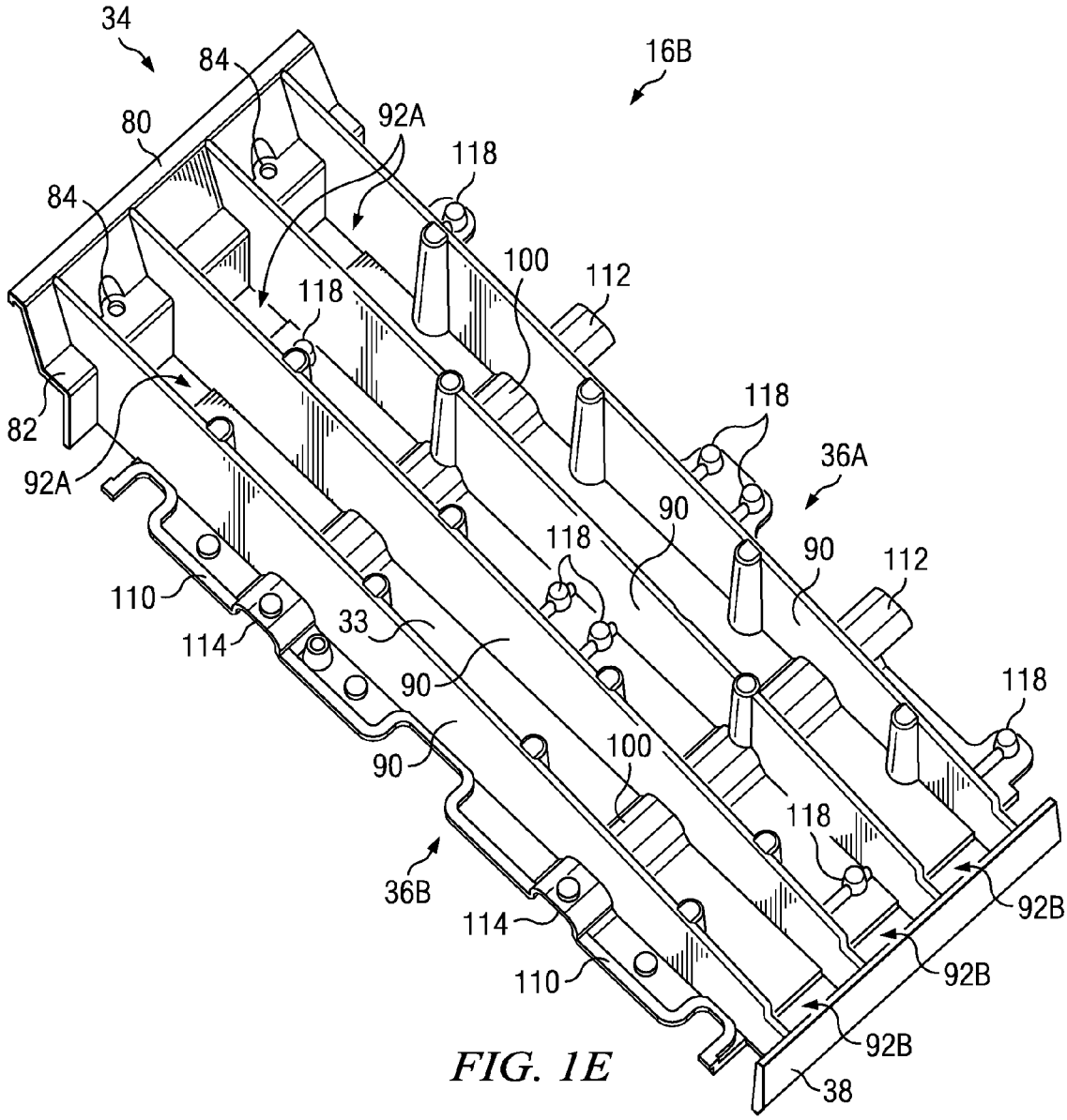
FIG. 1E is a perspective view from above of one of the heat sink modules of the lighting system of FIG. 1A.

FIG. 1A is a perspective view of heat sink module 130 according to a specific example embodiment of the disclosure. As shown, heat sink module 130 comprises heat sink 140 with attached panel 135. Heat sink 140 comprises face plate mount 121 and coupling 143. Panel 135 comprises wire channel 136. FIG. 1B is a perspective view of heat sink module 130. As shown, heat sink assembly 130 comprises panel 135 and heat sink 140, which in turn comprises coupling 143, vents 144, fins 147, and holes 149. FIG. 1C is a perspective view of heat sink module 130. FIG. 1D is a perspective view of heat sink module 130.

FIGS. 1A-1D illustrate various aspects of a first modular lighting system 10A, according to an example embodiment.

FIG. 1A is an assembled view, and FIG. 1B is an exploded view of example modular lighting system 10A. As shown, modular lighting system 10A may include a support housing 12 coupled to an extension arm 14, a plurality of heat sink modules 16 physically supported by support housing 12, and a plurality of LED panels 18 physically supported by heat sink modules 16. In the illustrated example, modular lighting system 10A is assembled with three heat sink modules 16A-16C and six LED panels 18A-18F. However, in other embodiments or configurations, modular lighting system 10A may include any other number and arrangement of heat sink modules 16 and LED panels 18.

As shown, modular lighting system 10A may also include first and second end caps 20A and 20B, a front plate 22, gaskets 24 and 25, compression plates 26, and various connectors for connecting the various components of system 10A. Support housing 12 may comprise a housing body 30 and an access door 32 coupled to the housing body 24, as discussed below with reference to FIG. 1D.

As discussed below in greater detail, each heat sink module 16A-16C has a rear side 34 that engages with support housing 12, and lateral sides 36A and 36B (shown in FIGS. 1E-1H) that engage with an adjacent heat sink module 16 or end cap 20A. Thus, adjacent heat sink modules 16 may couple to each other (e.g., in an interlocking manner), which may increase the structural integrity of modular light system 10A. End caps 20A and 20B are coupled to support housing 12 at opposite axial ends of support housing 12. A gasket 24 secured by a compression plate 26 may be provided between support housing 12 and each end cap 20A and 20B. A gasket 25 may be provided between access door 32 and body 32 of support housing 12. Gaskets 24 and 25 may seal an interior cavity of support housing 12, e.g., to protect electrical components of lighting system 10A from the exterior environment.

LED panels 18A-18F may be secured to a bottom side of heat sink modules 16A-16C. As discussed below, each LED panels 18A may be (a) connected to at least two heat sink modules 16 or (b) connected to at least one heat sink module 16 and an end cap 20, which may further increase the structural integrity of the assembled modular light system 10A.

In an example embodiment, each heat sink module 16A-16C may be molded as a single, integral component (e.g., using a die cast process), which may provide various advantages as discussed above. For example, as discussed below, each molded heat sink module 16 may include heat transfer structures (in this example, fins) 90, air flow openings 92, wiring passageways 102, and connection structures 104, 108, 110, 118, etc. for connecting the heat sink module 16 to support housing 12, adjacent heat sink module(s) 16, and/or end cap 20A. One or more of such features may not be feasibly formed by an extrusion process, without additional machining or assembly of components.

Further, support housing 12 may be extruded (e.g., each of housing body 30 and access door 32 may be extruded components), which may provide various advantages as discussed above. For example, support housing 12 may be extruded to various different lengths in order to accommodate different numbers or sizes of heat sink modules 16.

Extension arm 14 may be configured to mount lighting system 10A to a light pole or other structure, in order to provide an elevated lighting system 10A that directs light downwardly. Thus, extension arm 14 may be secured to support housing 12 and the light pole or other structure in any suitable manner, e.g., using connectors as shown in FIG. 1B.

FIG. 1C is a perspective view of housing body 30 of modular lighting system 10A, according to one embodiment. Housing body 30 may include a rear portion 40 configured for connection to extension arm 14, a top portion 42, a front portion 44 configured to engage with and physically support heat sink modules 16A-16C, and a bottom portion 46 configured to receive removable door 32, as discussed below with respect to FIG. 1D. Rear portion 42 may include holes 48 or other structures for engaging connectors for securing housing body 30 with extension arm 14. Front portion 44 may include any suitable structures or features for supporting heat sink modules 16A-16C. In this example, front portion 44 includes (a) an elongated groove 50 and a seat 52 for receiving and supporting an elongated hook structure 80 and a hip structure 82, respectively, on the rear side 34 of each heat sink module 16 (shown in FIG. 1D). Seat 52 includes holes or other mounting points 54 configured to align with holes or other mounting points 84 formed in the hip structure 82 of each heat sink module 16, for receiving screws, bolts, or other connectors to securely fasten each heat sink module 16 to support housing 12. Holes or other mounting points 54 and 84 may be positioned and/or spaced apart by distances that allow for different numbers and alignments of heat sink modules 16 along the length of support housing 12. Further, holes or other mounting points allow heat sink modules 16 to be adjusted laterally (side-to-side) with respect to support structure 12 as desired, e.g., to center the array of heat sink modules 16 with respect to support structure 12, extension arm 14, a light pole, and/or any other structure. In some embodiments, the connection between support structure 12 and heat sink modules 16 may allow for infinite adjustment, rather than adjustment between defined mounting positions.

As shown in FIG. 1C, housing body 30 may include one or more elongated channel-type connection structures 56 configured to receive screws or other connectors, e.g., for securing electronics or other devices or structures to the support housing. Channel-type connection structures 56 are also shown in FIG. 1D, which illustrates support housing 12 in an assembled stated and with end cap 20A and heat sink module 16A connected to support housing 12. As shown, access door 32 is secured to housing body 30 by inserting a first hooked edge 70 of door 32 into a corresponding first hooked edge 72 defined on the bottom side 46 of housing body 30 to provide a rotatable coupling between access door 32 and housing body 30, rotating access door 32 to the illustrated closed position, and securing a second edge 74 of door 32 to a second edge 76 of housing body 30, using screws or any other suitable connectors 78. Door 32 may provide access to the interior of housing 12 by removing connectors 78 and rotating door 32 to an open position.

As shown in FIGS. 1C and 1D, each channel-type connection structure 56 may extend in a first direction, e.g., an extrusion direction indicated by arrow $D_{ext}$. Each channel-type connection structure 56 may be configured to receive and securely engage screws or other connectors that are inserted in a direction generally perpendicular to the first direction, such perpendicular directions indicated by arrows $D_{perp}$. Such connections may be suitable for securing electronics or other structures within support housing 12. For example, as shown in FIG. 1D, an example component 60 (e.g., an LED driver, controller, surge monitor, terminal block, sensor, etc.) may be secured to a mounting bracket or other mounting structure 61, which in turn may be secured to a channel-type connection structure 56 by one or more screws or other connectors. Alternatively, component 60 may be coupled directly to a channel-type connection structure 56 by one or more screws or other connectors (e.g., without using a mounting bracket). In other configurations, a component 60 may be coupled directly or indirectly (e.g., using mounting brackets) to multiple channel-type connection structures 56.

As shown, the continuous channels provided by each connection structure 56 allows for infinite mounting positions for component 60 along the length of housing 12, which may provide increased flexibility as compared with systems that use dedicated mounting points. Thus, multiple components may be secured in support housing 12 in a very flexible manner, without being restricted to predefined mounting points along the length of the housing 12.

In some embodiments, each channel-type connection structure 56 may also receive and securely engage screws or other connectors that are inserted into the end of the connection structure 56 in a direction generally parallel to the first direction, such perpendicular directions indicated by arrows $D_{par}$ in FIG. 1C. Such connections may be suitable for securing various structures to the axial ends of housing body 30. For example, compression plates 9 and/or end caps 20 may be secured to the axial ends of housing body 30 by screws or other connectors inserted through holes in compression plates 9 and/or end caps 20 and into the axial ends of channel-type connection structures 56 in a direction $D_{par}$. Such screws are shown, for example, in the exploded view of FIG. 1A.

Channel-type connection structure 56 may have any suitable shape, size, or configuration. In the illustrated example, each channel-type connection structure 56 includes a channel defined by a rounded channel portion 62 configured to receive screws or other connectors in the parallel direction $D_{par}$ and an extended channel portion 64 configured to receive screws or other connectors in the perpendicular direction $D_{perp}$. The rounded channel portion 62 may sweep any suitable angle circumferentially. In the illustrated example, the rounded channel portion 62 sweeps an angle between 180 degrees and 360 degrees. Such angle may (a) prevent a screw or other connector inserted in the parallel direction $D_{par}$ from shifting into the extended channel portion 64, due to the angle being greater than 180 degrees, and (b) allow the leading end of screws or other connectors inserted through extended channel portion 64 in the perpendicular direction $D_{perp}$ to enter into the rounded channel portion 62, which may allow for a reduced dimension of the extended channel portion 64 in the perpendicular direction $D_{perp}$. In other embodiments, channel-type connection structure 56 may sweep any other angle, e.g., less than 180 degrees, equal to 180 degrees, or equal to 360 degrees.

The extended channel portion 64 may be defined by a pair of opposing flanges 66, which may be planar or non-planar, and which may be parallel to each other or angularly offset from each other. In the illustrated example, opposing flanges 66 are planar and parallel to each other, such that the extended channel portion 64 has a constant or substantially constant width between the opposing flanges 66. The extended channel portion 64 may extend in the perpendicular direction $D_{perp}$ by a distance sufficient to provide a desired engagement with screws or other connectors inserted in the perpendicular direction $D_{perp}$. For example, the extended channel portion 64 may extend in the perpendicular direction $D_{perp}$ by a distance sufficient to receive and engage with multiple threads of an inserted screw.

In some embodiments, the total depth $D_{channel}$ of the channel in the perpendicular direction $D_{perp}$, including both the rounded channel portion 62 and the extended channel portion 64, may be at least 1.5 times the width $W_{channel}$ of the channel in the extended channel portion 62. In some embodiments, the total channel depth $D_{channel}$ may be at least 2 times the channel width $W_{channel}$. In particular embodiments, the total channel depth $D_{channel}$ may be at least 3 times the channel width $W_{channel}$.

In the illustrated embodiment, each channel-type connection structure 56 includes a web structure 68 extending between the rounded channel portion 62 and a wall of the housing body 30, such that each channel-type connection structure 56 has a shape similar to a tuning fork. In other embodiments, each channel-type connection structure 56 may be connected to a respective wall of housing body 30 using two or more web structures 68. Alternatively, the rounded channel portion 62 and/or the extended channel portion 64 (or at least a portion thereof) may be formed integrally with a respective wall of housing body 30, e.g., such that channel-type connection structures 56 are formed as channels formed within the walls of housing body 30. Channel-type connection structures 56 may be formed and configured in any other suitable manner.

Figure 1F:
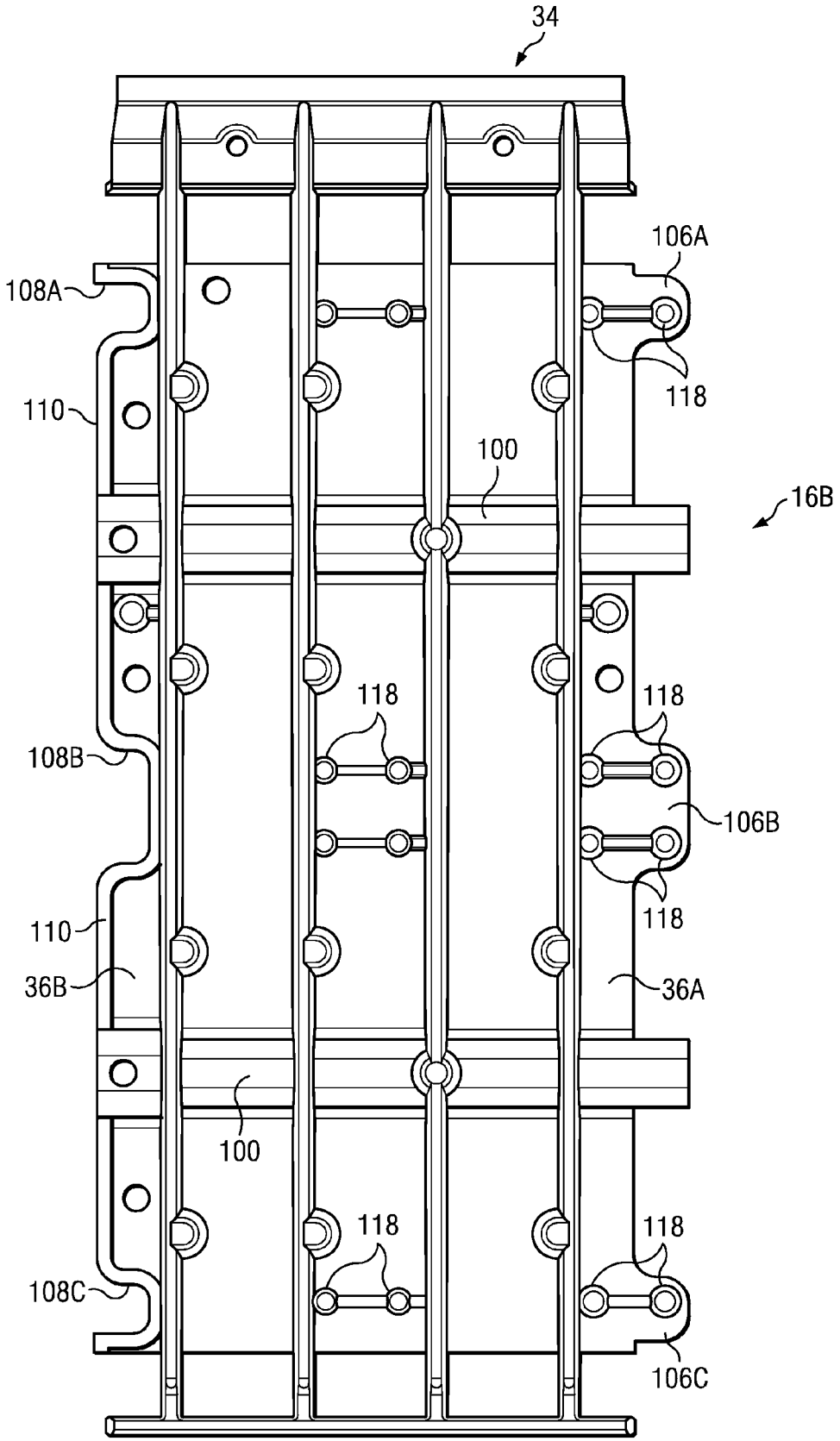
FIG. 1F is a top view of the heat sink module of FIG. 1E.

FIGS. 1E and 1F are perspective and top views, respectively, of heat sink module 16B of modular lighting system 10A. In some embodiments, heat sink modules 16A and 16C are identical or similar to heat sink module 16A.

Heat sink module 16B may include a generally planar base portion 33, a rear side 34 configured to engage with support housing 12, lateral sides 36A and 36B that engage with an heat sink modules 16A and 16C, respectively, and a front side 38 that is covered by front plate 22 shown in FIGS. 1A and 1B. As shown, heat sink module 16B may include a plurality of fins 90 extending generally perpendicularly from the generally planar base portion 33 and extending in a longitudinal direction between the front side 38 and the rear side 34 of the heat sink module 16B, for transferring heat away from one or more LED panels 18 secured to the underside of heat sink module 16B.

In addition, heat sink module 16B may includes air flow openings 92 that define ambient air flow passageways in a direction generally perpendicular to the plane of the heat sink module 16B (e.g., generally vertical air flow passageways when heat sink module 16B is installed in a generally horizontal manner). In this embodiments, such air flow openings 92 include first air flow openings 92A formed near the rear side 34 of heat sink module 16B, and second air flow openings 92B formed near the front side 38 of heat sink module 16B. As shown, each first air flow opening 92A has an enclosed perimeter defined by the base portion 33, a pair of adjacent fins 90, and structure of the rear side 34 of the heat sink module 16B. Similarly, each second air flow opening 92B has an enclosed perimeter defined by the base portion 33, a pair of adjacent fins 90, and structure of the front side 38 of the heat sink module 16B. Air flow openings 92 may provide increased convective heat transfer from heat sink module 16B.

Heat sink module 16B may a plurality of wire routing channels 100 that partially define wiring passageways 102 for routing wiring of the modular lighting system 100A. In the illustrated embodiment, heat sink module 16B includes two wire routing channels 100, which are configured to engage with two corresponding wire routing channels 100 of heat sink modules 16A and 16C to form a pair of wiring passageways 102 (see FIGS. 1G and 1H) that extend across the total width of the three heat sink modules 16A-16C. LED panels 18 secured to the underside of heat sink modules 16A-16C may form the remaining side of the wiring passageways, thus forming enclosed wiring passageways.

Heat sink module 16B may also include various connection structures for connecting or facilitating the connection of heat sink module 16B to support housing 12 and to adjacent heat sink modules 16A and 16B. For example, to couple heat sink module 16B to support housing 12, rear side 34 may include a hook structure 80 configured to be engage with groove 50 of housing body 30 and a hip structure 82 configured to rest on seat 52 of housing body 30. Holes 84 formed in hip structure 82 may be configured to align with holes 54 formed in seat 52, for receiving screws, bolts, or other connectors to securely fasten heat sink module 16B to support housing 12. Holes 84 may be positioned and/or spaced apart by distances that allow for different numbers and alignments of heat sink module 16B along the length of support housing 12.

Further, connection structures formed on leading edge 36A and trailing edge 36B of heat sink module 16B may be configured for engagement with corresponding connection structures formed on leading and trailing edges 36A and 36B of heat sink modules 16A and 16C. As shown in FIGS. 1E and 1F, leading edge 36A defines three protruding tabs 106A-106C, while trailing edge 36B defines three recesses 108A-

108C configured to receive and engage the protruding tabs 106A-106C of the adjacent heat sink module 16A. Further, each wire routing channel 100 includes a leading protrusion 112 extending from the leading edge 36A, and a trailing recess 114 formed in the trailing edge 36B of heat sink module 16B, each trailing recess 114 being configured to receive a leading protrusion 112 of the adjacent heat sink module 16A. Thus, each recess 114 may be sized larger than the corresponding protrusion 112. Trailing edge 36B may include a flange 110, best shown in FIG. 1H, extending along the length of the trailing edge, as discussed below.

Heat sink module 16B may also include mounting points 118 (e.g., screw bosses) configured to receive screws or other connectors for securing one or more LED panels 108 to the underside of heat sink module 16B. Mounting points 118 may be located at various positions to allow for multiple different numbers, positions, or configurations of LED panel(s) secured to heat sink modules 16A-16C. In some embodiments, one or more mounting points 118 may be provided on protruding tabs 106, indicated as mounting points 118A in FIG. 1H. As shown, mounting points 118A on tabs 106 may thus project into the footprint of an adjacent heat sink module 16, which may facilitate the coupling of individual LED panels 18 to multiple heat sink modules 16 (e.g., to provide increased structural integrity for system 10A). For example, an example positioning of an LED panel 18 is shown by dashed lines in FIG. 1H. As shown, the position of the LED panel 18 corresponds with one half of the footprint of heat sink module 16C. However, due to protruding tabs 106 of heat sink module 16B projecting into the footprint of heat sink module 16C, the LED panel 18 can be secured not only to mounting points 118 of heat sink module 16C, but also to a pair of mounting points 118A on tabs 106 of heat sink module 16B. Coupling individual LED panels 18 to multiple heat sink modules may provide additional structural integrity to system 10A.

Figure 1G:
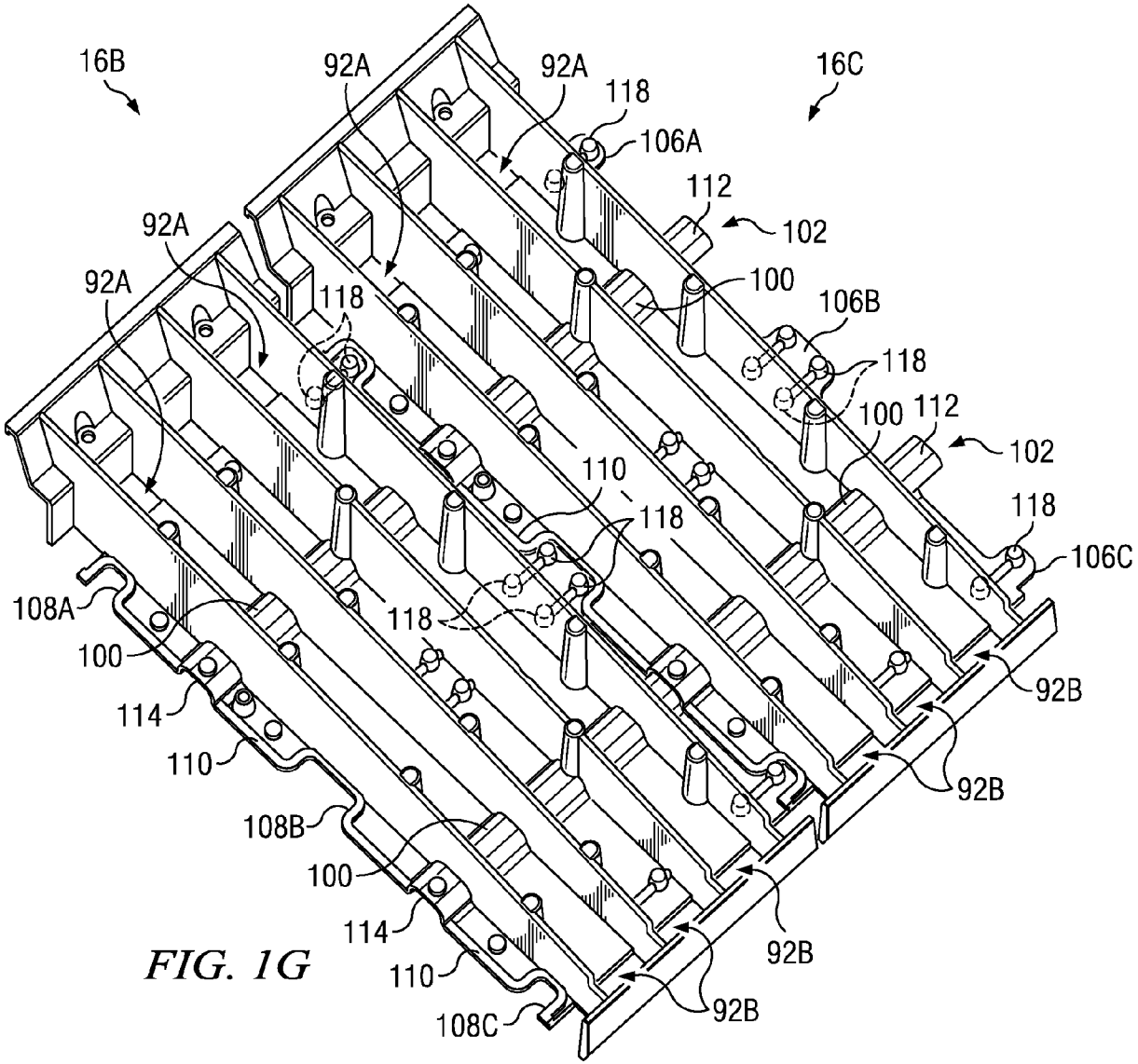
FIG. 1G is a perspective view from above of two heat sink modules of the lighting system of FIG. 1A, showing the interconnection of the heat sink modules.
Figure 1H:
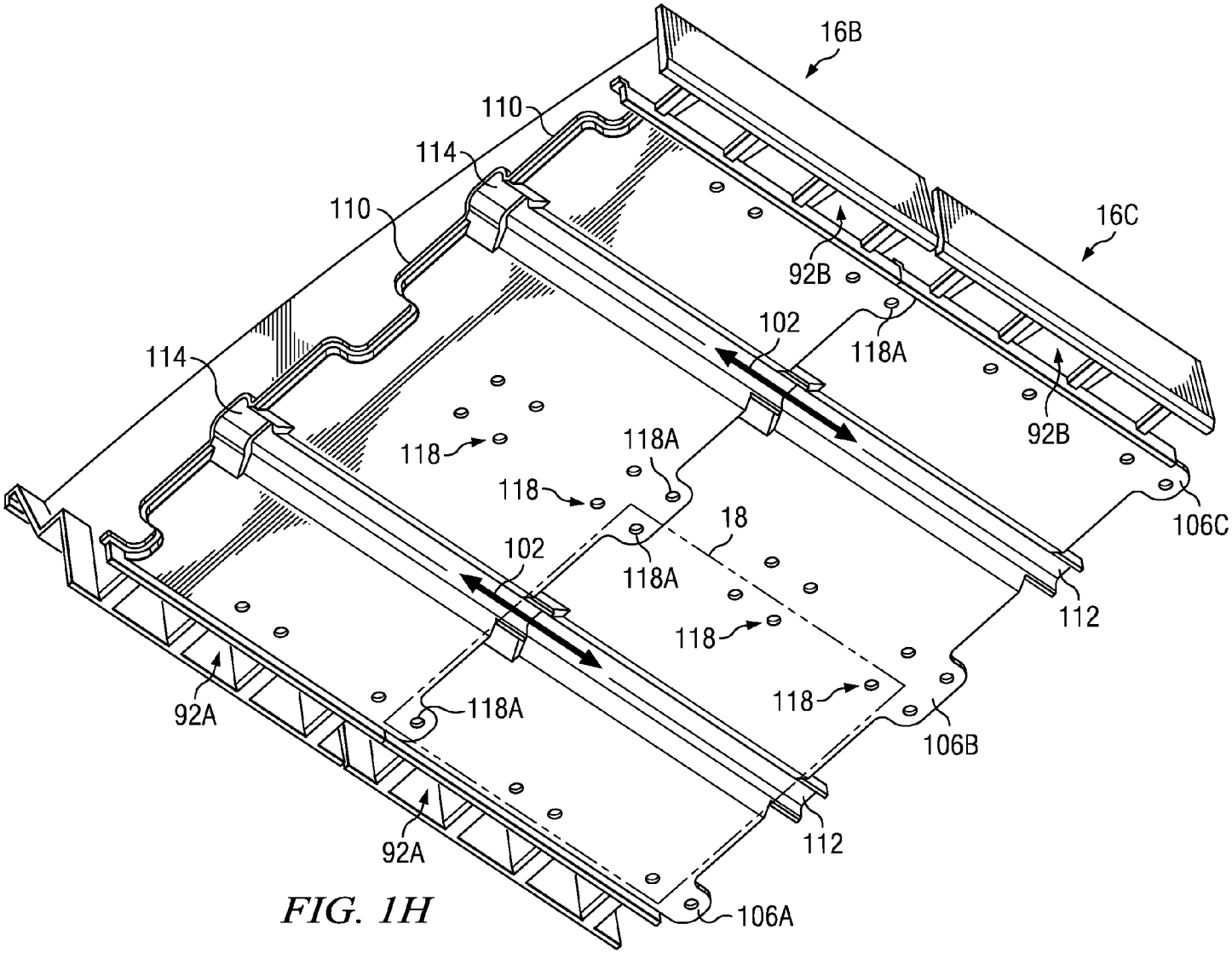
FIG. 1H is a perspective view from below of the two interconnected heat sink modules of FIG. 1G, showing the interconnection of the heat sink modules.
Figure 11:
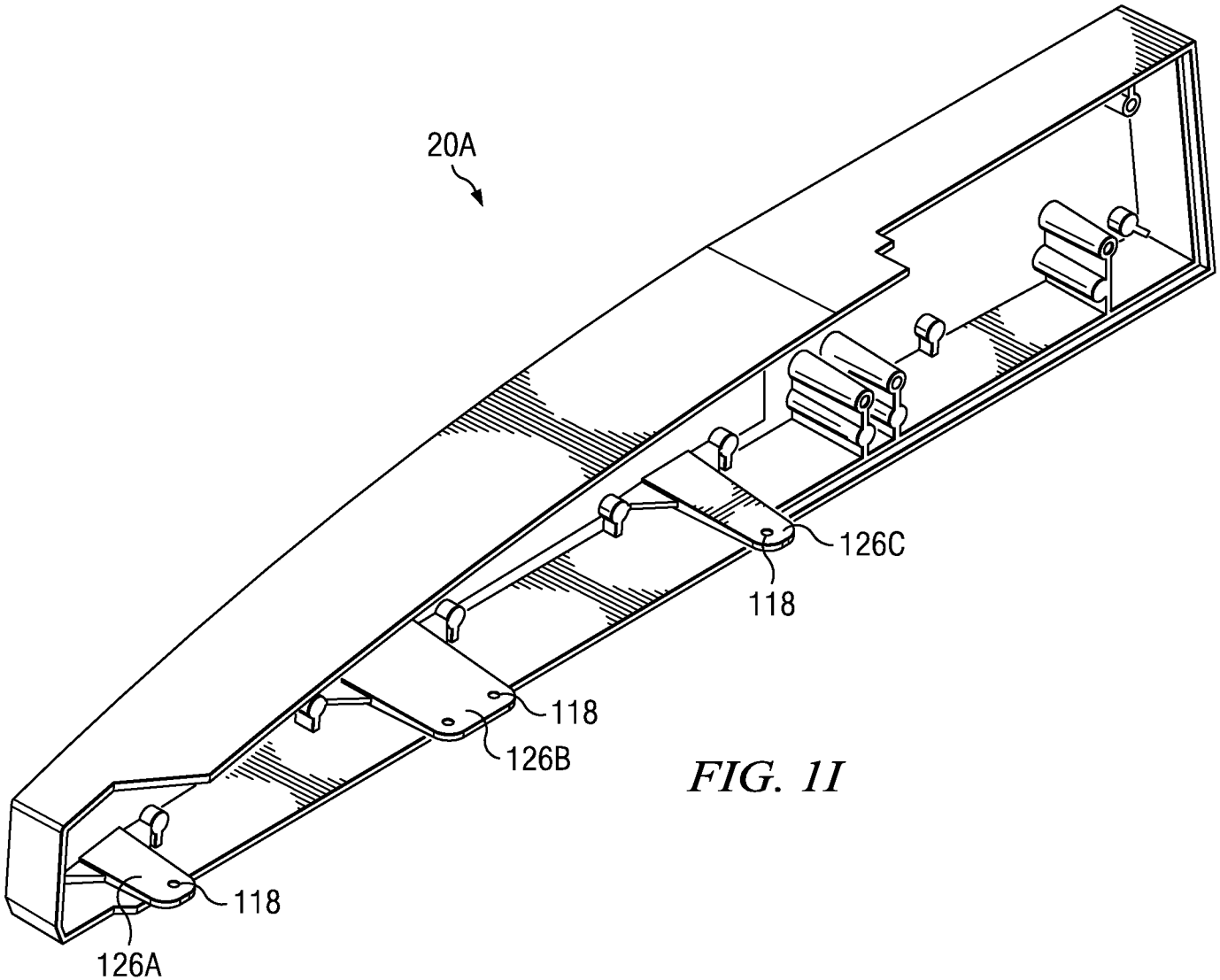
FIG. 11A is a perspective view from above of another modular lighting system, according to an example embodiment.
FIG. 11B is a perspective view from below of the modular lighting system of FIG. 11A mounted to a pole.

FIGS. 1G and 1H illustrate perspective views from above and below, respectively, or heat sink module 16B assembled with adjacent heat sink module 16C. As shown, the leading edge 36A of heat sink module 16B interlocks with the trailing edge 36B of heat sink module 16C. In particular, protruding tabs 106A-106C of heat sink module 16B are received in corresponding recesses 108A-108C of heat sink module 16C. Further, the leading protrusion 112 of each wire routing channel 100 of heat sink module 16B is received in the trailing recess 114 of each wire routing channel 100 of heat sink module 16C. A leading portion of the leading edge 36A of heat sink module 16B may be received under the flange 110 formed on the trailing edge 36B of heat sink module 16C. These interlocking engagements may help ensure proper alignment of heat sink modules and/or provide additional structural integrity to system 10A, when assembled. In addition, by covering the edge of the adjacent heat sink module, flange 110 may act to prevent or reduce light flow between the adjacent heat sink modules (e.g., upwards through the lighting system 10A), thereby reducing unwanted losses in light output.

Figure 1J:
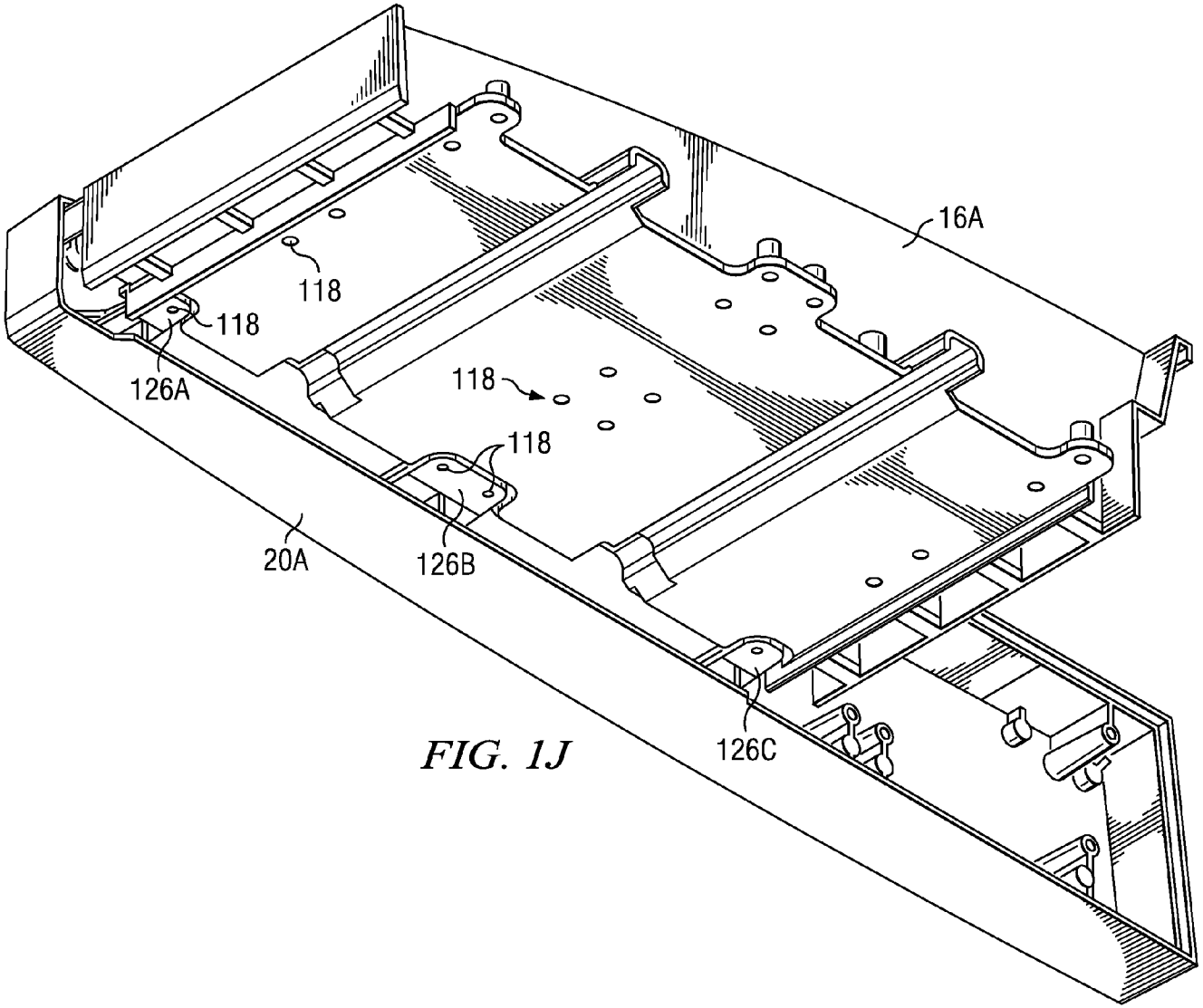
FIG. 1J is a perspective view from below of the end cap of FIG. 1I interconnected with one of the heat sink modules.

FIG. 1I is a perspective view from above of end cap 20A of modular lighting system 10A. FIG. 1J is a perspective view from below of end cap 20A assembled with adjacent heat sink module 16A. As shown, end cap 20A may include protruding tabs 126A-126C configured to be received in recesses 108A-108C formed in trailing edge 36B of heat sink module 16A. Thus, protruding tabs 126A-126C are analogous to protruding tabs 106A-106C of heat sink modules 16. The engagement of protruding tabs 126A-126C with recesses 108A-108C may provide increased structural integrity to system 10A. Further, protruding tabs 126A-126C may include mounting points 118 for mounting one or more LED panels 18.

Figure 1K:
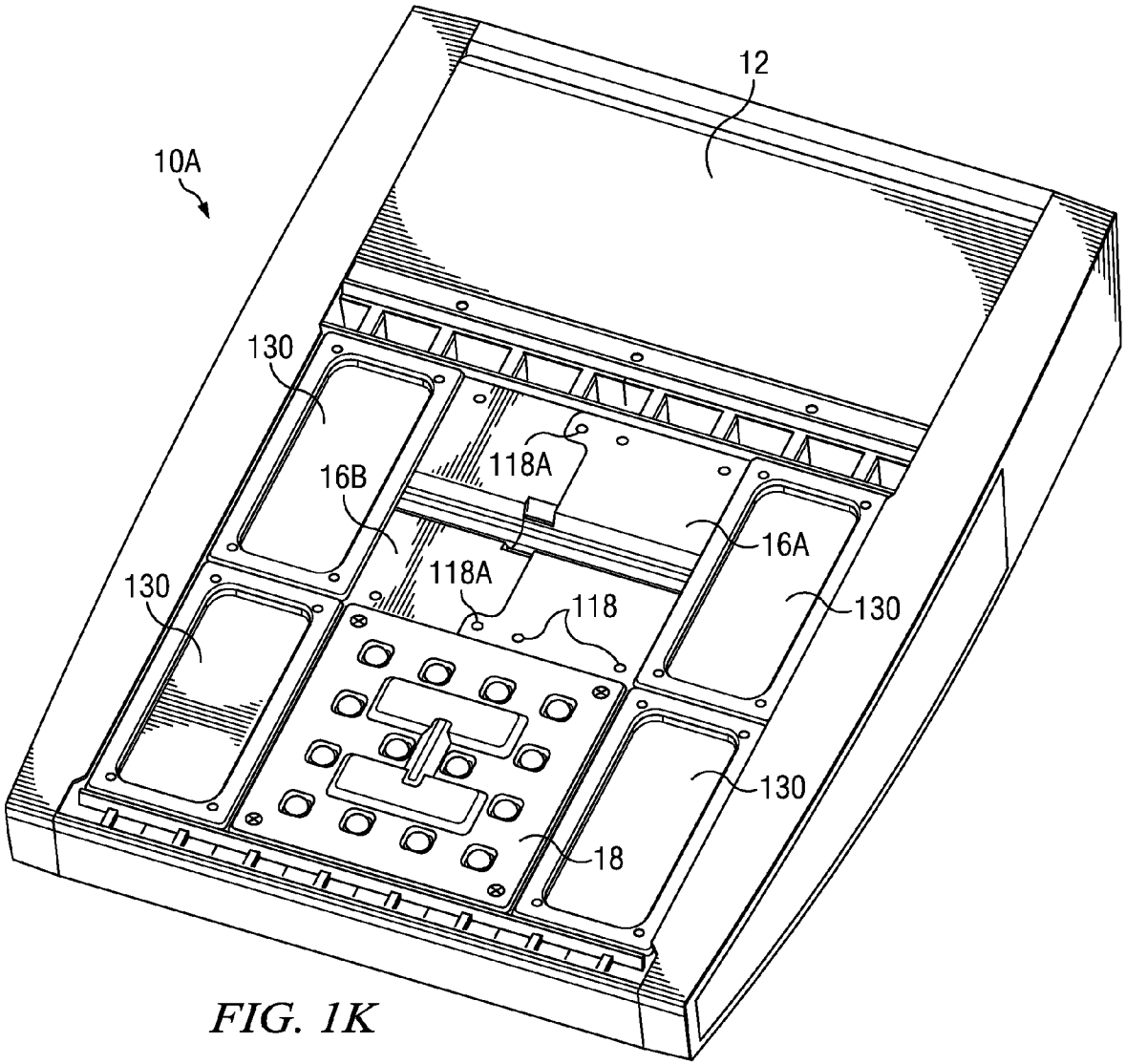
FIG. 1K is a perspective view from below of the lighting system of FIG. 1A, in an example configuration having two light panels, according to an example embodiment.
Figure 1L:
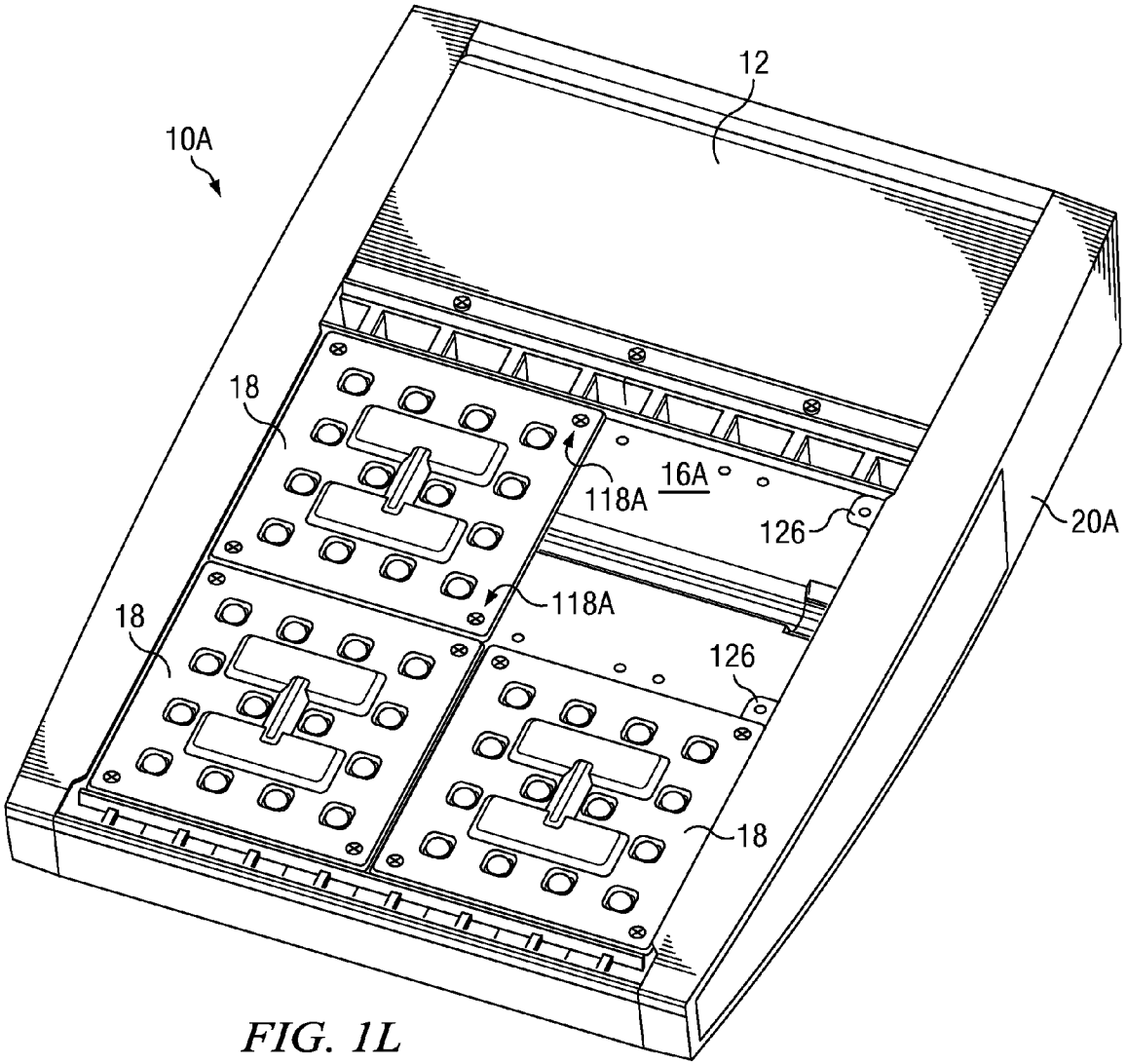
FIG. 1L is a perspective view from below of the lighting system of FIG. 1A, in an example configuration having four light panels, according to another example embodiment.

FIGS. 1K and 1L provide views from below of modular lighting system 10A assembled with two heat sink modules 16A and 16B in a two-panel configuration (FIG. 1K) and a four-panel configuration (FIG. 1L). For the sake of illustration, the second LED panel is not shown installed in FIG. 1K, and the fourth LED panel is not shown installed in FIG. 1L.

In the two-panel configuration shown in FIG. 1K, each LED panel 18 is positioned such that it straddles the interface between heat sink modules 16A and 16B, and is thus coupled to mounting points 118 of both heat sink modules 16A and 16B. Filler plates 130 may be installed for various reasons, e.g., to enclose the wiring passageways 102, protect the components of system 10A, for aesthetic purposes, etc.

In the four-panel configuration shown in FIG. 1L, each LED panel 18 is positioned such that it is generally aligned with the footprint of one of the heat sink modules 16A or 16B. However, due to tabs 106 of heat sink module 16A projecting into the footprint of heat sink module 18B, the LED panels 18 aligned with the footprint of heat sink module 16B are also secured to heat sink module 16A at mounting points 118A in such tabs 106. Further, due to tabs 126 of end cap 20A projecting into the footprint of heat sink module 16A, the LED panels 18 aligned with the footprint of heat sink module 16A are also secured to end cap 20A at mounting points 118 in such tabs 126. Such interlocking engagement between LED panels 18, heat sink module 16, and end cap 20A may provide increased structural integrity to system 10A.

Figure 2A:
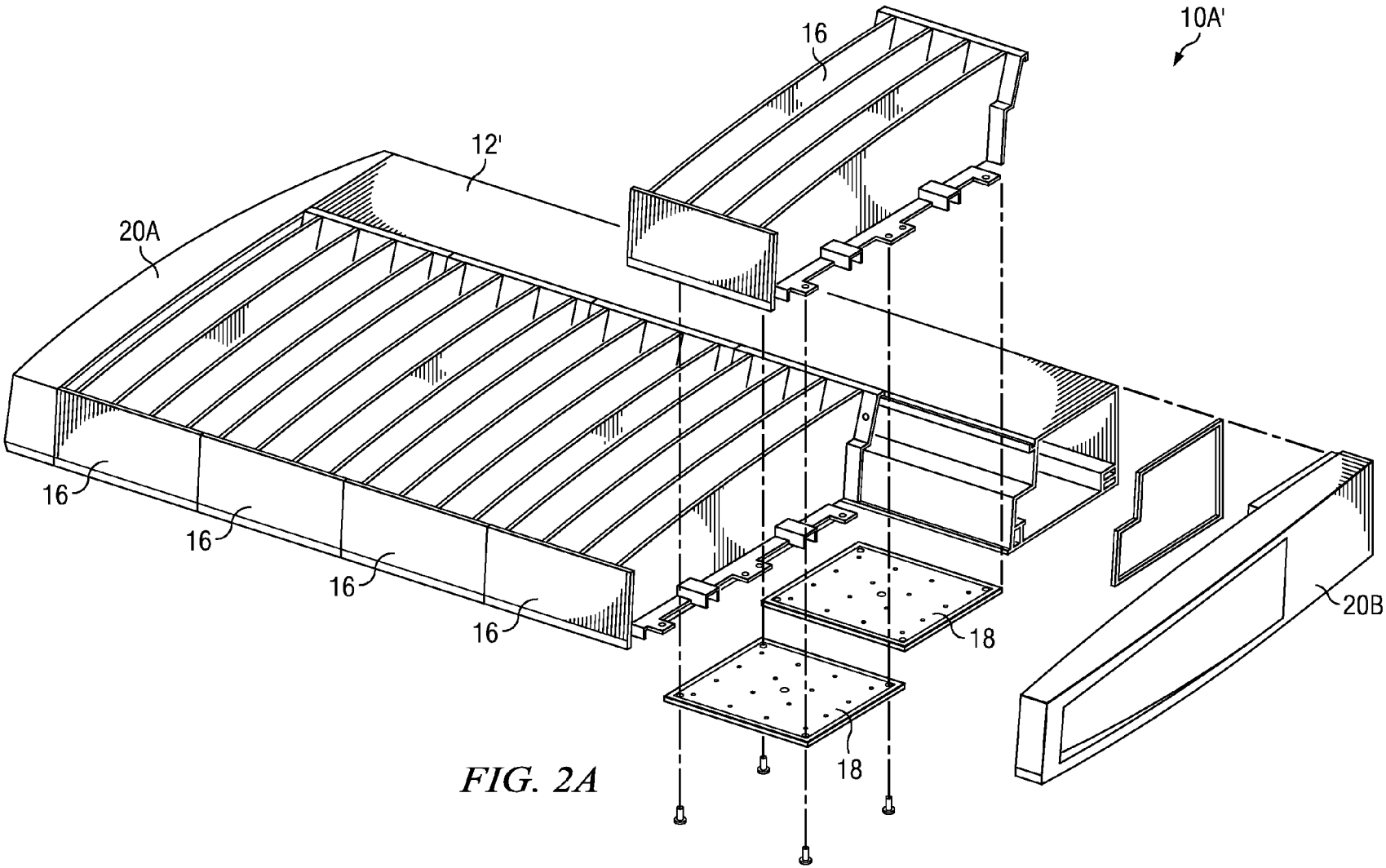
FIGS. 2A and 2B are partially exploded views of the modular lighting system of FIGS. 1A-1L, but configured with five heat sink modules and 10 light panels, according to an example embodiment.
Figure 2B:
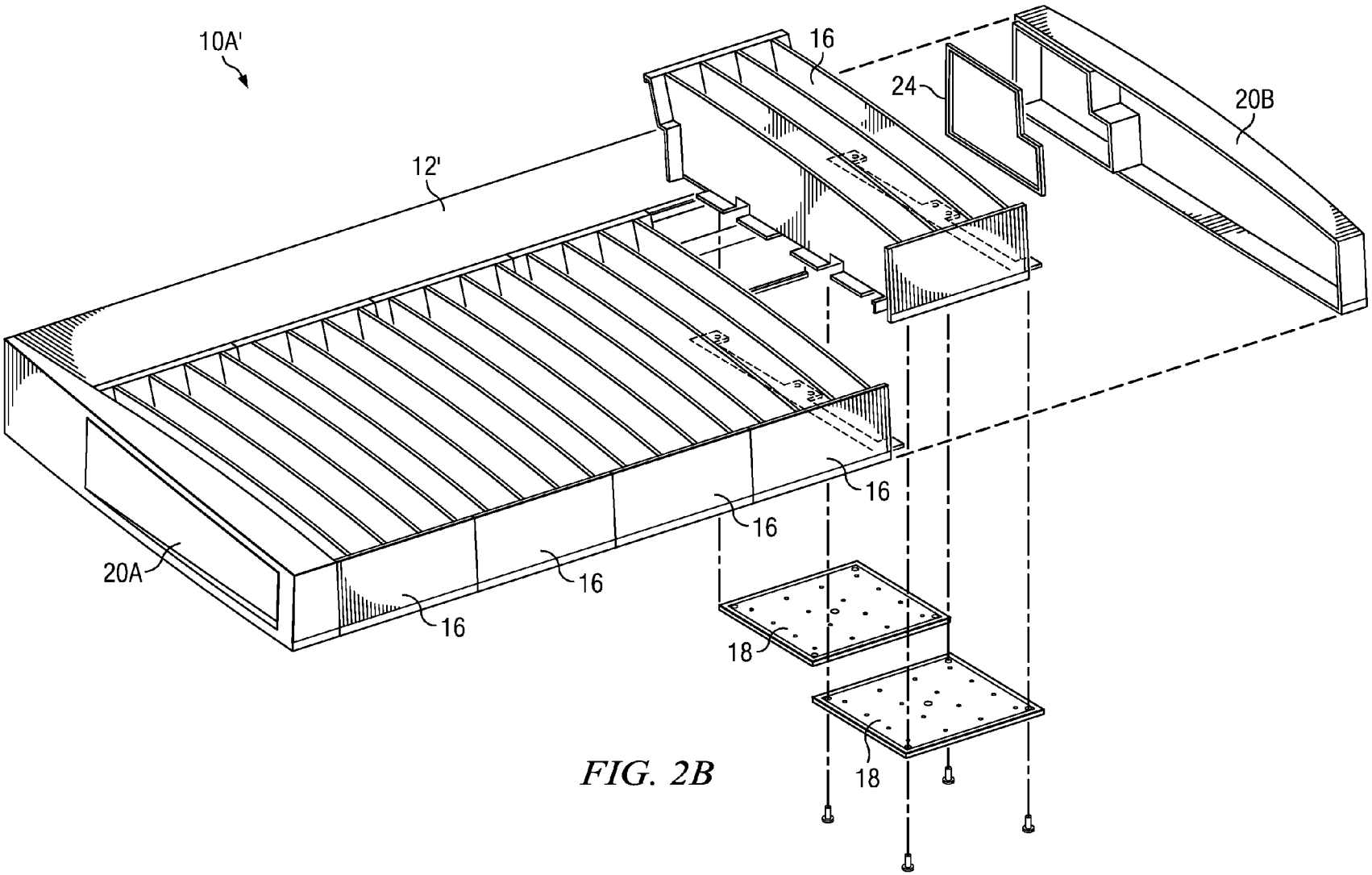
Figure 2C:
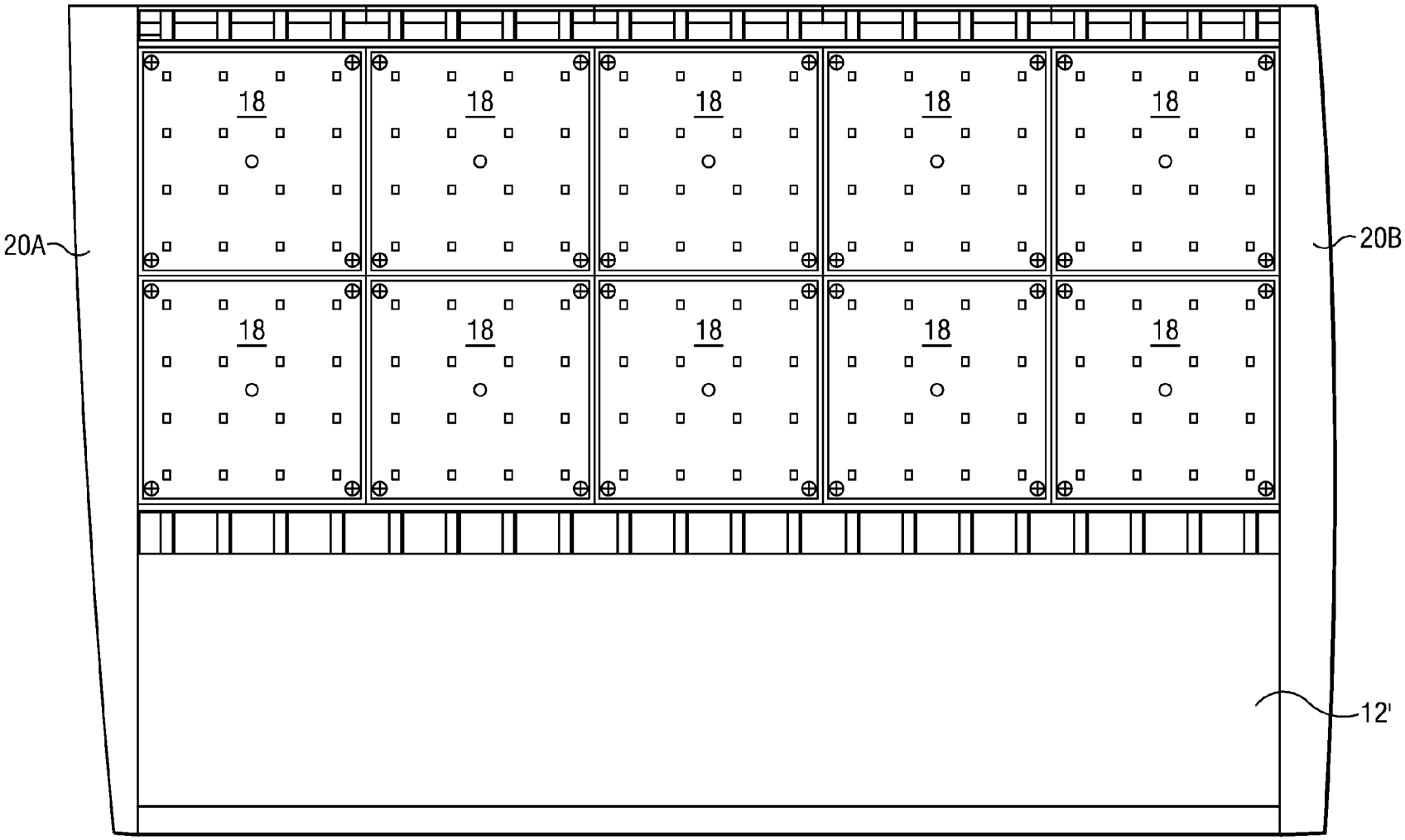
FIG. 2C is a bottom view of the lighting system configuration of FIGS. 2A and 2B, according to an example embodiment.

FIGS. 2A-2C illustrate various views of modular lighting system 10A' which may be identical to modular lighting system 10A of FIGS. 1A-1L, but configured with five heat sink modules and 10 LED panels (instead of three heat sink modules and six LED panels), according to an example embodiment. In particular, FIGS. 2A and 2B are partially exploded views, and FIG. 2C is a bottom view, of modular lighting system 10A configured with five heat sink modules and 10 LED panels.

As shown in FIGS. 2A-2C, modular lighting system 10A' may include a support housing 12', five heat sink modules 16, and 10 LED panels 18. Support housing 12' may be similar or identical to support housing 12 of modular lighting system 10A, but longer to accommodate five heat sink modules instead of three. Thus, in embodiments in which the support housing is formed by an extrusion process, support housing 12' may be formed in the same manner (e.g., using the same or similar tooling) as support housing 12, but simply extruded to a greater length.

Thus, in some embodiments, modular lighting system 10A may be converted between the configuration shown in FIGS. 1A-1L and the configuration shown in FIGS. 2A-2C by simply replacing the support housing (e.g., by selecting support housing 12 or support housing 12') and assembling the appropriate number of heat sink modules and LED panels. Thus, modular lighting system 10A/10A' may be a fully modular system that can be easily sized and configured as desired for the relevant application.

As discussed above with respect to heat sink modules 16A-16C of modular lighting system 10A, each heat sink module 16 of modular lighting system 10A' is configured to interlock with an adjacent heat sink module 16 on one or both lateral sides of that heat sink module 16.

Figure 3A:
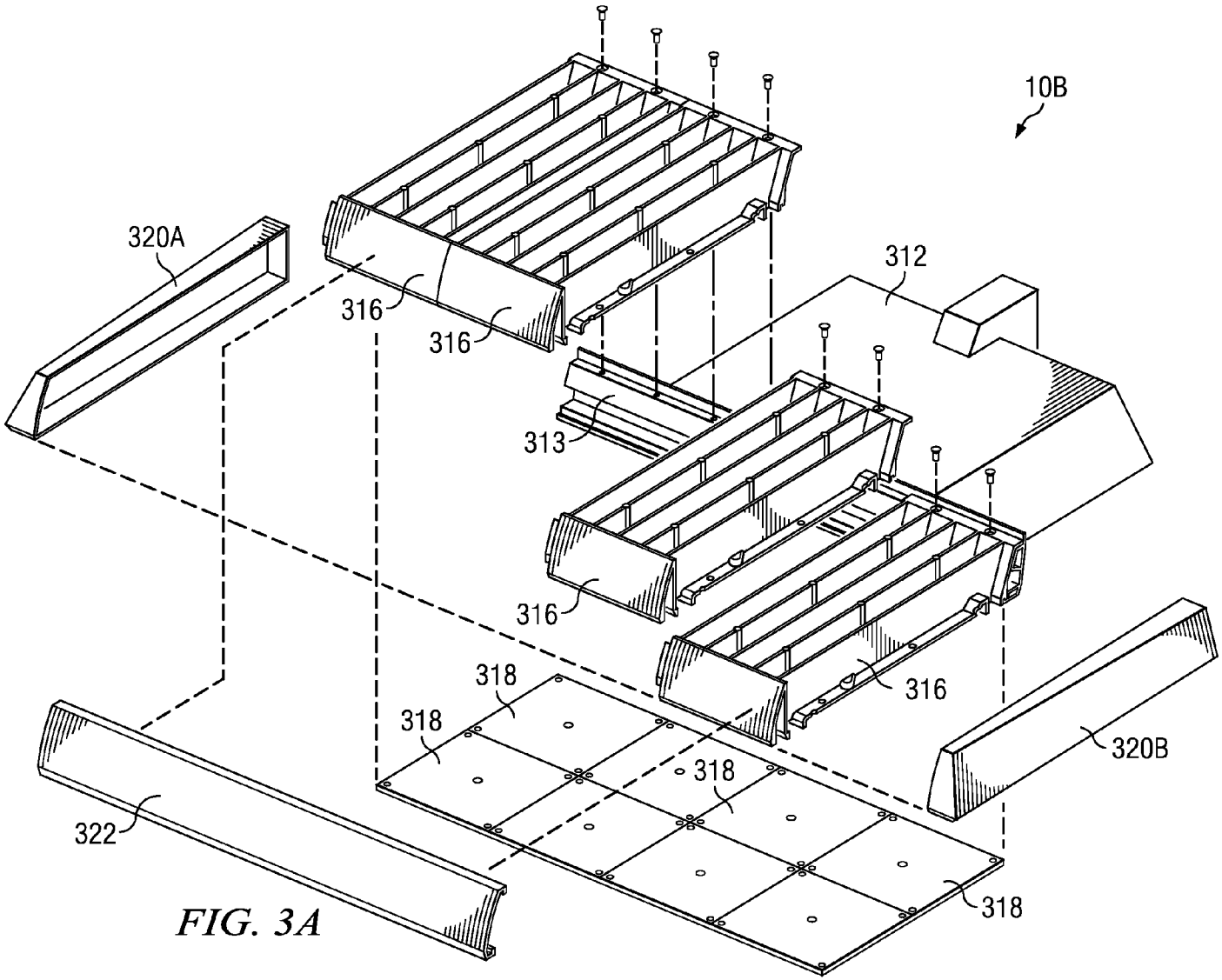
FIG. 3A is a perspective exploded view of another modular lighting system, according to an example embodiment.
Figure 3B:
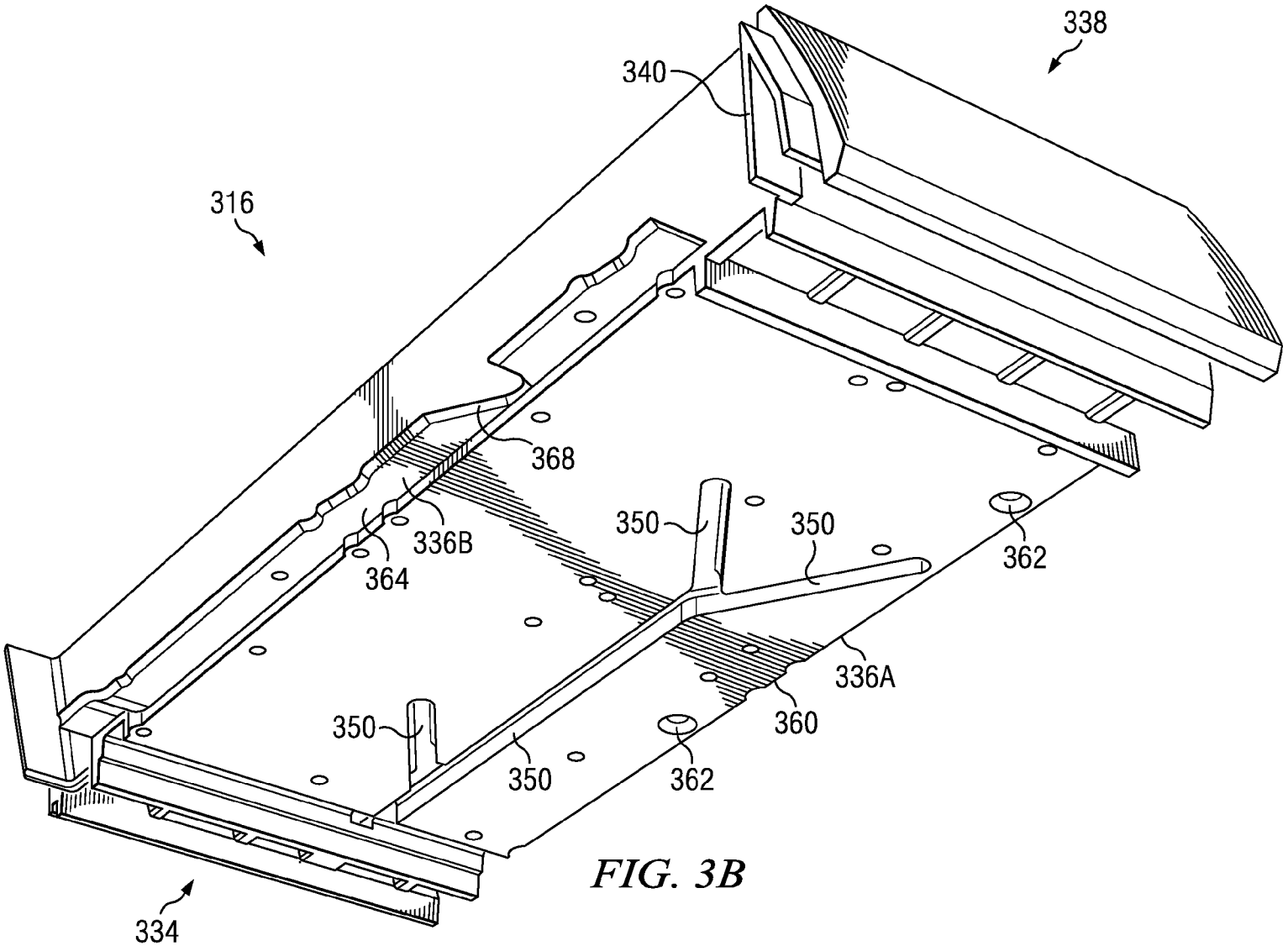
FIGS. 3B-3E are various perspective views of one of the heat sink modules of the lighting system of FIG. 3A.
Figure 3C:
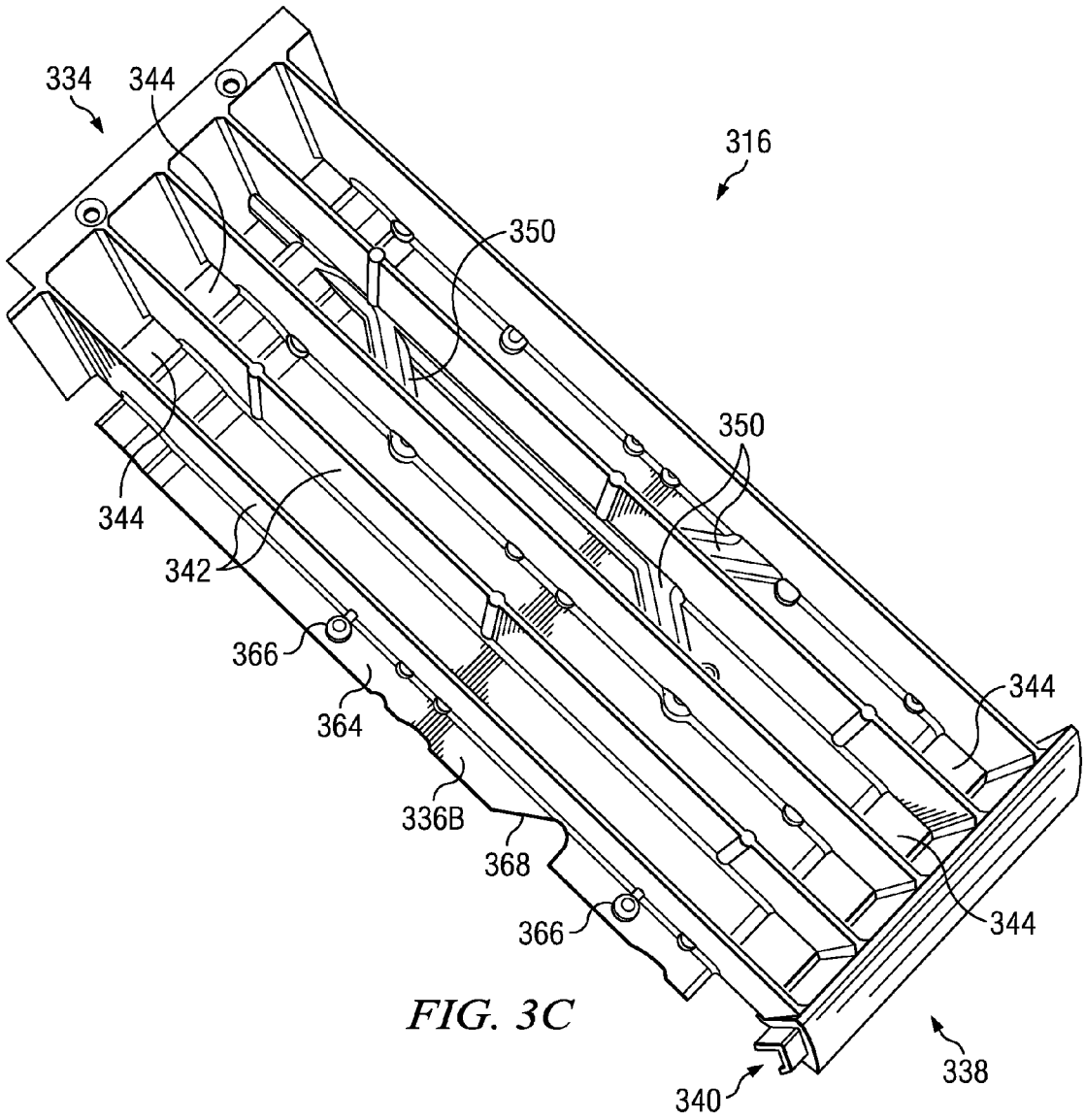
Figure 3D:
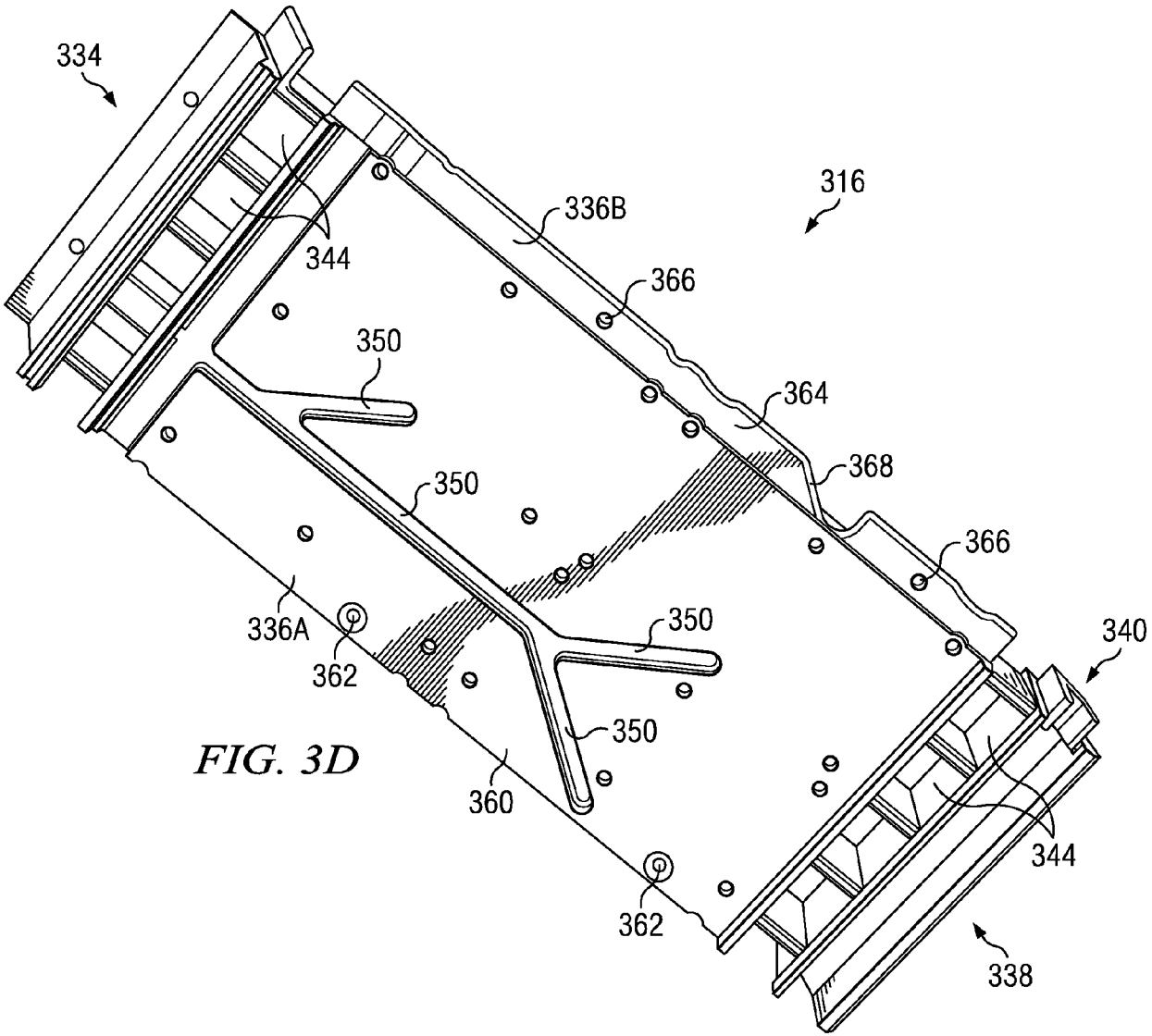
Figure 3E:
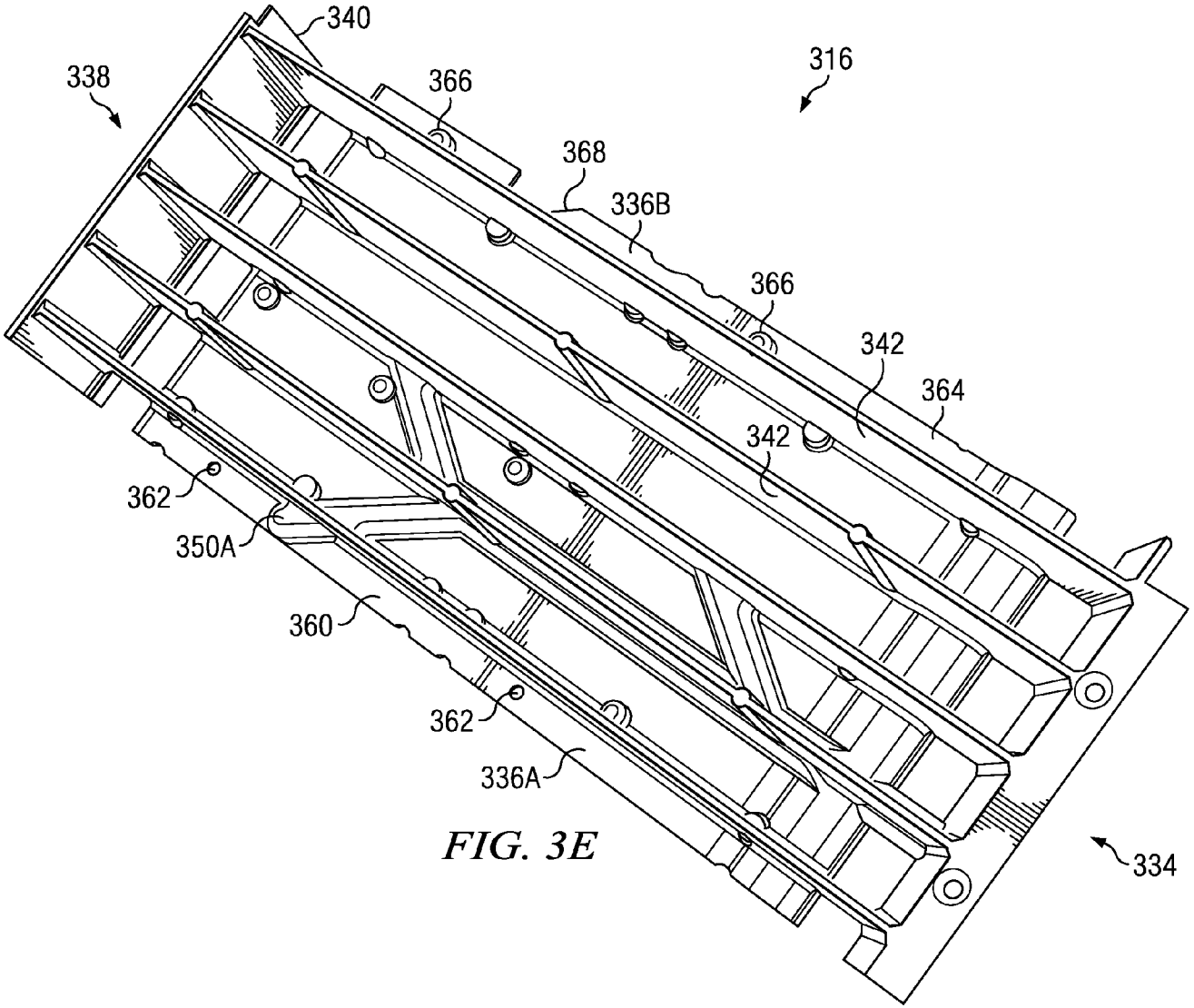

FIGS. 3A-3H illustrate various aspects of another modular lighting system 10B, according to an example embodiment. FIG. 3A is a perspective exploded view of modular lighting system 10B. As shown, like modular lighting system 10A, modular lighting system 10B includes a support housing 312, a plurality of heat sink modules 316 supported by the support housing 312, a plurality of LED panels 318 secured to an underside of the heat sink modules 316, a pair of end caps 320A and 320B, and a front plate 322. However, heat sink modules 316 are structurally different than heat sink modules 16 of modular lighting system 10A, and heat sink modules 316 couple to support housing 312 and to each other in a different manner than heat sink modules 16, as discussed below.

Figure 3F:
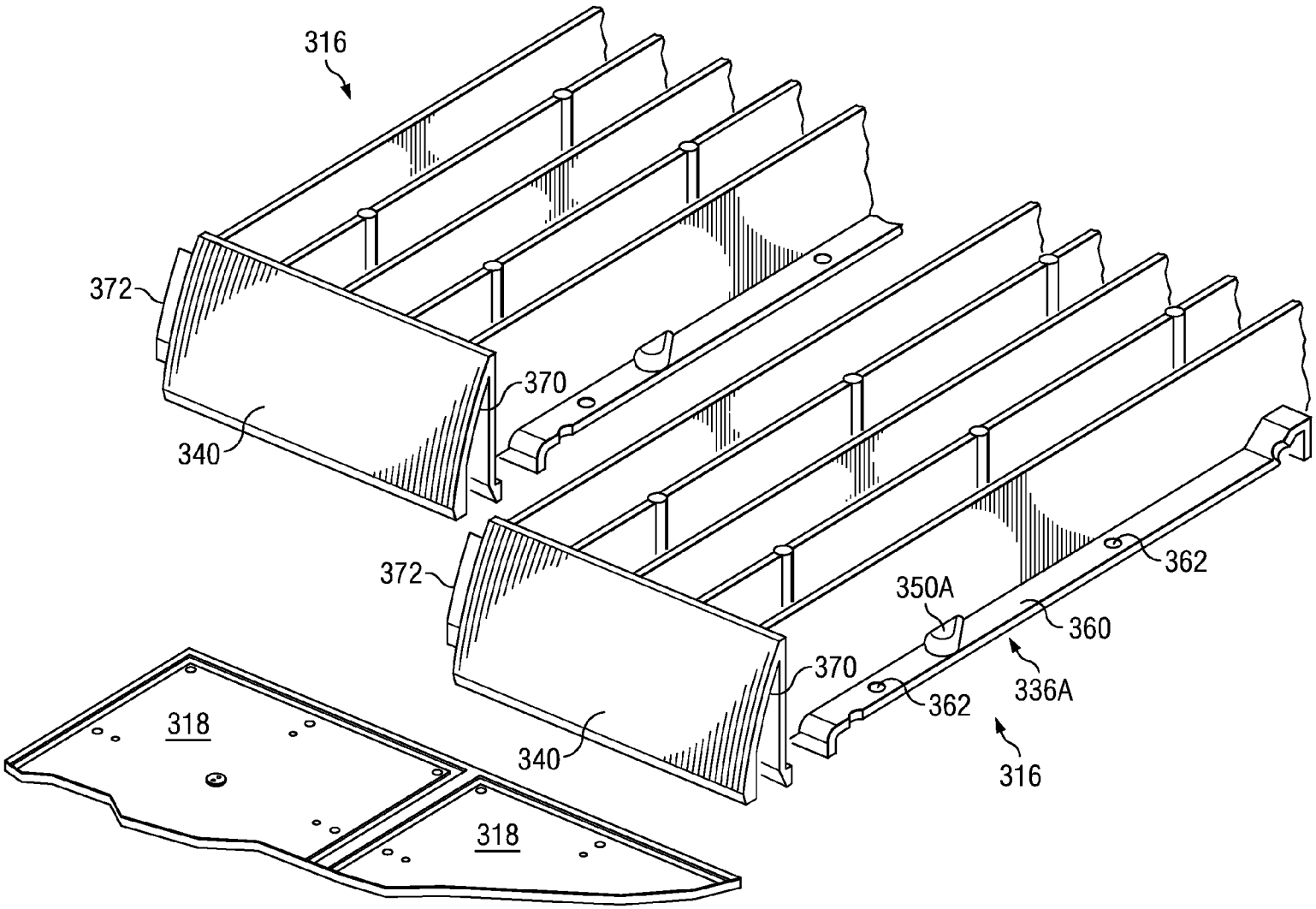
FIGS. 3F and 3G illustrate aspects of the interconnection of two heat sink modules in the modular lighting system of FIG. 3A.
Figure 3G:
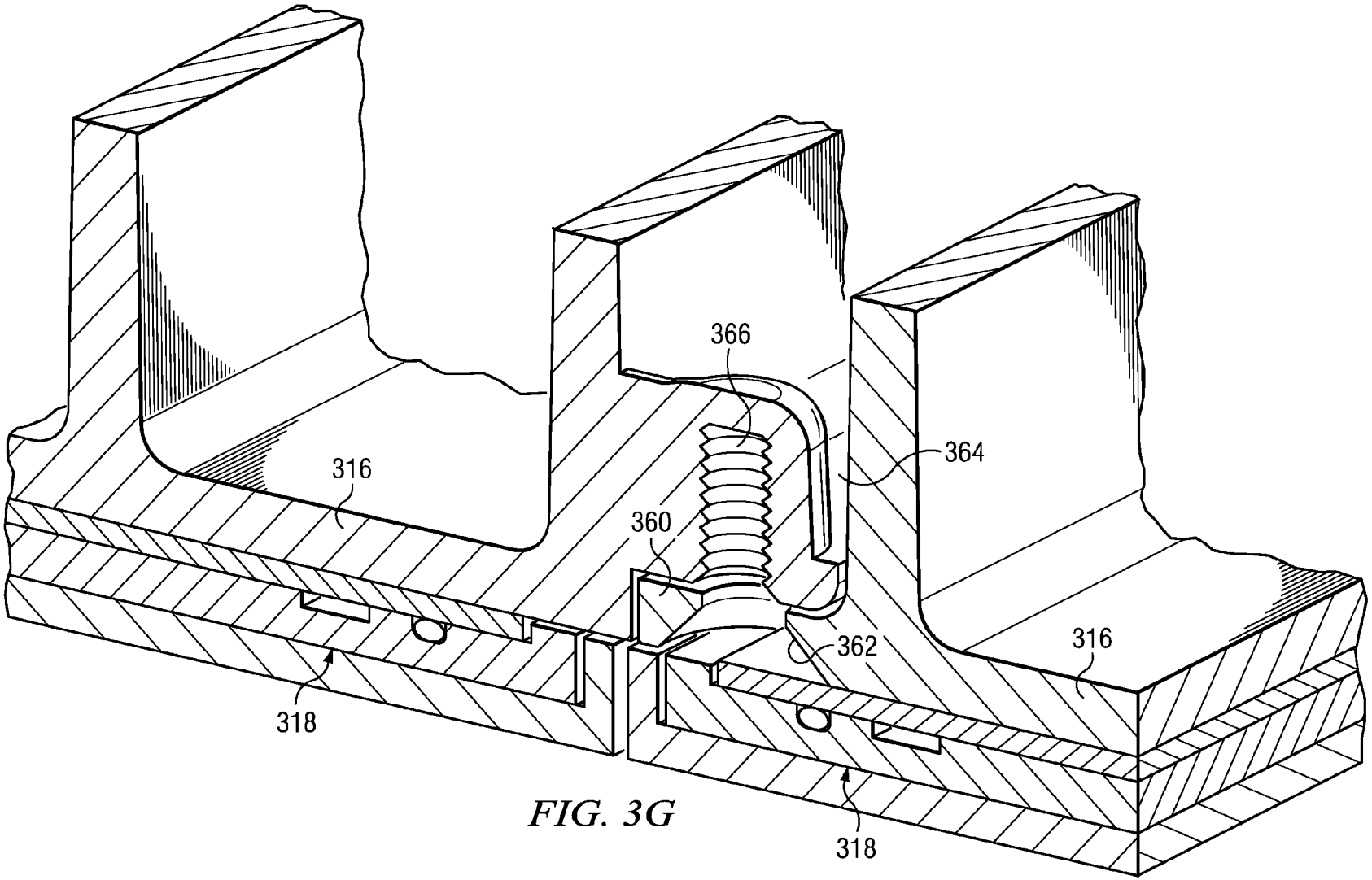
Figure 3H:
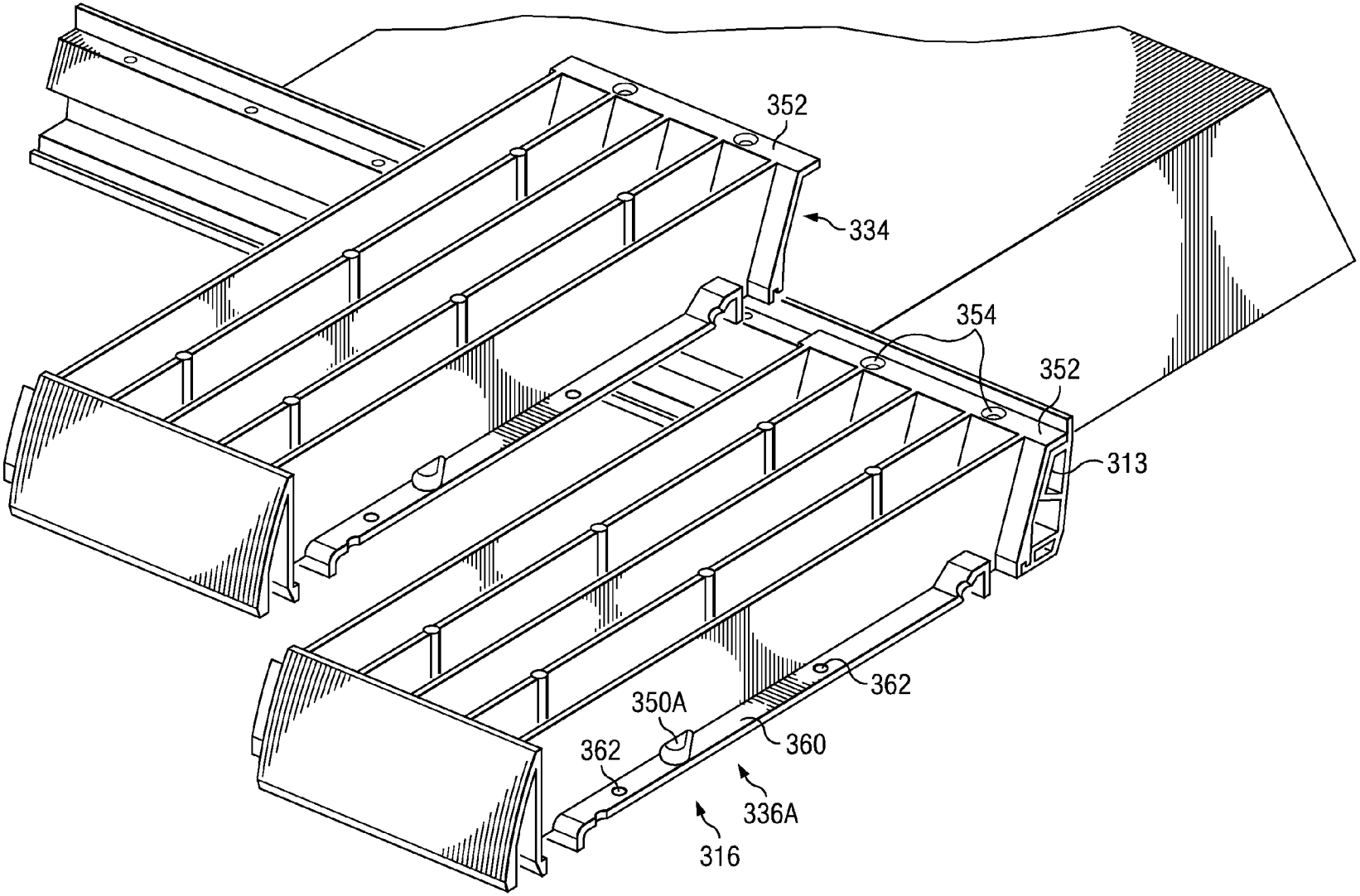
FIG. 3H shows the assembly of heat sink modules to a support beam of the lighting system of FIG. 3A.

FIGS. 3B-3E are various perspective views of one heat sink module 316 of modular lighting system 10B. FIGS. 3F and 3G illustrate the coupling of adjacent heat sink modules 316 to each other, and FIG. 3H illustrates the coupling of heat sink modules 316 to a support beam 313 of support housing 312.

Turning first to FIGS. 3B-3E, heat sink module 316 may include a rear side 334 configured to engage with support beam 313 of support housing 312, lateral sides 336A and 336B that engage with adjacent heat sink modules 316, and a front side 338 that includes a V-shaped coupling structure 340 for further engagement with the adjacent heat sink modules 316. In some embodiments, support housing may include an electronics housing 311 and support beam 313 coupled to the electronics housing 311. In some embodiments, electronics housing 311 is a molded structure and support beam 313 is an extruded structure (e.g., extruded aluminum). Thus, the support beam 313 may be extruded or cut to length to accommodate a selected number of heat sink modules 316 and coupled to electronics housing 311, such that one size electronics housing 311 can be used for different number of heat sink modules 316, e.g., to provide an application-specific modular system. Support beam 313 may also provide a wire way to rout wires from heat sink modules 316/light modules 318 into electronics housing 311.

Like heat sink module 16, heat sink module 316 may include a plurality of fins 342 for transferring heat away from LED panels 318, a plurality of openings 344 that define generally vertical ambient air flow passageways (when heat sink module 316 is installed in a horizontal orientation), and a wire routing channel 350 for routing wiring of the modular lighting system 100B. In the illustrated embodiment, wire routing channel 350 may have a generally branched configuration, with each branch extending to a location corresponding to a possible wiring location of an LED panel 18 mounted to the underside of the heat sink module 316. The installed LED panel(s) 18 may enclose the wiring passageways, as discussed above.

As mentioned above, heat sink modules 316 may be configured to couple to support housing 312 and to each other in a different manner than heat sink modules 16 of modular lighting system 10A. To mount heat sink modules 316 to support housing 312, the rear side 334 of each heat sink module 316 may include a mounting flange 352 having mounting holes 354 for securing heat sink module 316 to a support beam 313 of support housing 312, using screws or other suitable connectors, as shown in FIG. 3H.

Further, to couple heat sink modules 316 to each other, the lateral sides 336A and 336B of adjacent heat sink modules 316 may be arranged in an overlapping manner and secured together using screws or other suitable connectors. With reference to FIGS. 3B-3E, lateral side 336A may include a first flange 360 having mounting holes 362 and a portion 350A of wire routing channel 350 extending into first flange 360, while lateral side 336B may include a second flange 364 including mounting bosses 366 aligned with mounting holes 362 in first flange 360 and a recess or cutout 368 aligned with wire routing channel portion 350A of first flange 360.

To couple heat sink module 316 with adjacent heat sink modules 316, the second flange 364 on lateral side 336B is arranged over the first flange 360 on lateral side 336A such that mounting holes 362 align with mounting bosses 366, and wire routing channel portion 350A is received in cutout 368. Screws or other suitable connectors may then be inserted through mounting holes 362 and mounting bosses 366, to secure the heat sink modules 316 to each other. FIG. 3G illustrates a cross-sectional view through a first flange 360 and second flange 364 of adjacent heat sink modules 316, showing the alignment of a mounting holes 362 and mounting boss 366, though which a screws or other suitable connector may be inserted. FIG. 3G also shows LED panels 318 mounted to the underside of the assembled heat sink modules 316, in one example configuration.

In addition, heat sink modules 316 may be further secured to each other at the front side 338. As shown in FIGS. 3B-3E, each heat sink module 316 includes a V-shaped coupling structure 340 for further engagement with the adjacent heat sink modules 316. FIG. 3F illustrates the engagement of V-shaped coupling structures 340 during the assembly adjacent heat sink modules 316. In this example, a V-shaped portion 370 at a first end of each V-shaped coupling structure 340 is received over a correspondingly shaped protrusion 372 at a second end of the adjacent V-shaped coupling structure 340. This engagement may provide increased structural integrity for the assembled system 10B.

Figure 4A:
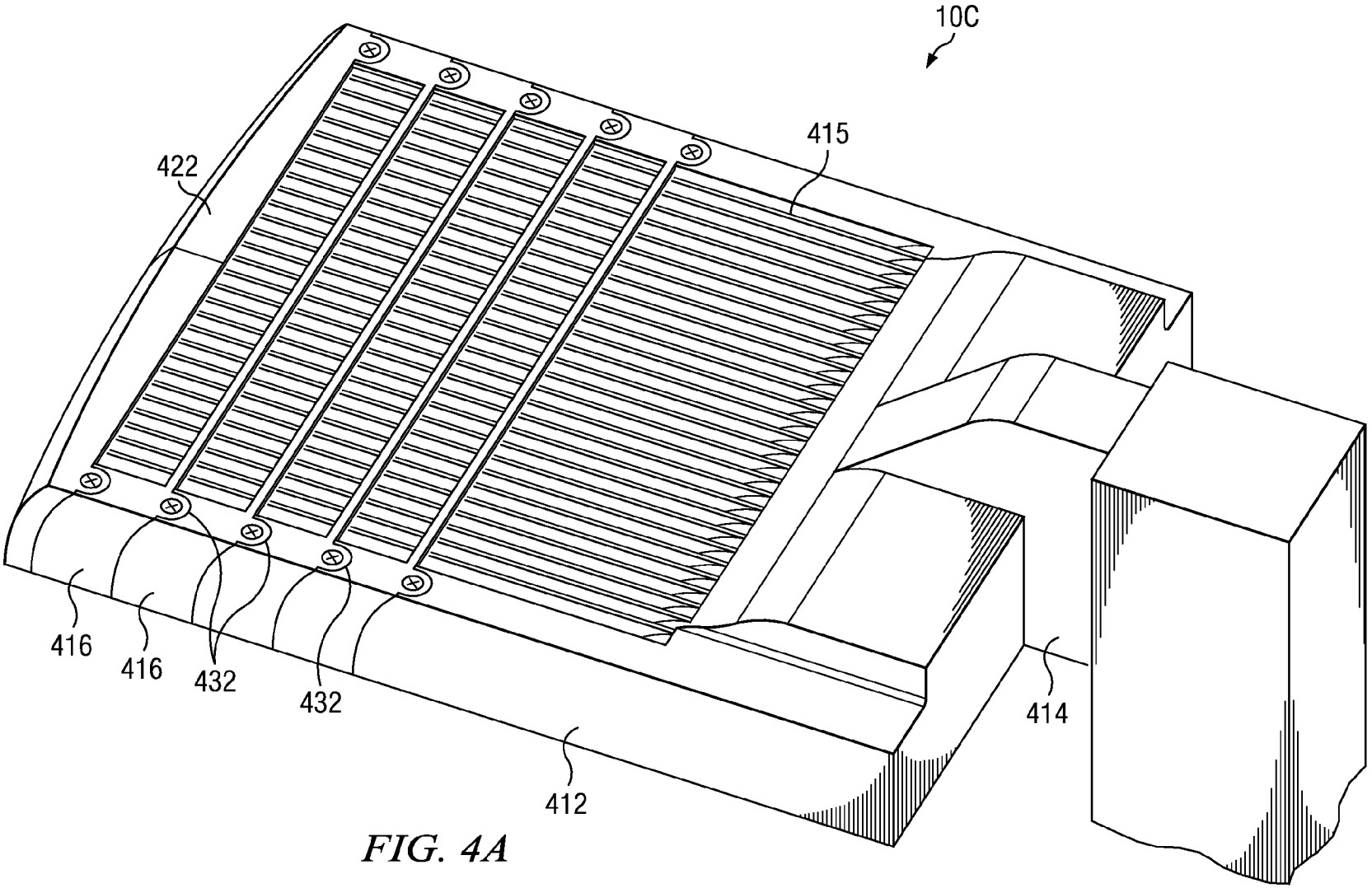
FIG. 4A-4D illustrate various aspects of another modular lighting system, according to an example embodiment.

FIG. 4A-4D illustrate various aspects of another modular lighting system 10C, according to an example embodiment. FIG. 4A is a perspective view from above of assembled light modular lighting system 10C. As shown, modular lighting system 10C comprises a support housing 412, an extension arm (i.e., light pole mount) 414, a cantilevered array of heat sink modules 416, and a front plate 422. As shown, support housing 412 may include an integrated heat sink 415.

Figure 4B:
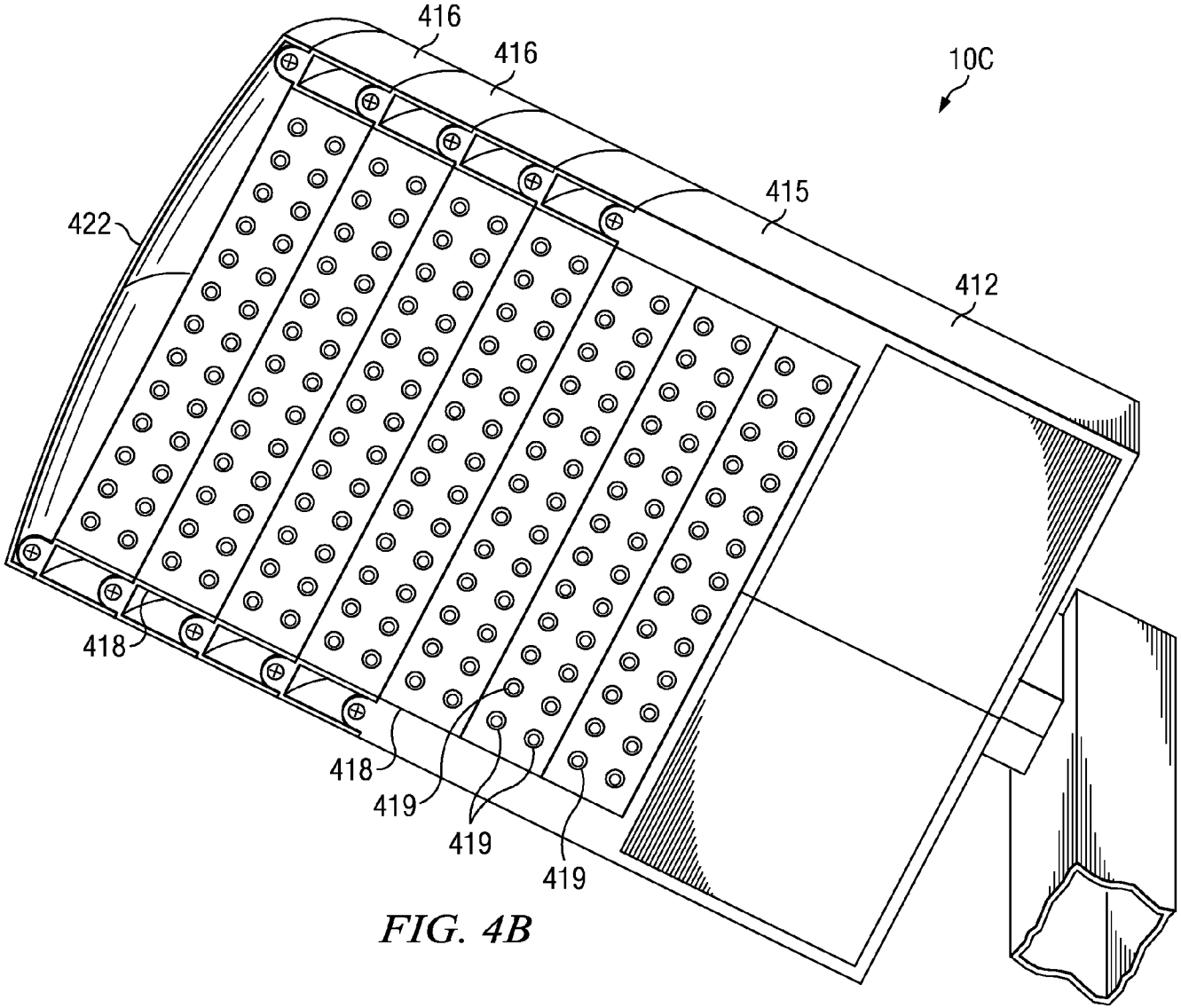
Figure 4C:
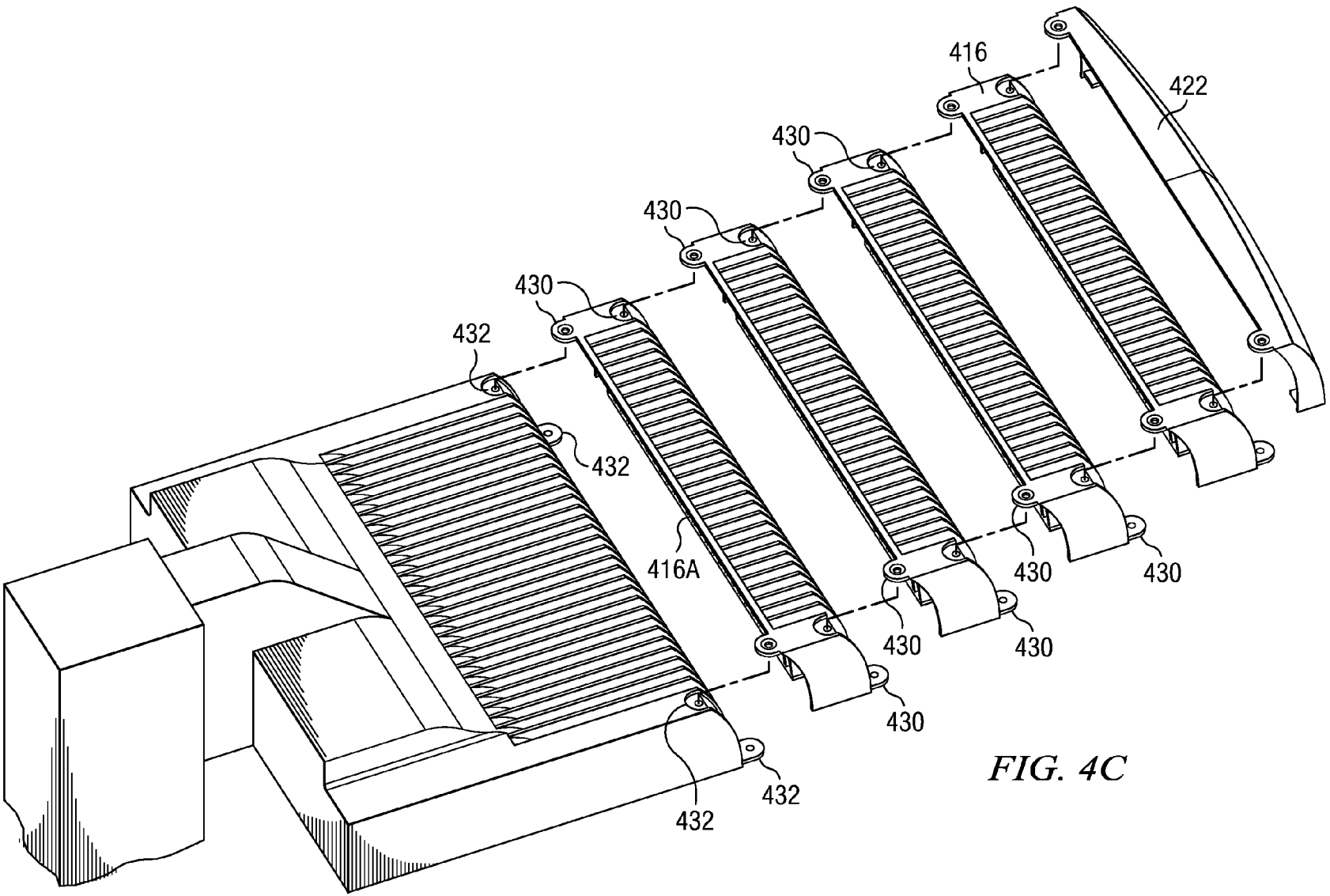
Figure 4D:
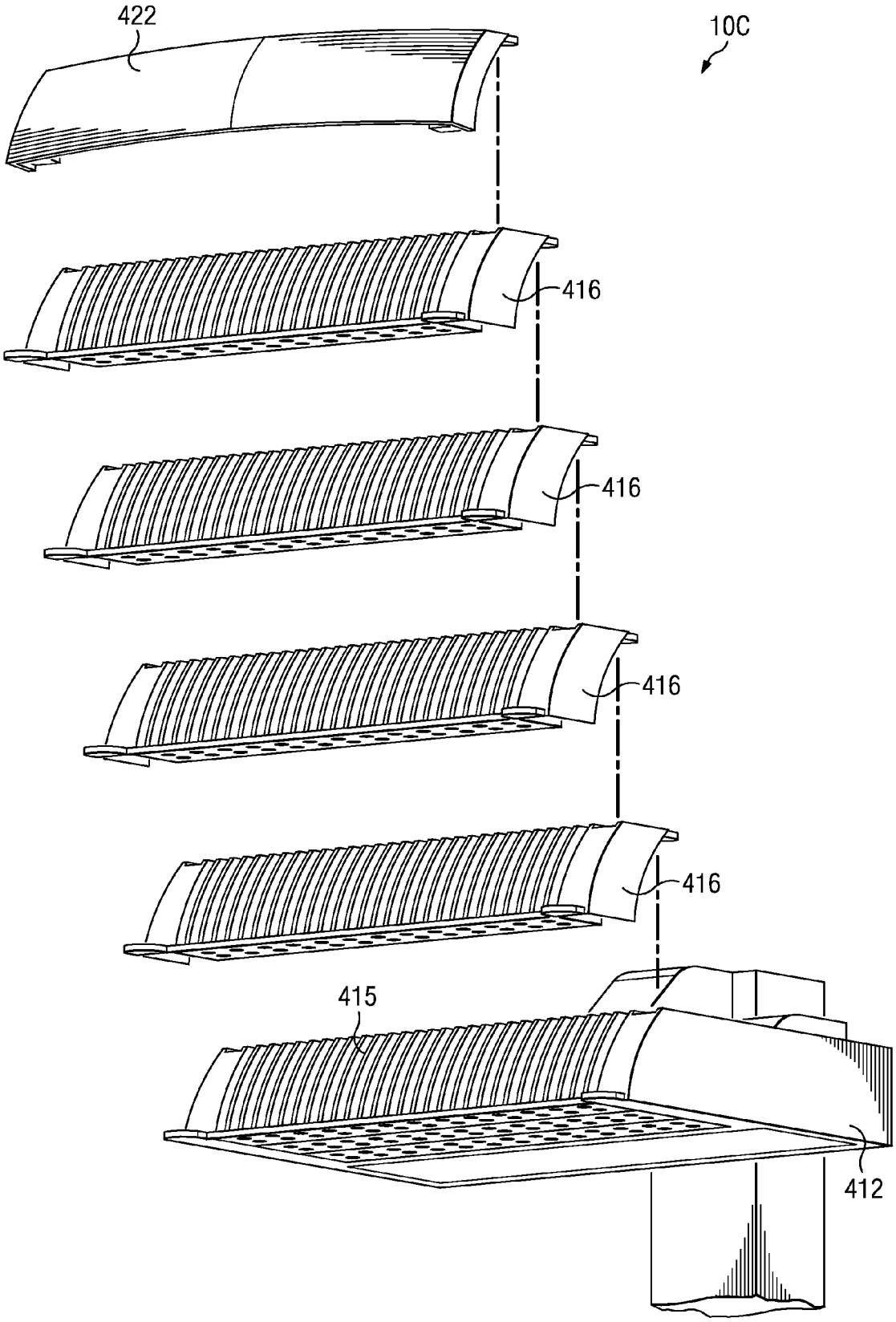

FIG. 4B is a perspective view from below of assembled light modular lighting system 10C. As shown, light panels 418 may be mounted to the underside of heat sink modules 416 and integrated heat sink 415 of support housing 412. Light panels 418 may comprise LEDs 419. FIGS. 4*c* and 4D are exploded views of modular lighting system 10C. As shown, heat sink modules 416 may include mounting structures 430 for connecting heat sink modules 416 to each other (e.g., using screws or other suitable connectors). Support housing 412 may include similar mounting structures 432 for connecting a first heat sink module 416A to support housing 412. Thus, in the illustrated example, an array of four heat sink modules 416 may be supported by support housing 412 in a cantilevered manner, with only a first heat sink module 416A being directly coupled to support housing 412.

Figure 5A:
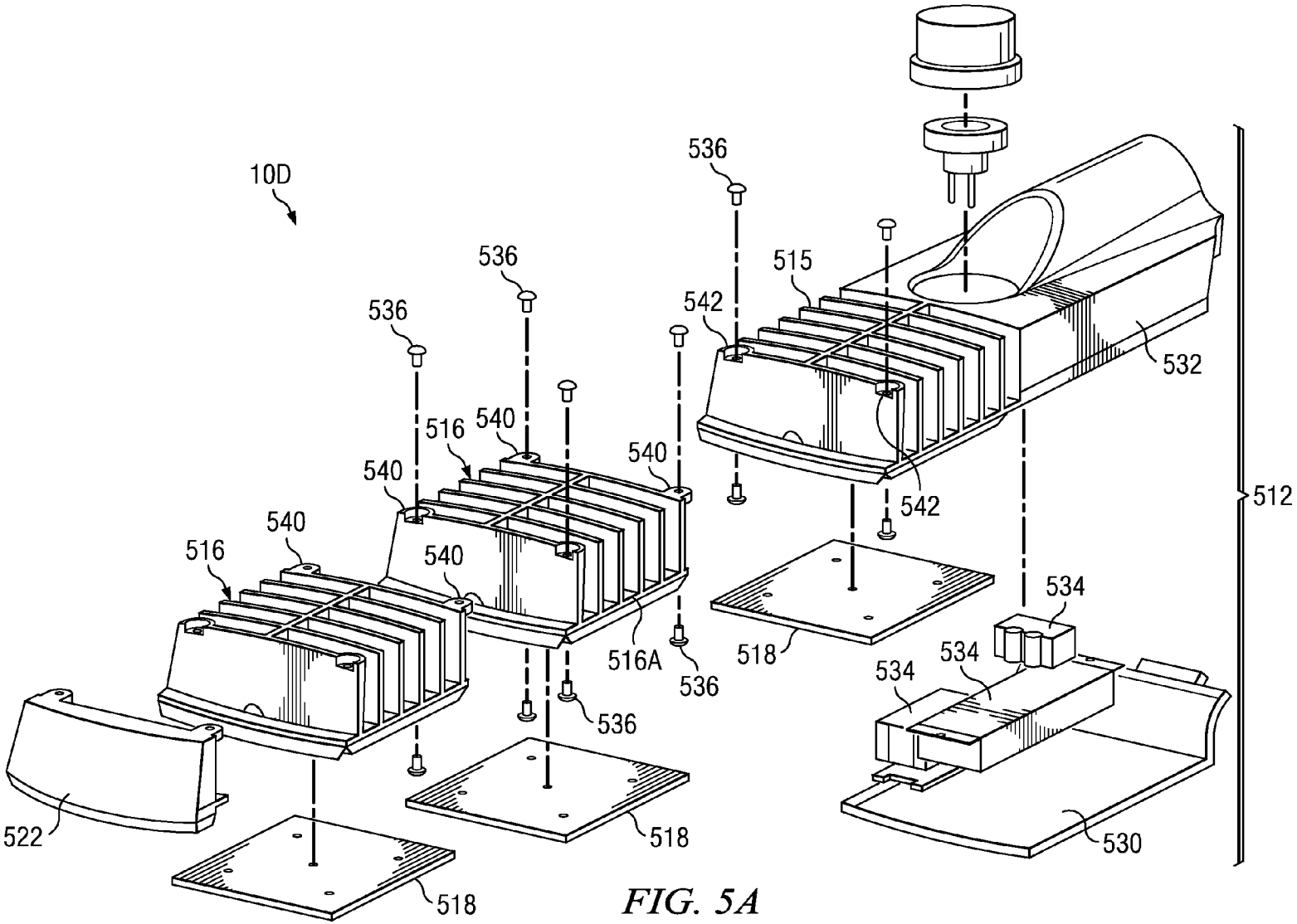
FIG. 5A-5D illustrate various aspects of another modular lighting system, according to an example embodiment.
Figure 5B:
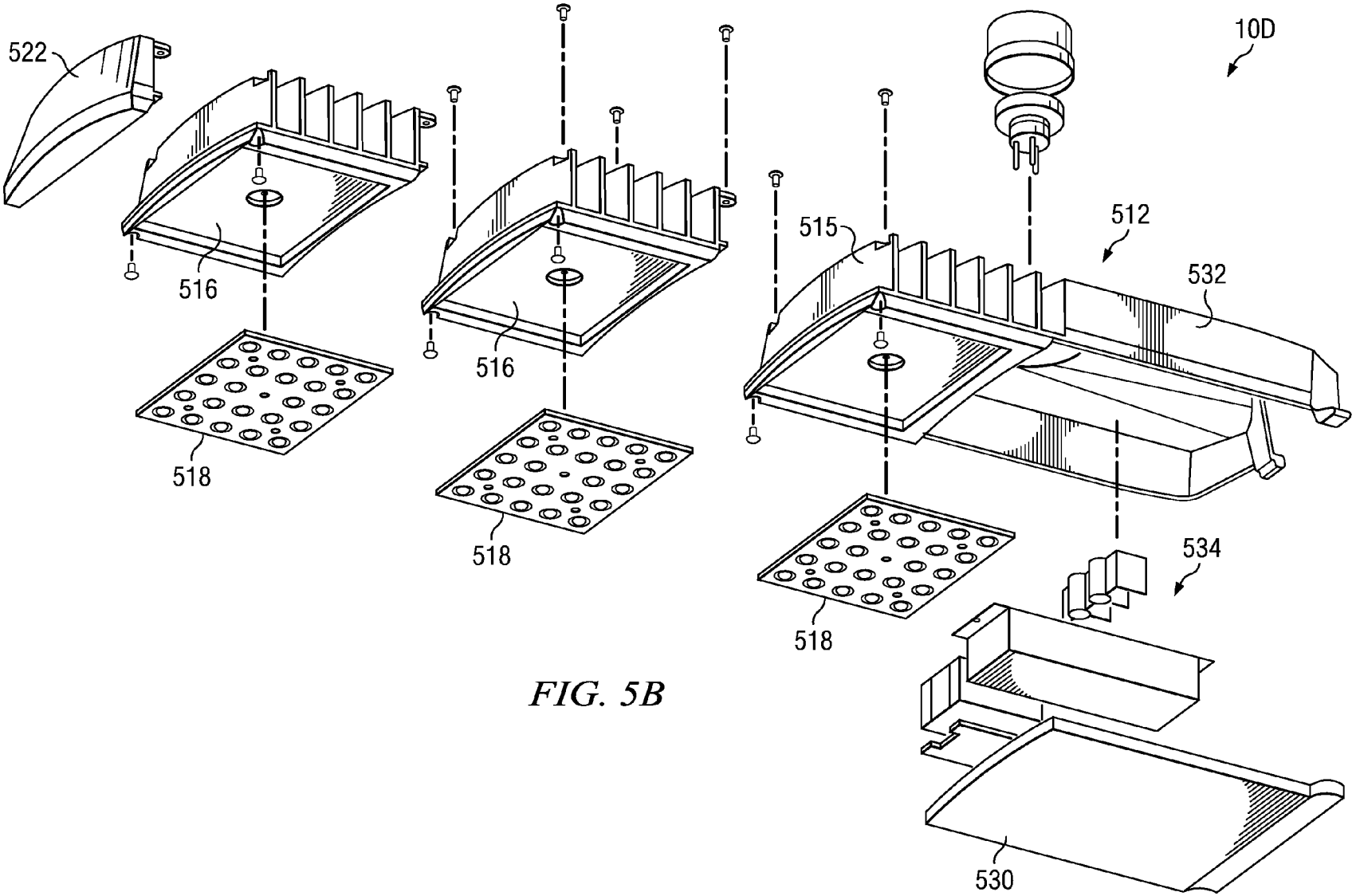

FIG. 5A-5D illustrate various aspects of another modular lighting system 10D, according to an example embodiment. FIGS. 5A and 5B are exploded views of modular lighting system 10D from above and below, respectively. As shown, modular lighting system 10D may include a support housing 512 (including a housing base 530 and a housing cover 532), a plurality of heat sink modules 516, a front plate 522, electronic components 534, screws 536, and a plurality of LED panels 518. As shown, support housing 512 may include an integrated heat sink 515.

Figure 5C:
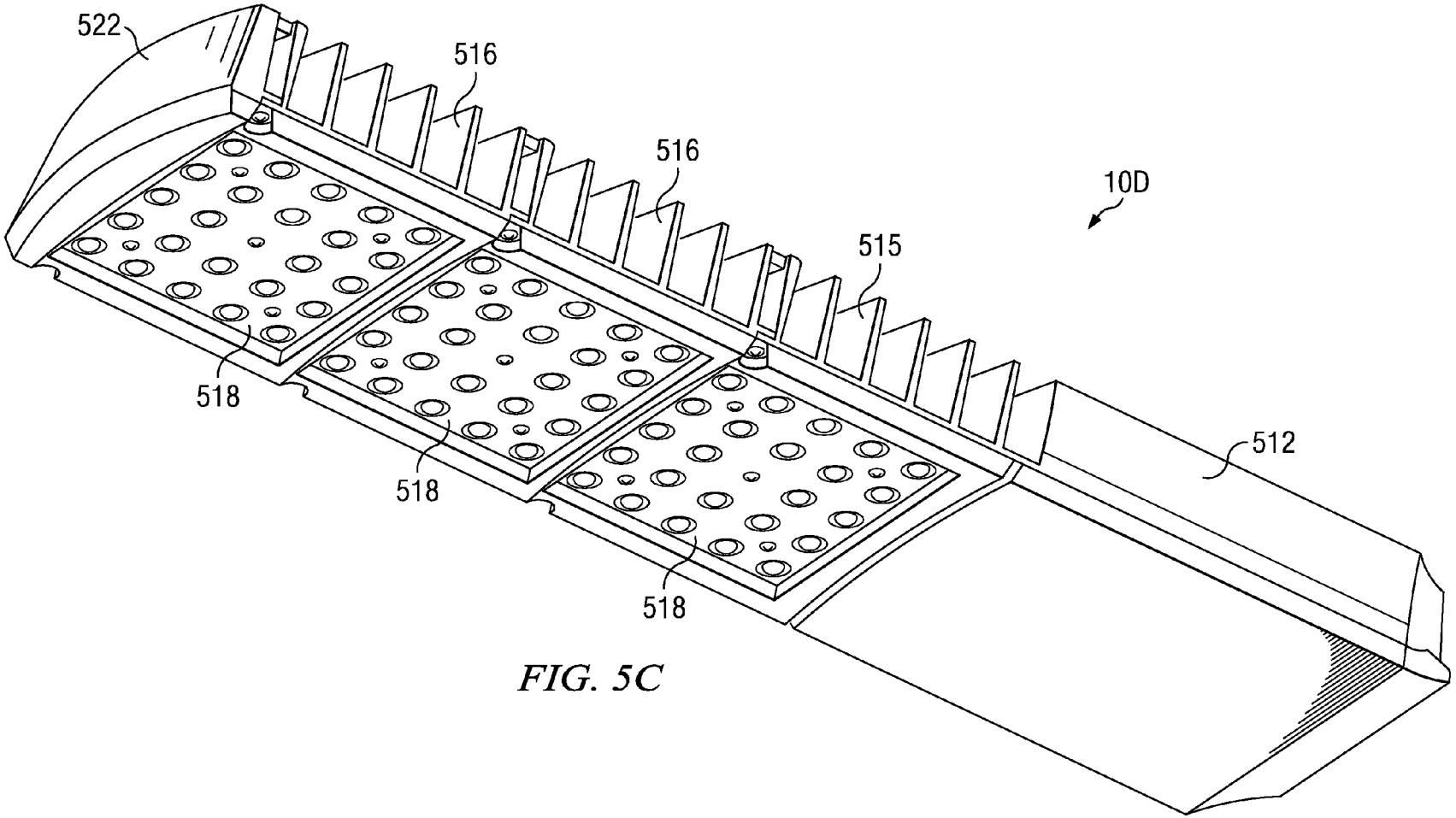
Figure 5D:
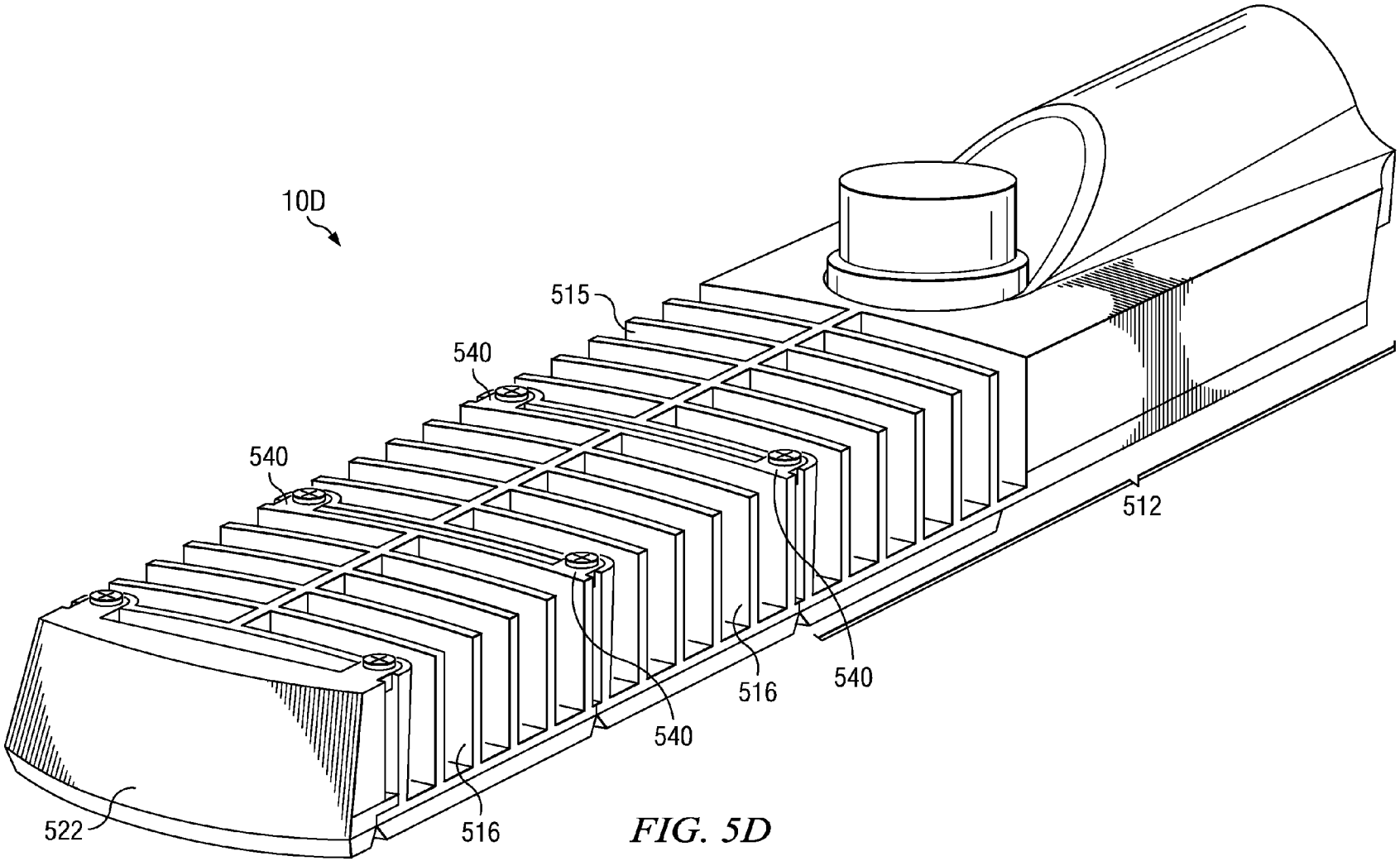

FIGS. 5C and 5D are perspective views of assembled modular lighting system 10D from below and above, respectively. As shown, heat sink modules 516 may be arranged as a cantilevered array of heat sink modules 516 supported by support housing 512, and light panels 518 may be mounted to the underside of heat sink modules 516 and integrated heat sink 515 of support housing 512.

As shown in FIG. 5A-5D, heat sink modules 516 may include mounting structures 540 for connecting heat sink modules 516 to each other (e.g., using screws or other suitable connectors). Support housing 512 may include similar mounting structures 542 for connecting a first heat sink module 516A to support housing 512. Thus, in the illustrated example, an array of two heat sink modules 516 may be supported by support housing 512 in a cantilevered manner, with only a first heat sink module 516A being directly coupled to support housing 512.

Figure 6A:
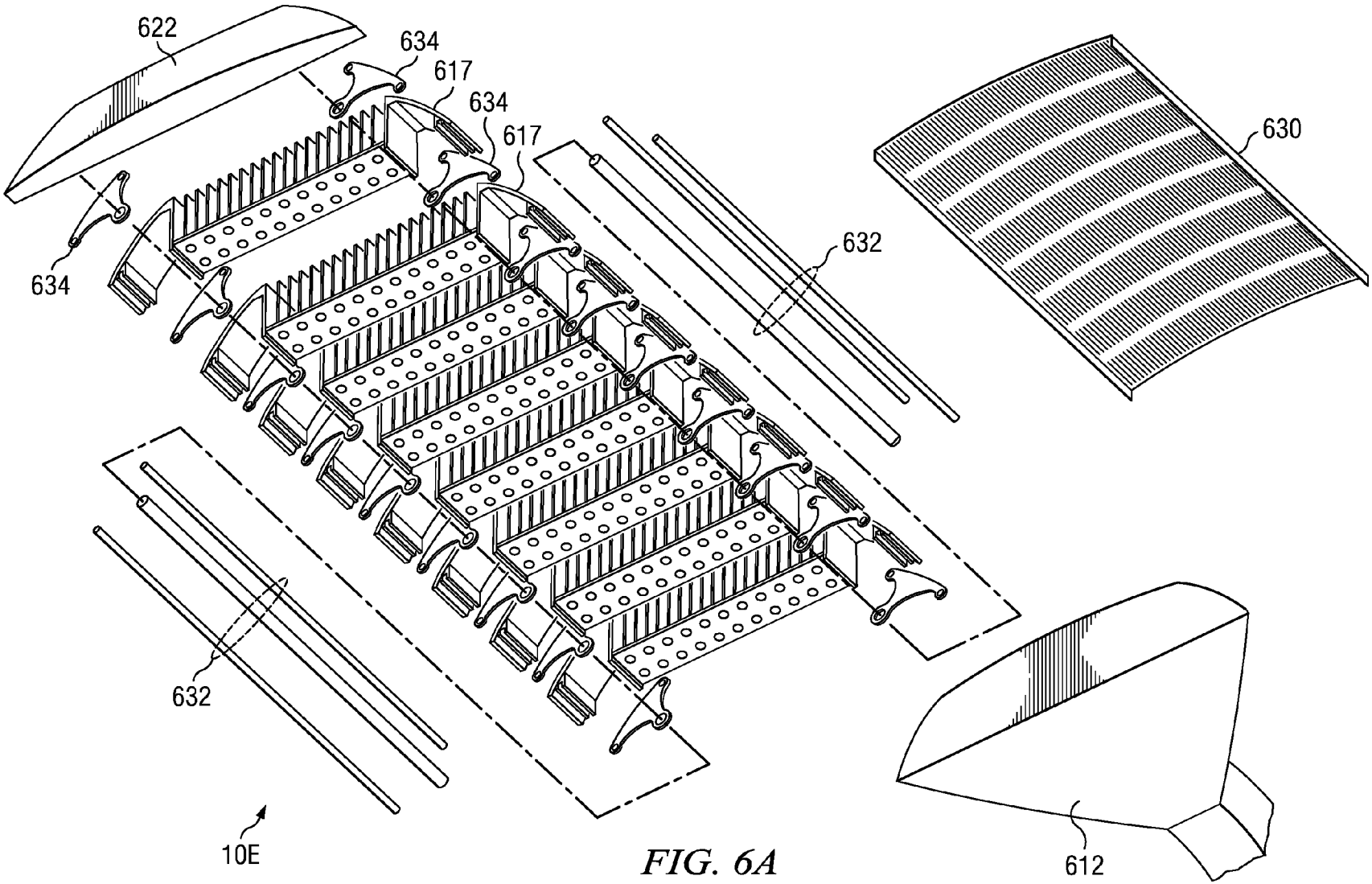
FIG. 6A-6D illustrate various aspects of another modular lighting system, according to an example embodiment.
Figure 6B:
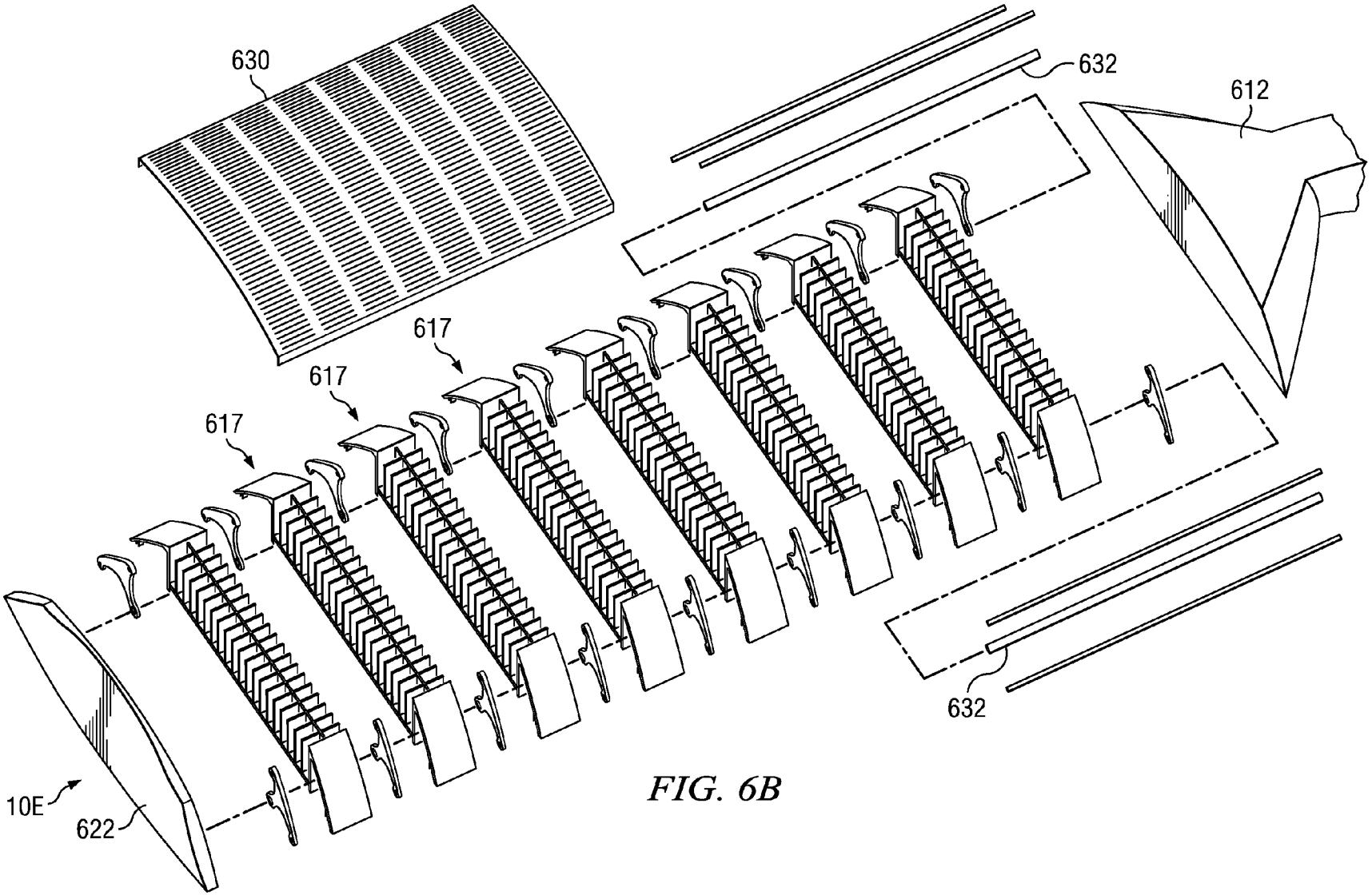
Figure 6C:
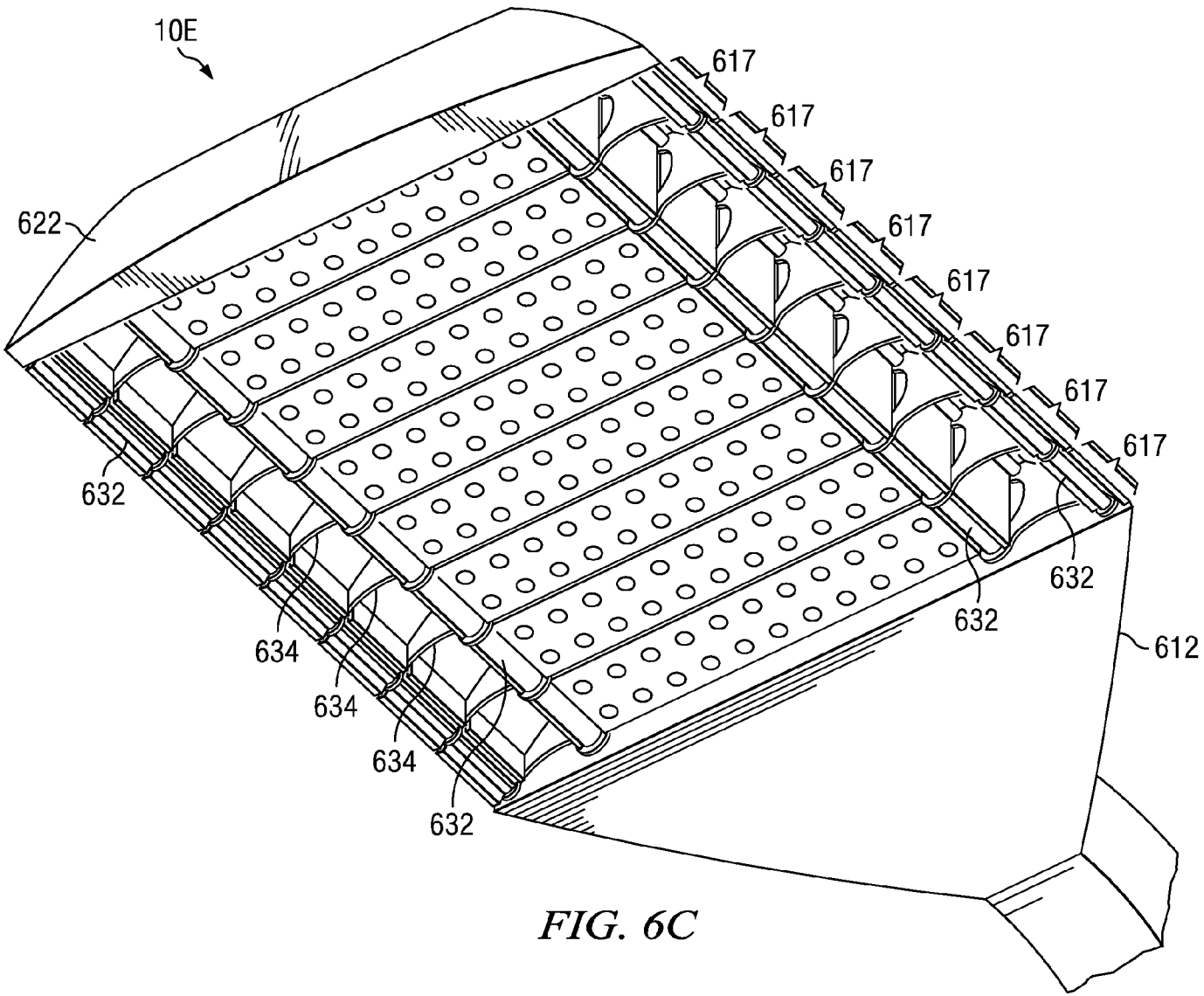
Figure 6D:
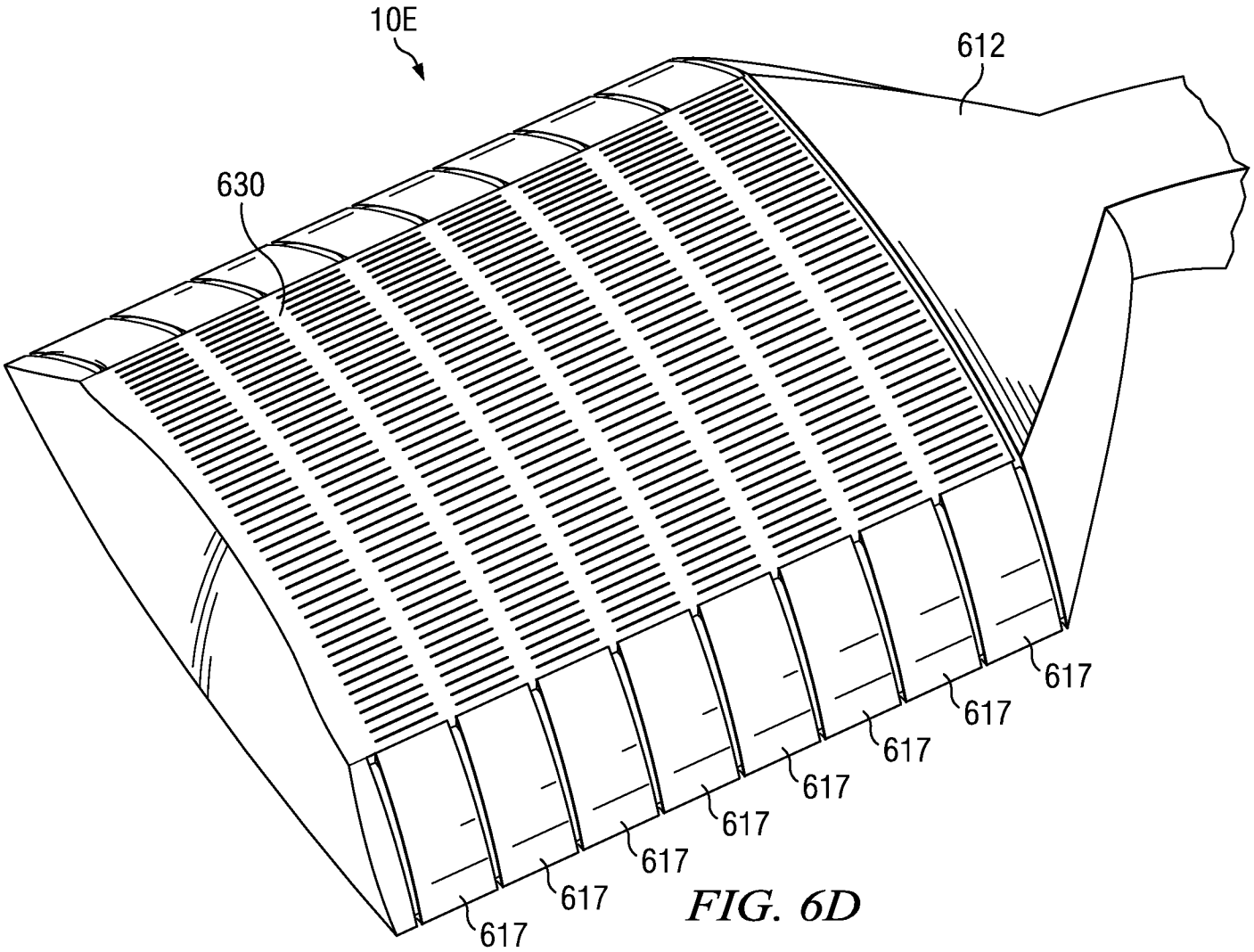

FIG. 6A-6D illustrate various aspects of another modular lighting system, according to an example embodiment. FIGS. 6A and 6B are exploded views of modular lighting system 10E from below and above, respectively, while FIGS. 6C and 6D are assembled views of modular lighting system 10E from below and above, respectively.

As shown, modular lighting system 10E may comprise a support housing 612, a debris screen 630, support rods 632, heat sink/LED panel module 617, a front cover 622, and spacers 634. Each heat sink/LED panel module 617 may comprise one or more LEDs mounted to a heat sink. Support rods 632 may be arranged to extend from support housing 612 and may be configured to align and/or support heat sink/LED panel modules 617, which may slide onto the free ends of support rods 632 (or otherwise couple to support rods 632). For example, two to six support rods 632 may be inserted through heat sink/LED panel modules 617 to secure heat sink/LED panel modules 617 to support housing 612. Spacers 634 may be arranged between adjacent heat sink/LED panel modules 617 to create ventilation gaps between heat sink/LED panel modules 617.

Figure 7A:
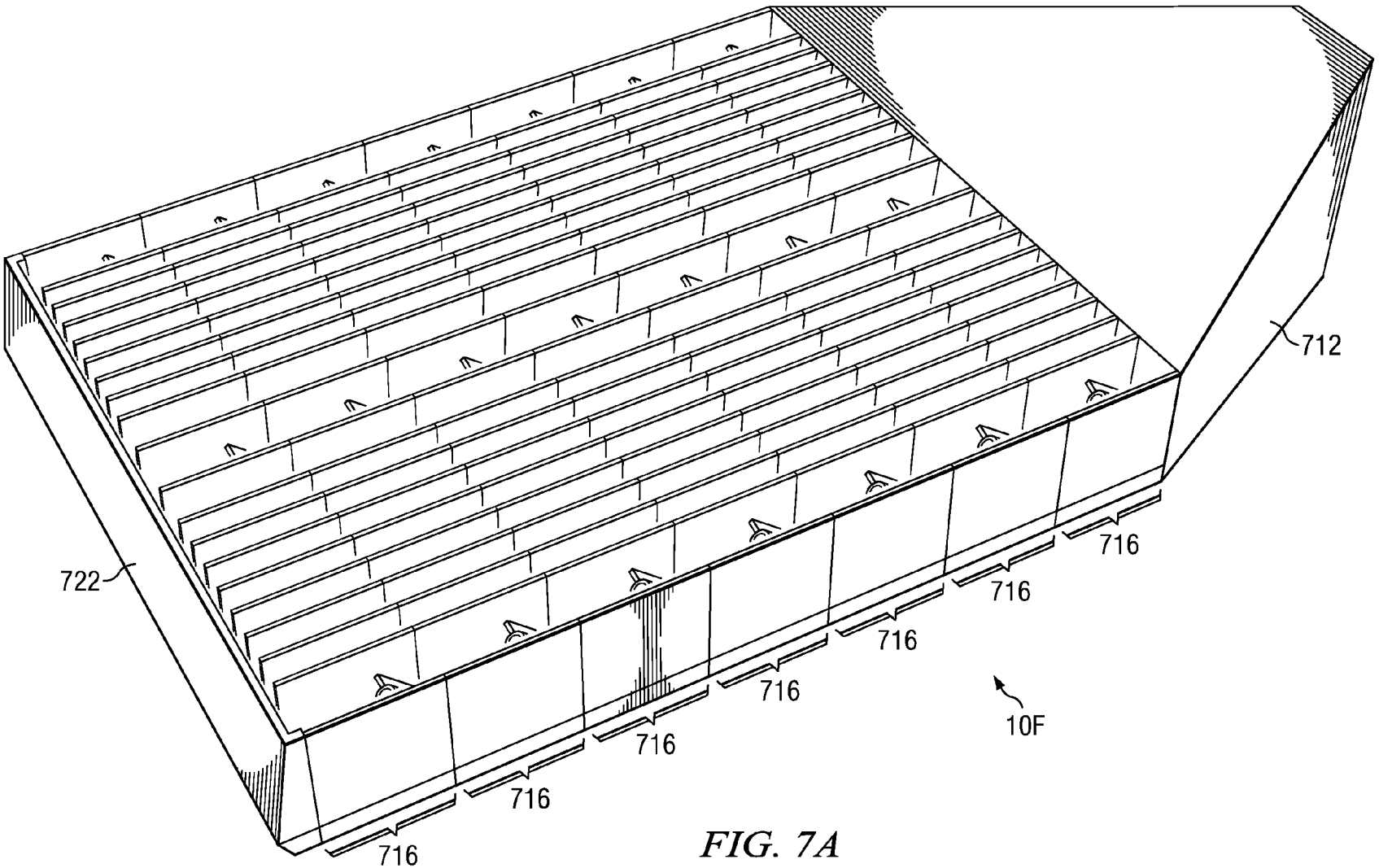
FIGS. 7A and 7B are perspective views of another modular lighting system, in an assembled form, according to an example embodiment.
Figure 7B:
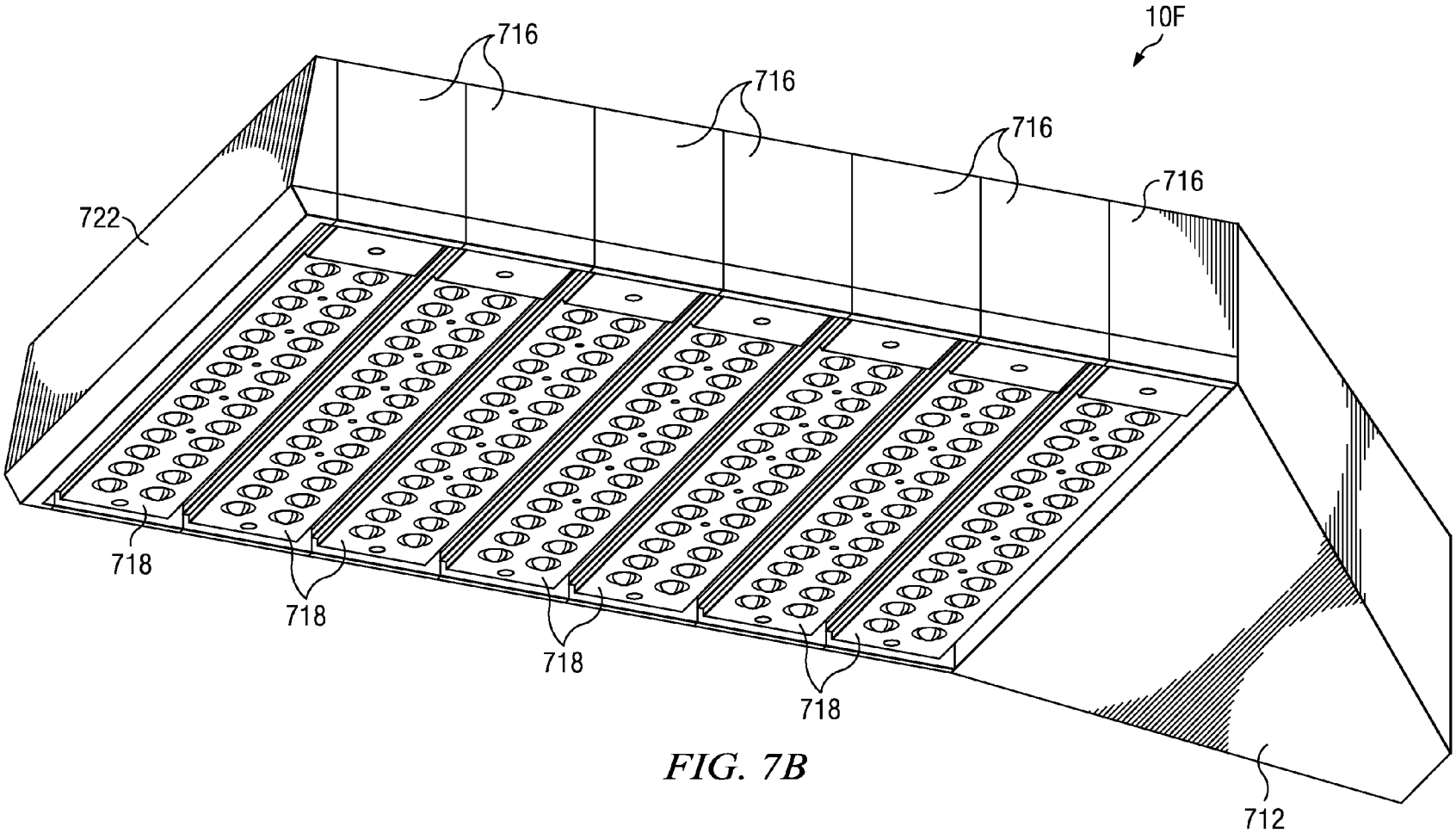

FIGS. 7A-7H illustrate various aspects of another modular lighting system 10F, according to an example embodiment. In particular, FIGS. 7A and 7B are perspective views of assembled modular lighting system 10F. As shown, modular lighting system 10F may comprise a support housing 712, modular heat sinks 716, LED panels 718, and a face plate 722. Heat sinks 716 may comprise longitudinal, self-locking, modular heat sinks.

Figure 7C:
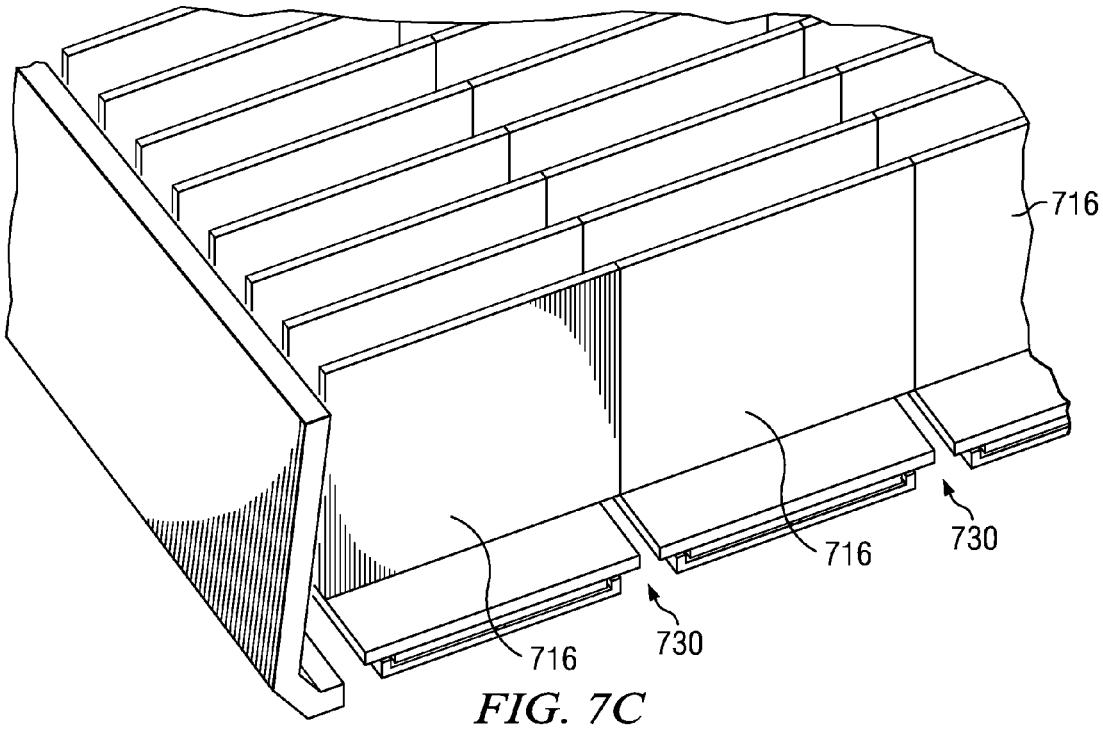
FIGS. 7C and 7D illustrate airflow gaps formed between heat sink modules of the lighting system of FIGS. 7A and 7B.
Figure 7D:
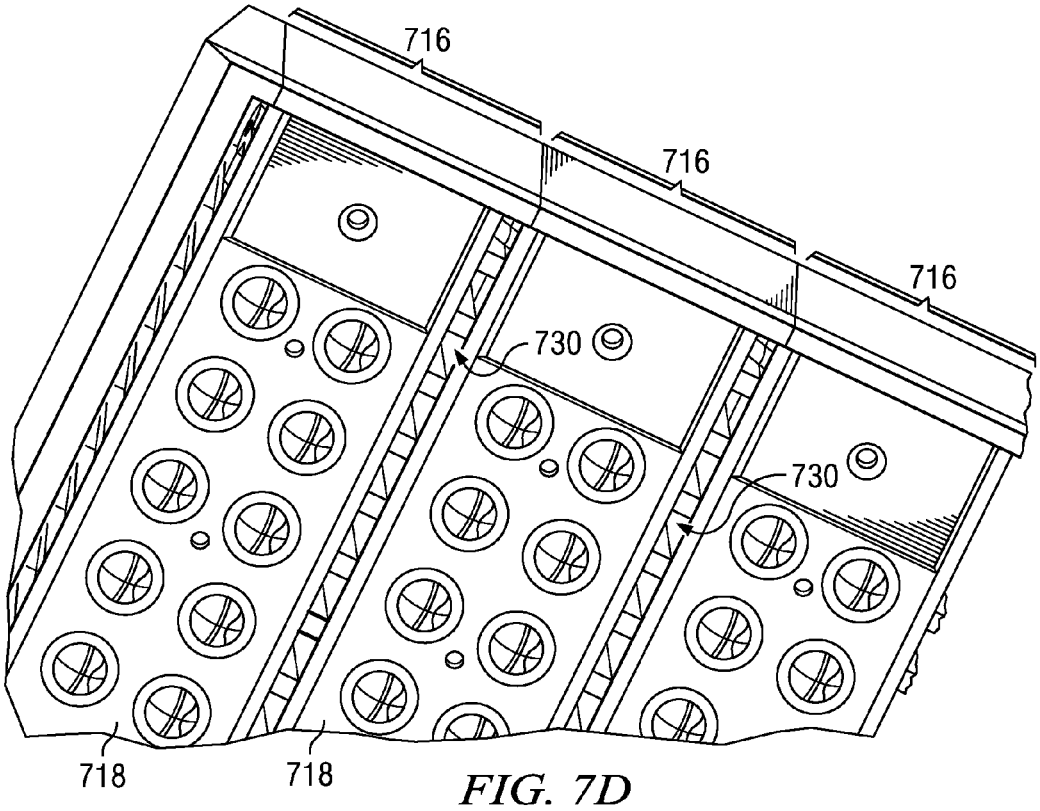
Figure 7E:
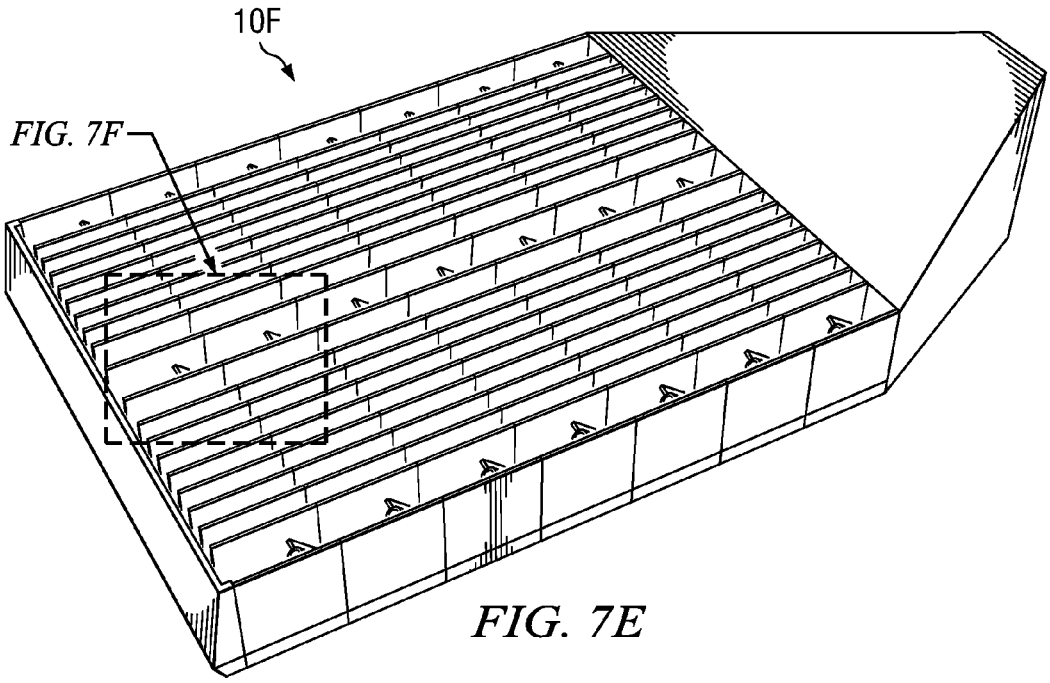
FIGS. 7E and 7F illustrate a fastening system for connecting adjacent heat sink modules of the lighting system of FIGS. 7A and 7B.
Figure 7F:
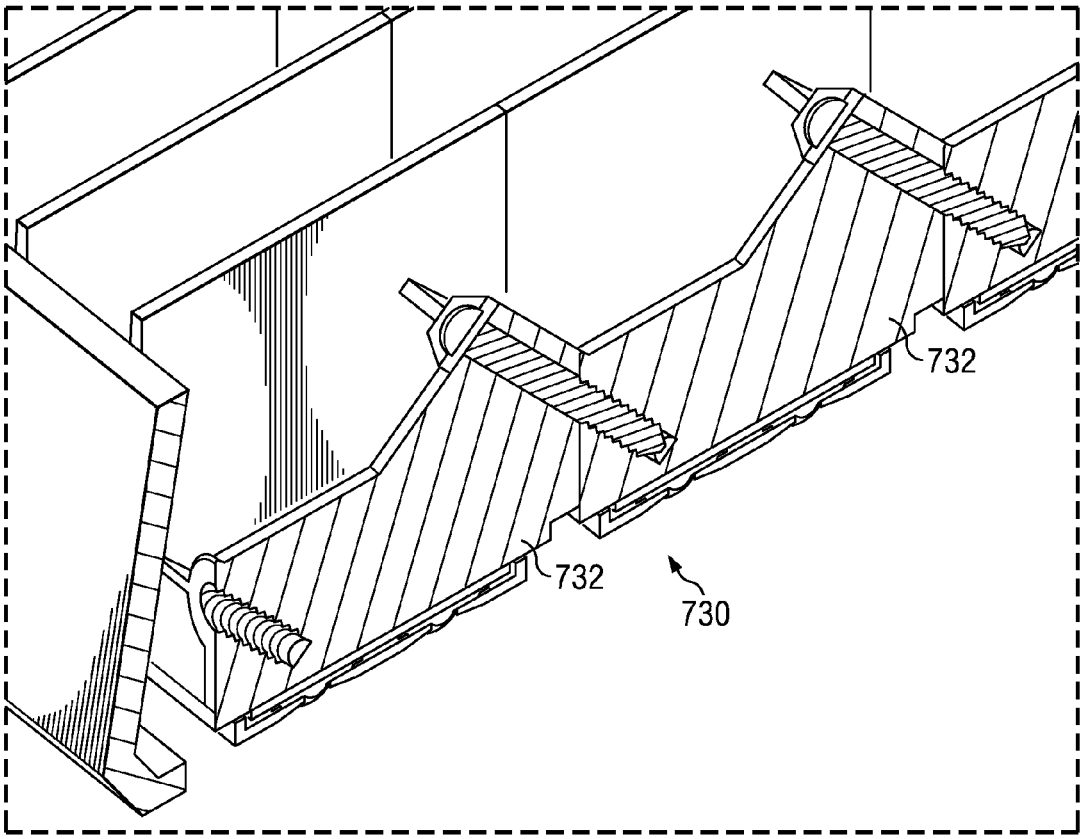
Figure 7G:
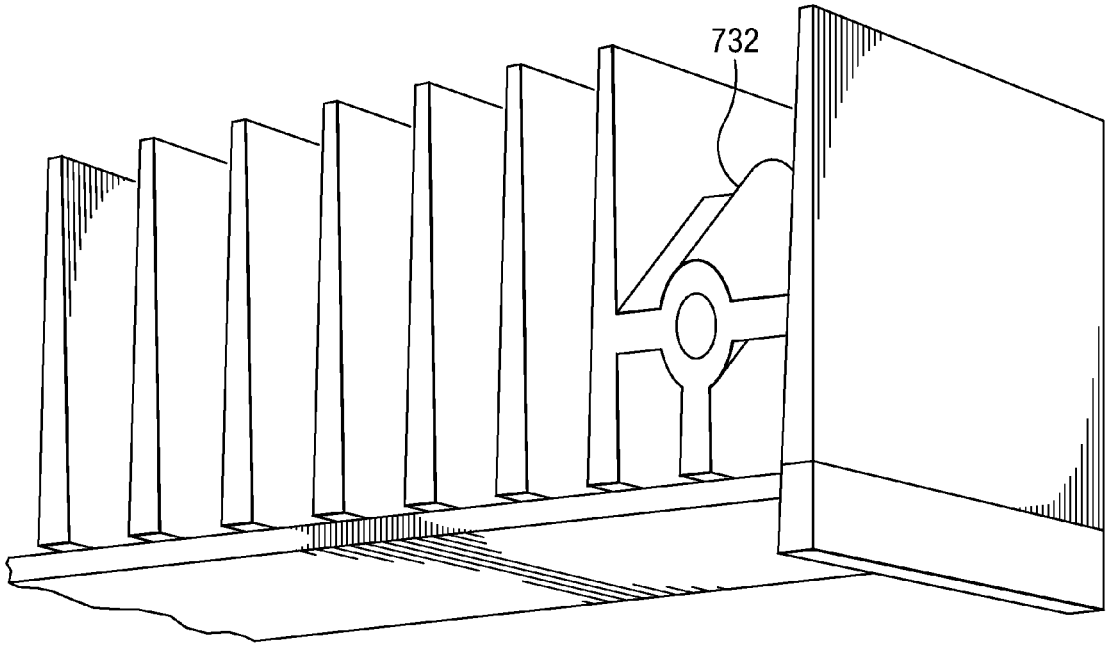
FIGS. 7G and 7H are perspective views of an example fastening element for connecting adjacent heat sink modules of the lighting system of FIGS. 7A and 7B.
Figure 7H:
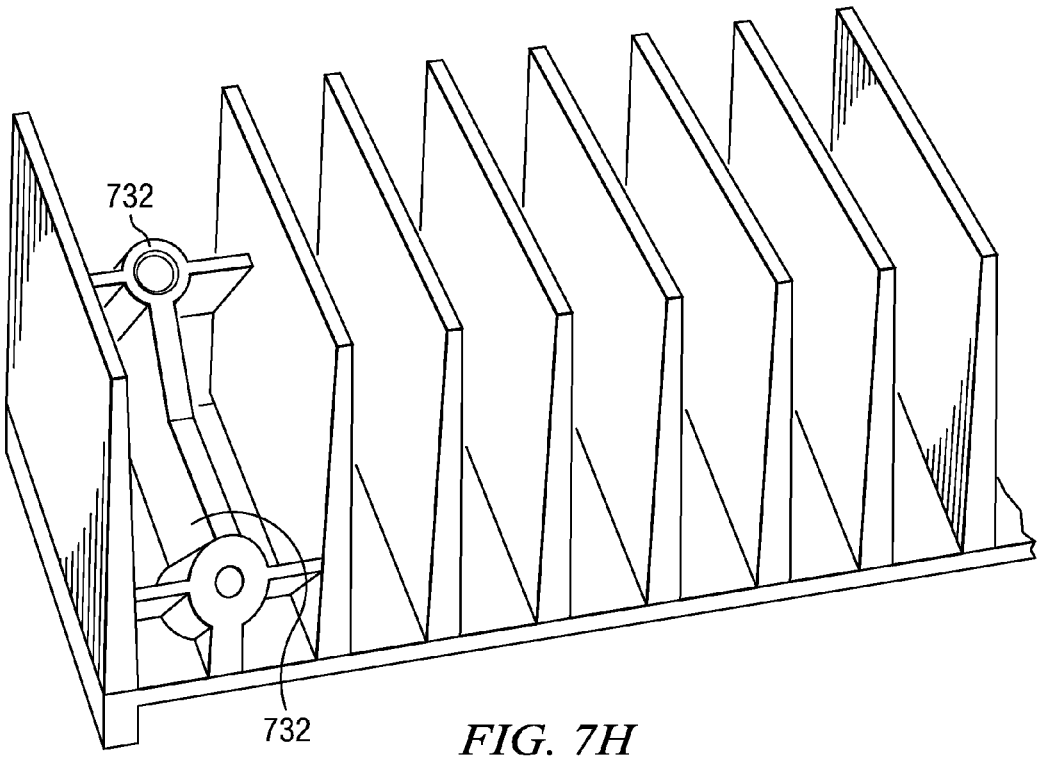

FIGS. 7C and 7D illustrate airflow gaps 730 formed between adjacent heat sink modules 716, to facilitate air flow through lighting system 10F. FIGS. 7E and 7F illustrate a fastening system 730 for connecting adjacent heat sink modules 716. FIGS. 7G and 7H are perspective views of an example fastening element 732 for connecting adjacent heat sink modules 716. The fastening system 730 may utilize fastening element that fasten each heat sink module 716 to the next. In use, each fastening element 732 may receive a screw or other connector through adjacent fins of adjacent heat sinks 716. As shown, fastening elements 732 may comprise slanted connectors (together with a screw, pin, or other fastener) to join each heat sink to the next. In use, each slanted connector may receive a screw or other connector through a mounting through-hole of a first heat sink and enter a mounting boss in a second heat sink, thereby securing the two heat sinks together. Desirable qualities of slanted connectors may include one-sided assembly of multiple heat sink modules, improved casting, simplified design, and/or reduced cost according to some embodiments.

Figure 8A:
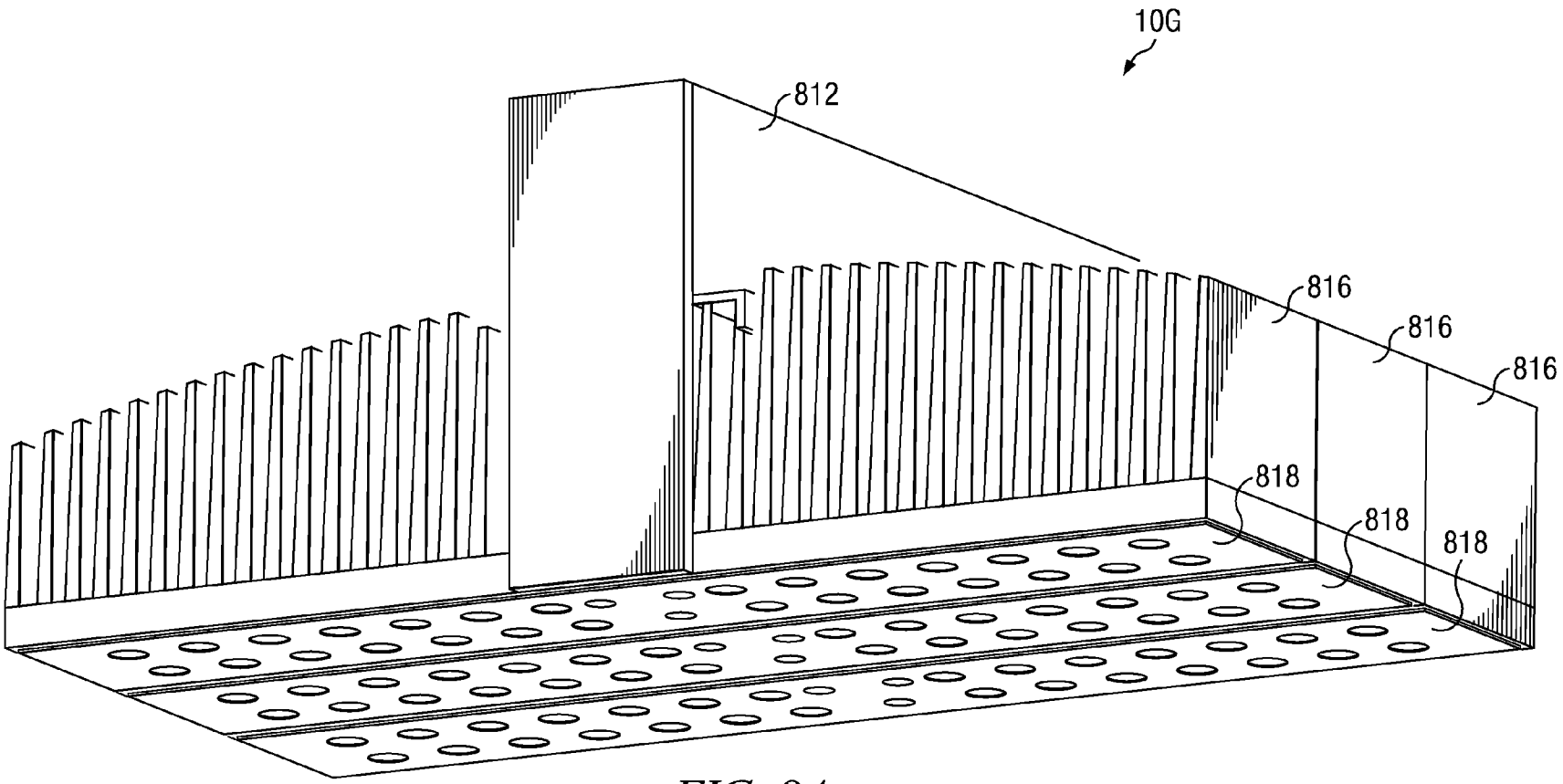
FIGS. 8A and 8B are perspective views of another modular lighting system, in an assembled form, according to an example embodiment.
Figure 8B:
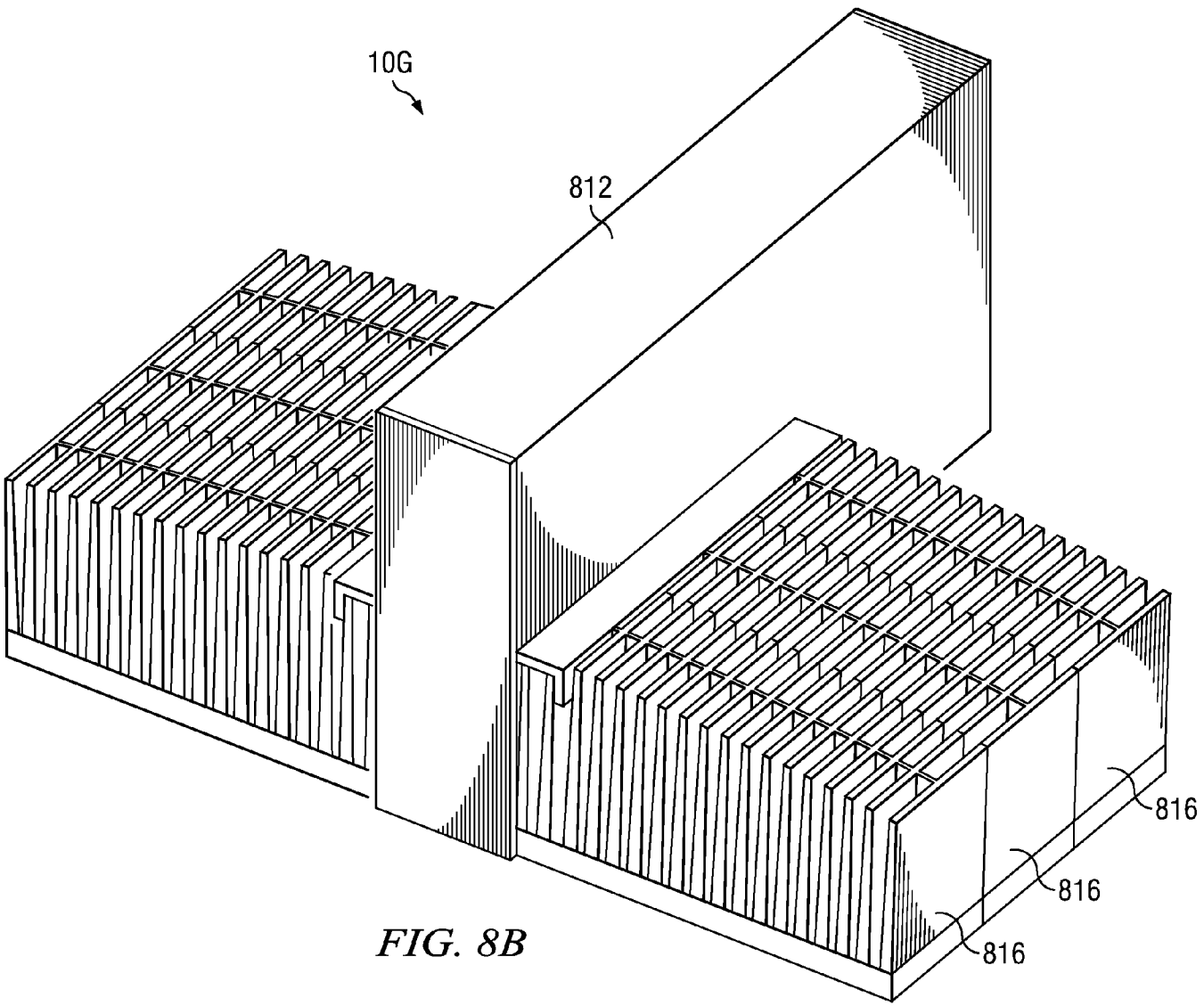
Figure 8C:
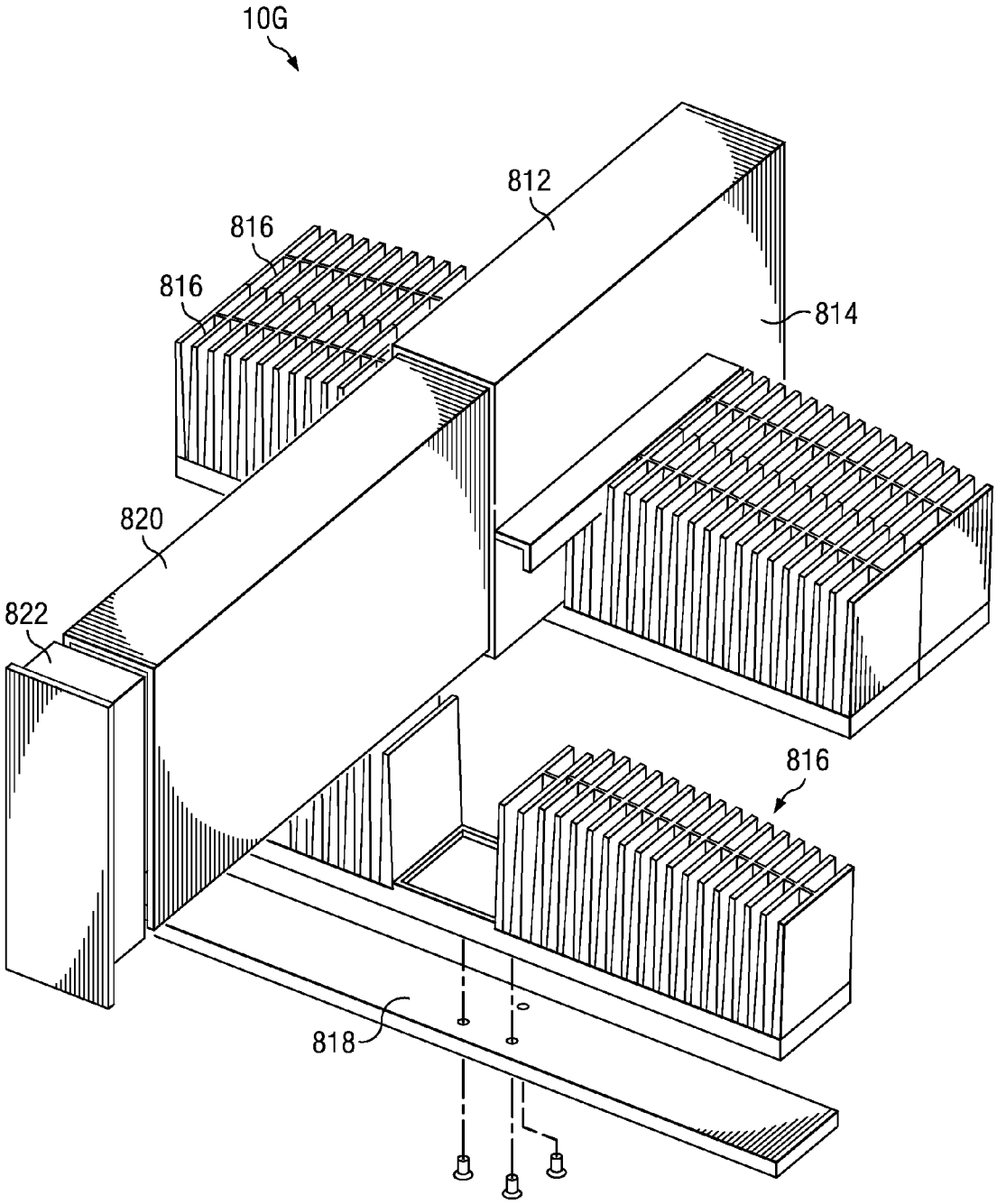
FIGS. 8C and 8D are perspective exploded views of the modular lighting system of FIGS. 8A and 8B.
Figure 8D:
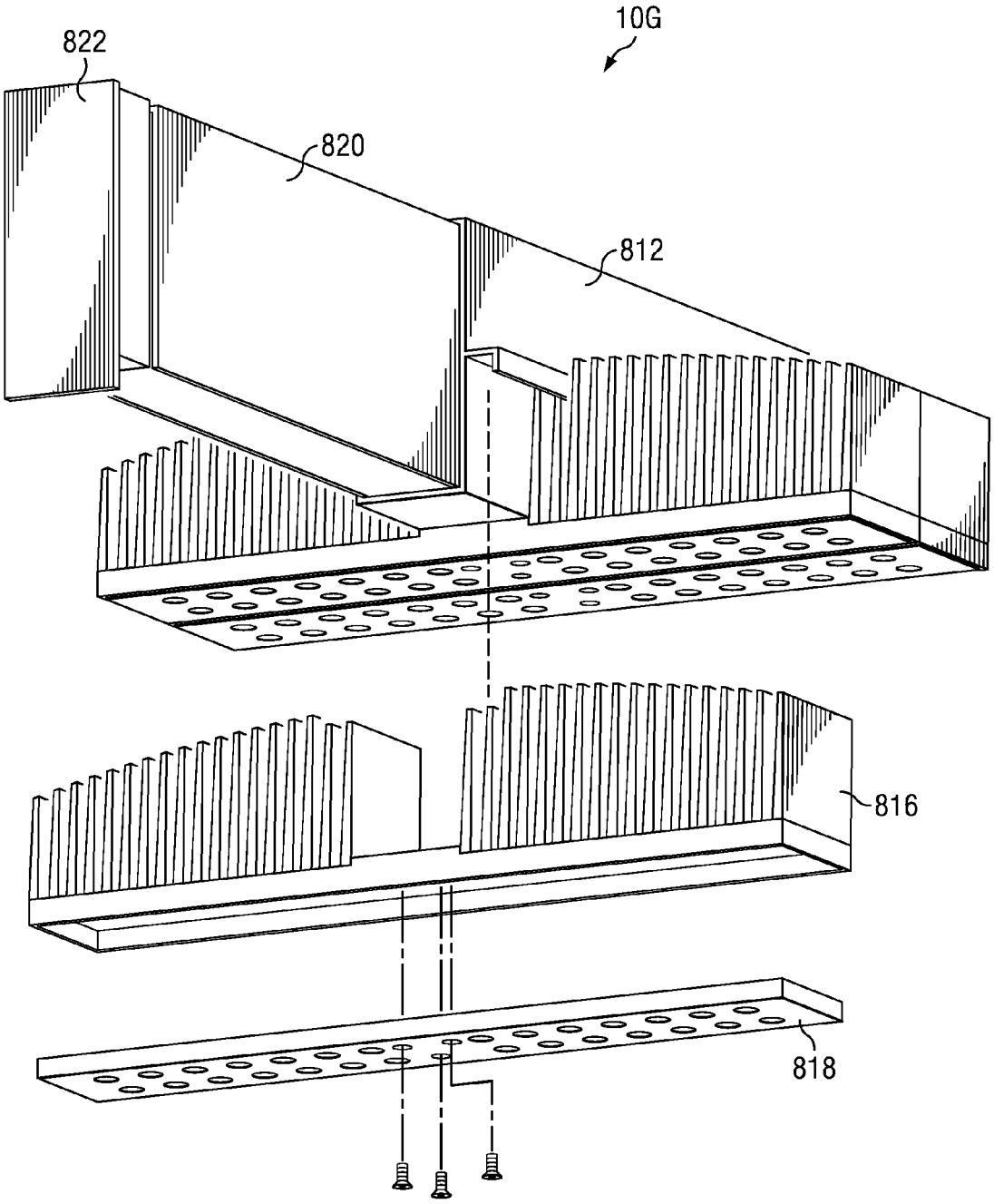

FIGS. 8A-8D illustrate various aspects of another modular lighting system 10G, according to an example embodiment. In particular, FIGS. 8A and 8B are perspective views of assembled modular lighting system 10G, while FIGS. 8C and 8D are exploded views of modular lighting system 10G. As shown, modular lighting system 10G may include a support housing 812, an array of longitudinal, center-locking, modular heat sink modules 816, and light panels 818. In some embodiments, electronics (e.g., transducers, power source, ballast, controls, and/or the like) may be housed in the support housing 812. In some embodiments, support housing 812 may have a rear portion 814 (see FIG. 8C) for mounting to a pole or other structure. Support housing 812 may be formed, for example, by extrusion. In some embodiments, a power tray 820 (e.g., capped with a power tray cover 822) may be configured to slide into and out of support housing 812 as illustrated, e.g., to access electronics in inner housing 820. Each heat sink module 816 may contact a lower face of support housing 812 with or without an interposed gasketed wire-way pad. An LED panel 818 may be fastened to a lower face of each heat sink module 816. Certain advantageous qualities of modular lighting system 10G may include, in some embodiments, optimal access to ambient air for efficient cooling of LED's, heat sink assemblies may be assembled on a separate line, mounting details may be cast in, modest number of parts lowering costs (e.g., capital costs), centralized CG for vibration, stress loads may be evenly distributed across fixture, and/or combinations thereof.

Figure 9A:
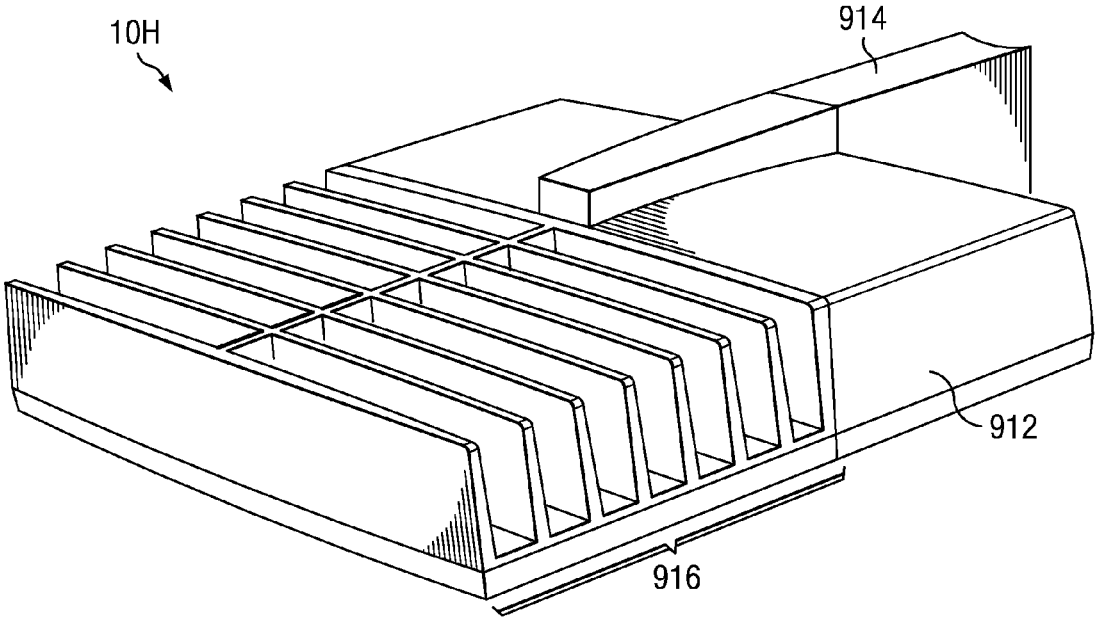
FIG. 9A is a perspective view from above of another modular lighting system, according to an example embodiment.
Figure 9B:
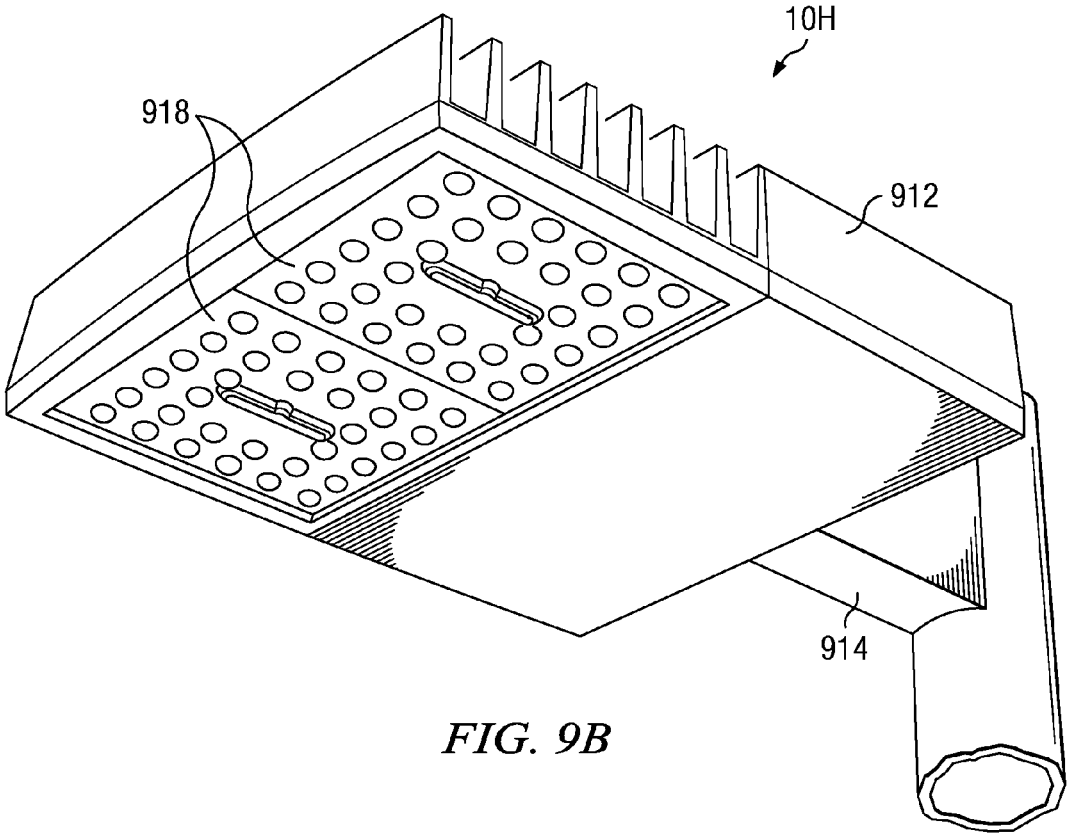
FIG. 9B is a perspective view from below of the modular lighting system of FIG. 9A mounted to a pole.

FIGS. 9A and 9B illustrate various aspects of another modular lighting system 10H, according to an example embodiment. FIG. 9A is a perspective view from above of modular lighting system 10H, while FIG. 9B is a perspective view from below of modular lighting system 10H mounted to a pole. As shown, modular lighting system 10H may comprise an arm 914, a support housing 912, and a heat sink module 916. One or more LED panels 918 may be mounted to an underside of the heat sink module 916. In the example shown in FIG. 9B, two LED panels 918 are mounted to the heat sink module 916.

Figure 10:
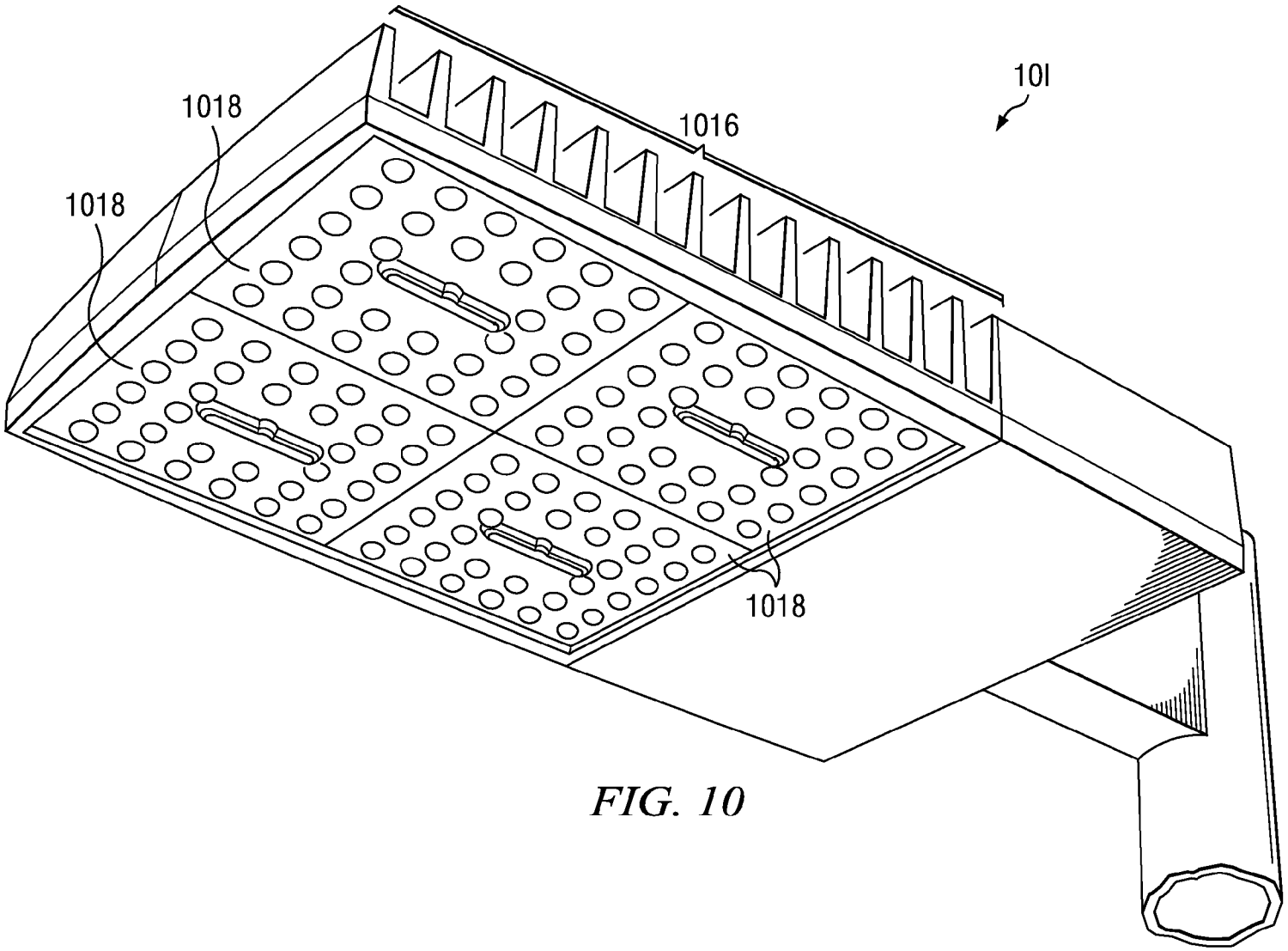
FIG. 10 is a perspective view from below of another modular lighting system mounted to a pole.

FIG. 10 is a perspective view from below of another modular lighting system 10I mounted to a pole. Modular lighting system 10I may include a larger heat sink module 1016 (as compared with the embodiment shown in FIGS. 9A-9B), with four LED panels 1018 mounted to the larger heat sink module 1016.

Figure 11A:
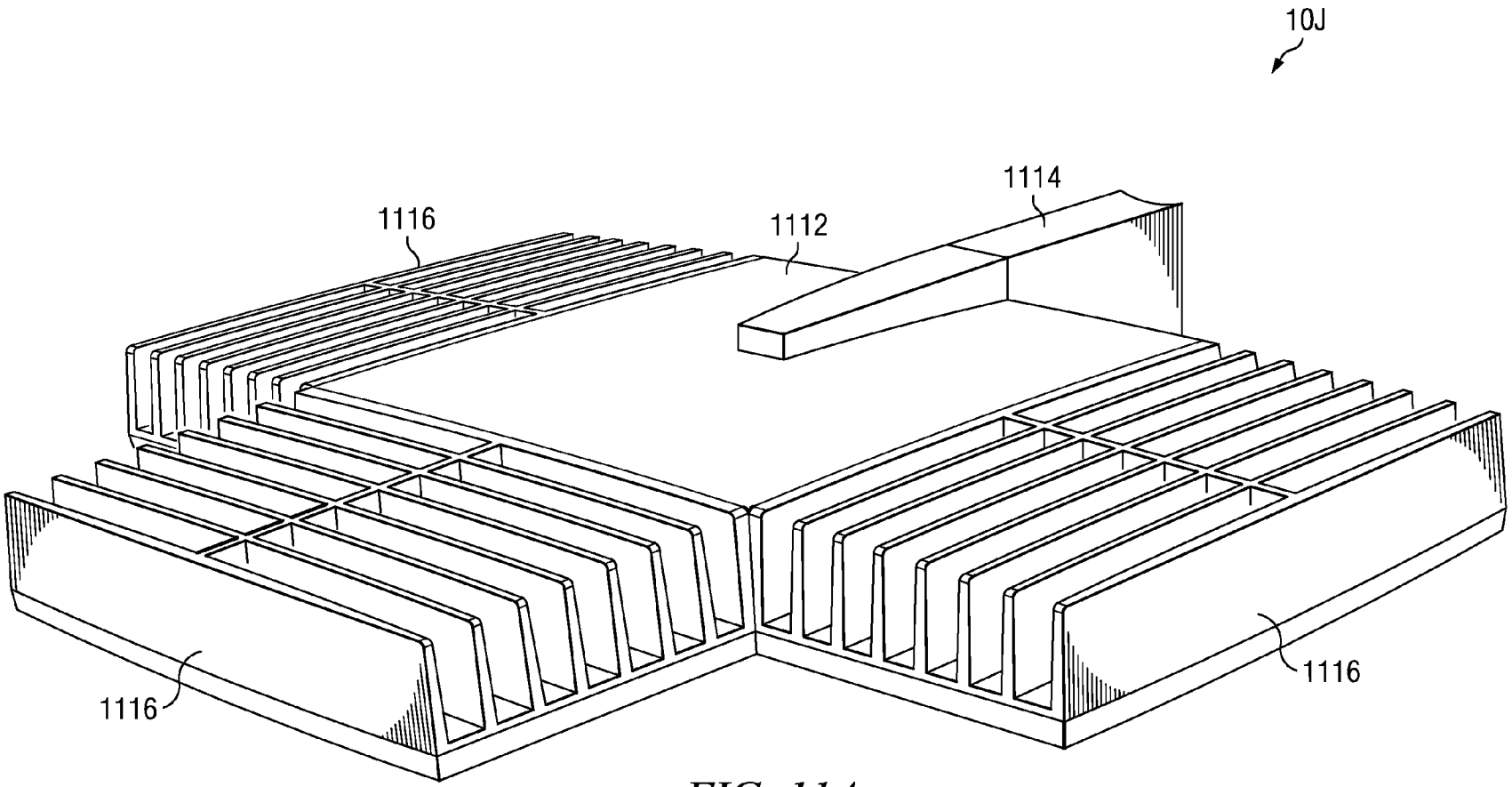
Figure 11B:
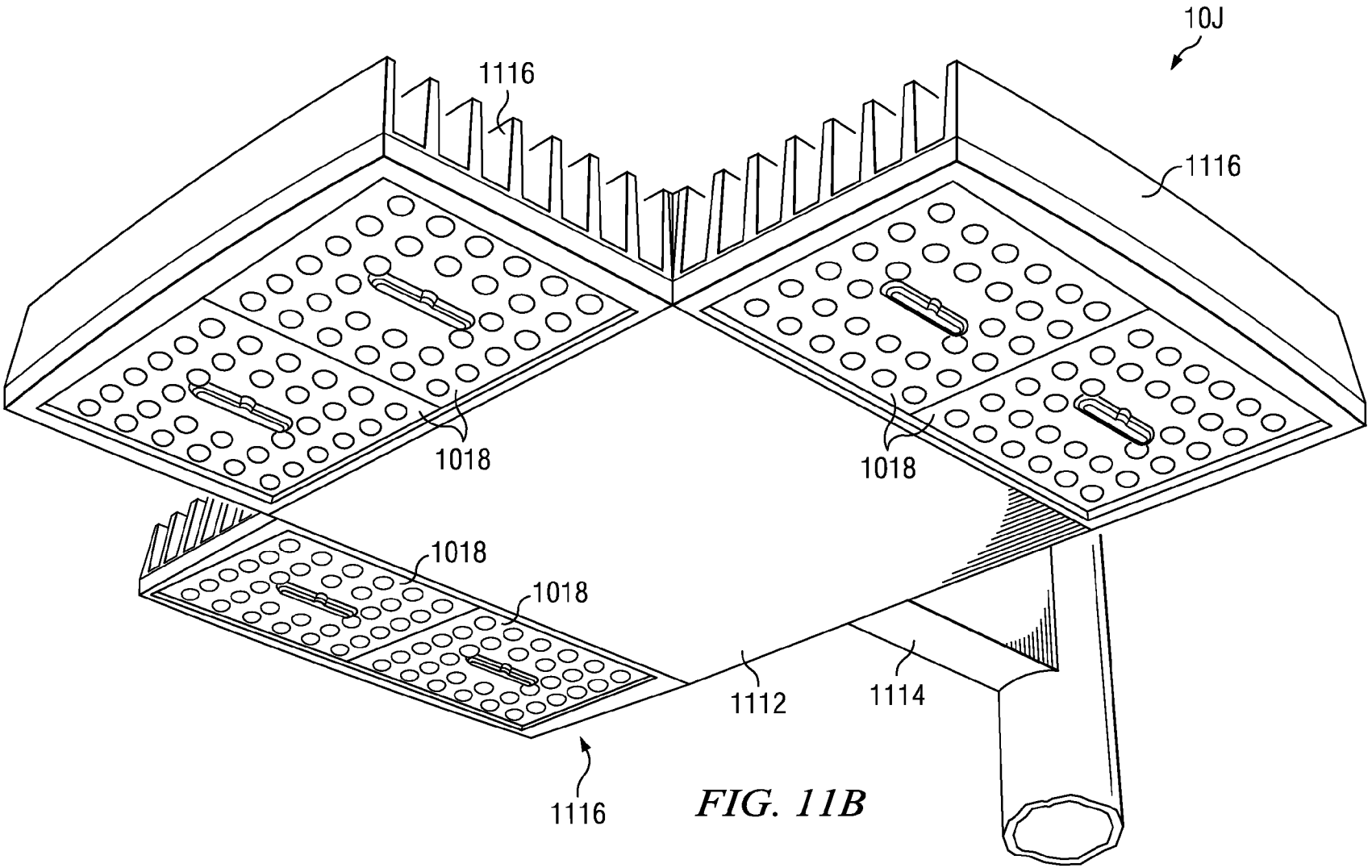

FIGS. 11A and 11B are perspective views from above and below, respectively, of another modular lighting system 10J, according to an example embodiment. Modular lighting system 10J may comprises an arm 1114, a support housing 1112, three heat sink modules 1116 (each supported on a different side of the support housing), and two LED panels 1118 mounted to the underside of each of the three heat sink modules 1116.

Figure 12:
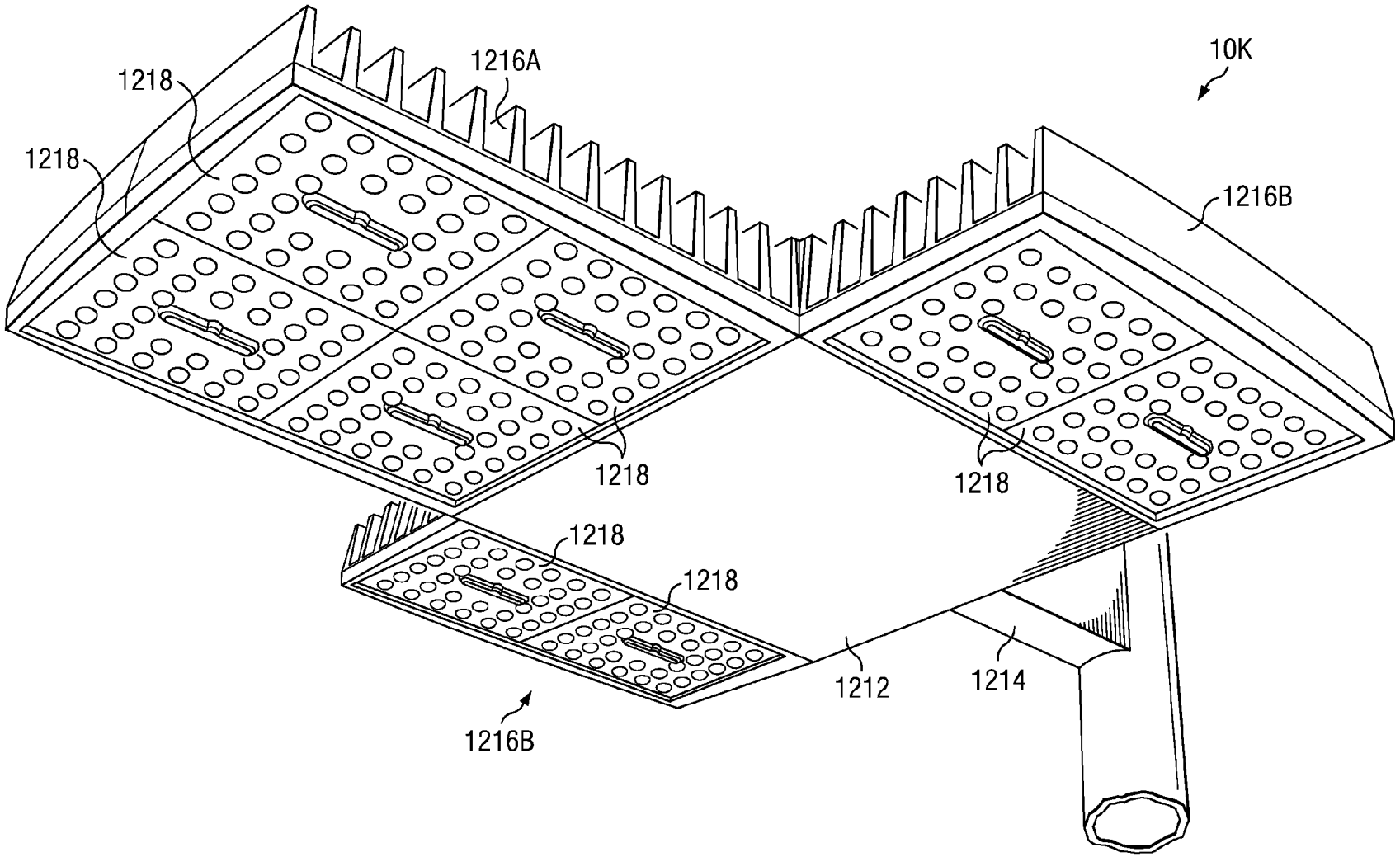
FIG. 12 is a perspective view from below of another modular lighting system mounted to a pole.

FIG. 12 is a perspective view from below of another modular lighting system 10K mounted to a pole, according to an example embodiment. Lighting system 10K comprises an arm 1214, a support housing 1212, a larger heat sink module 1216A supported on a front side of the support housing 1212 and a smaller heat sink module 1216B supported on each lateral side of the support housing 1212, with four LED panels 1218 mounted to the larger heat sink module 1216A and two LED panels 1218 mounted to each smaller heat sink module 1216B.

Figure 13:
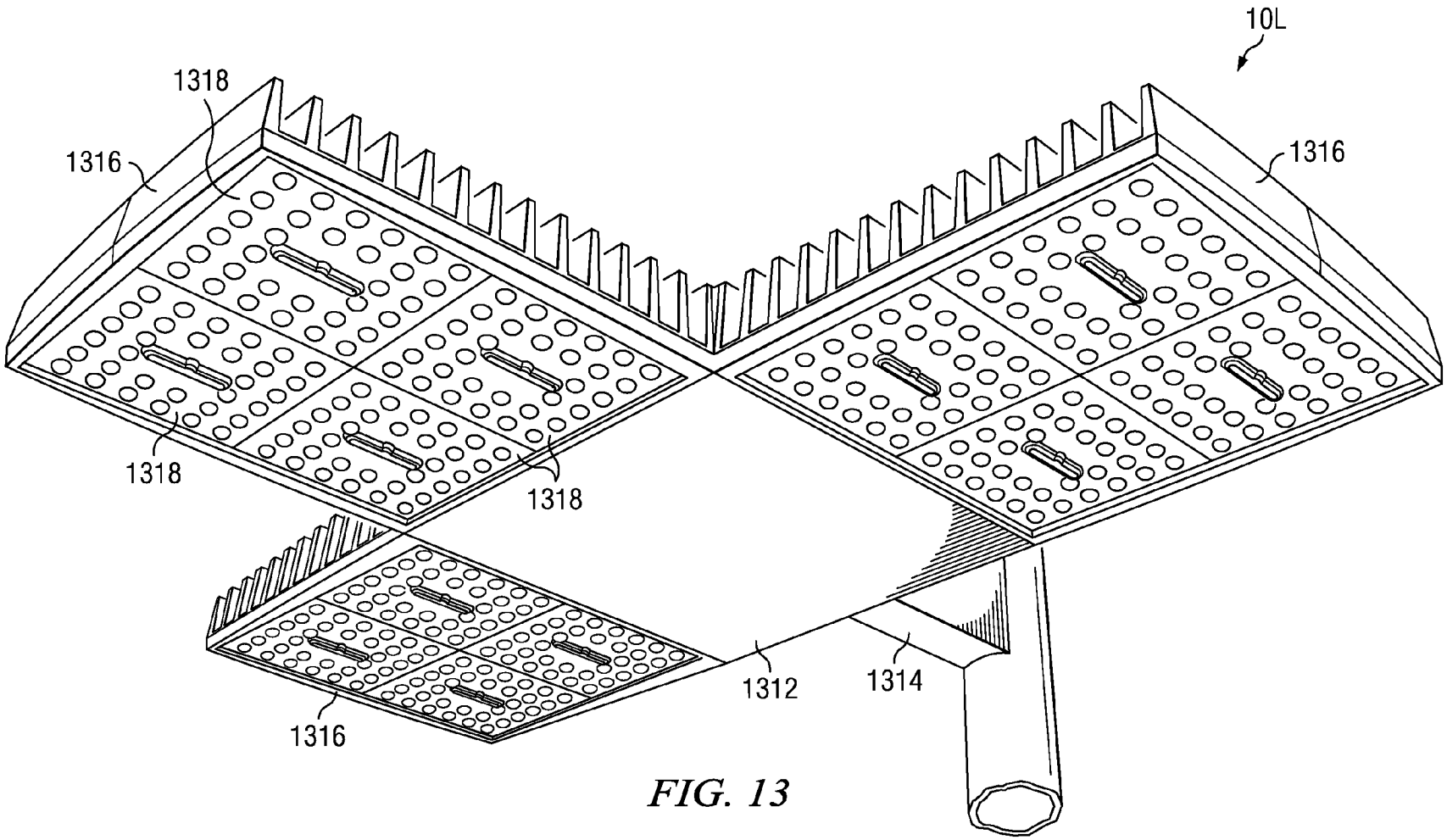
FIG. 13 is a perspective view from below of another modular lighting system mounted to a pole.

FIG. 13 is a perspective view from below of another modular lighting system 10L mounted to a pole, according to an example embodiment. Lighting system 10L comprises an arm 1314, a support housing 1312, and a larger heat sink module 1316 supported on each of three sides of the support housing 1312, with four LED panels 1318 mounted to each of the three heat sink modules 1316.

What is claimed is:

1. A heat sink module for transferring heat from at least one light source in a modular lighting system, the heat sink module comprising:

a front end structure;

a rear end structure that is opposite to the front end structure;

a generally planar base portion that extends between the front end structure and the rear end structure and is configured for engagement with a light panel to receive heat generated by the light panel;

a first and second lateral sides extending between the front end structure and the rear end structure;

at least one heat transfer element extending generally in a first direction;

at least one molded wiring channel defined by the generally planar base portion such that the at least one molded wiring channel is integral to the heat sink module and configured for routing wiring to the at least one light source, wherein the at least one molded wiring channel comprises a leading protrusion extending from the first lateral side and a trailing recess formed in the second lateral side, wherein the at least one molded wiring channel is defined such that the at least one molded wiring channel is enclosed when a light source panel is secured to an underside of the heat sink module; and at least one air flow opening configured to allow ambient air flow through the heat sink body.

2. The heat sink module of claim 1, further comprising connection structures for coupling the heat sink module to an adjacent heat sink module.

3. The heat sink module of claim 1, wherein the at least one heat transfer element comprises a series of fins extending generally in the first direction from the front end structure of the heat sink module to the rear end structure of the heat sink module.

4. The heat sink module of claim 1, wherein the at least one molded wiring channel extends in a direction non-parallel to the first direction.

5. The heat sink module of claim 1, wherein the at least one molded wiring channel extends in a direction substantially perpendicular to the first direction.

6. The heat sink module of claim 1, wherein the heat sink module further defines a plurality of mounting points for securing the light source panel to the heat sink module.

7. The heat sink module of claim 1, wherein the first and second lateral sides are configured for coupling the heat sink module to an adjacent heat sink module, and wherein the heat sink module and adjacent heat sink module are coupled such that the light source panel, when secured to the underside of the heat sink module, straddles the interface between the heat sink module and the adjacent heat sink module and the light source panel couples to a mounting point of the heat sink module and a mounting point of the adjacent heat sink module.

8. The heat sink module of claim 7, wherein:

the first lateral side of the heat sink module defines at least one first protrusion;

the second lateral side of the heat sink module defines at least one first recess;

the first lateral side of the heat sink module is configured for engagement with a first adjacent heat sink module such that the at least one first protrusion of the heat sink module is received in at least one second recess of the first adjacent heat sink module; and the second lateral side of the heat sink module is configured for engagement with a second adjacent heat sink module such that at least one first recess of the heat sink module receives at least one second protrusion of the second adjacent heat sink module.

9. The heat sink module of claim 8, wherein the at least one first protrusion at the first lateral side of the heat sink module comprises at least one light source module mounting point;

such that upon arrangement of the heat sink module with the first adjacent heat sink module, the at least one light source module mounting point on the at least one first protrusion of the heat sink module projects into a footprint of the first adjacent heat sink module.

10. The heat sink module of claim 1: wherein the at least one heat transfer element comprises a plurality of generally parallel fin elements extending from the generally planar base portion; and wherein each air flow opening is defined between adjacent ones of the generally parallel heat transfer elements and allows ambient air flow through the heat sink module in a direction generally perpendicular to a horizontal plane of the generally planar base portion.

11. The heat sink module of claim 10, wherein:

the plurality of generally parallel fin elements extend between the front end structure of the heat sink module and the rear end structure of the heat sink module; and the at least one air flow opening comprises at least one first air flow opening between adjacent ones of the generally parallel heat transfer elements and located near the front end structure of the heat sink module, and at least one second air flow opening between adjacent ones of the generally parallel heat transfer elements and located near the rear end structure of the heat sink module.

12. The heat sink module of claim 1, wherein the the at least one heat transfer element comprises a plurality of generally parallel heat transfer elements extending from the generally planar base portion, and extending generally in the first direction from the front end structure toward a rear end of the heat sink module; and wherein the at least one air flow opening configured to allow ambient air flow through the heat sink body comprises at least one first air flow opening defined between adjacent ones of the generally parallel heat transfer elements and between the front end structure and the base portion of the heat sink module.

13. The heat sink module of claim 12, wherein the at least one air flow opening configured to allow ambient air flow through the heat sink body further comprises at least one second air flow opening defined between adjacent ones of the generally parallel heat transfer elements and between the rear end structure and the base portion of the heat sink module.

14. The heat sink module of claim 1, wherein the heat sink module is formed by a die cast process.

15. A heat sink module for transferring heat from at least one light source in a modular lighting system, the heat sink module comprising:

a first end and a second end opposite the first end;

a generally planar base portion extending generally in a first plane and configured for thermal coupling with at least one light source;

at least one heat transfer element extending from the generally planar base portion in a first direction generally perpendicular to the first plane, and further extending between the first and second ends in a second direction;

first and second lateral sides extending between the first and second ends, each of the first and second lateral sides including connection structures for connecting the heat sink module to a similar adjacent heat sink module; and a molded wiring channel defined by the generally planar base portion such that the molded wiring channel is integral to the heat sink module, wherein the molded wiring channel comprises a leading wiring channel protrusion extending from the first lateral side and a trailing wiring channel recess formed in the second lateral side, and wherein the molded wiring channel is defined such that the molded wiring channel is enclosed when a light source panel is secured to an underside of the heat sink module.

16. The heat sink module of claim 15, wherein the molded wiring channel is configured for routing wiring to the at least one light source and the wiring channel extends in a direction non-parallel to the second direction.

17. The heat sink module of claim 16, wherein the molded wiring channel extends in a direction substantially perpendicular to the second direction.

18. The heat sink module of claim 15, wherein the heat sink module further defines at least one air flow opening configured to allow ambient air flow in a direction generally perpendicular to the first plane, the first plane being a horizontal plane extending along an elongation of the generally planar base.

19. The heat sink module of claim 18, wherein each air flow opening is defined between adjacent ones of the generally parallel heat transfer elements.

20. The heat sink module of claim 15, wherein:

the first lateral side of the heat sink module defines at least one first protrusion;

the second lateral side of the heat sink module defines at least one first recess; and the first lateral side of the heat sink module is configured for engagement with a first adjacent heat sink module such that the at least one first protrusion of the heat sink module is received in at least one second recess of the first adjacent heat sink module;

the second lateral side of the heat sink module is configured for engagement with a second adjacent heat sink module such that at least one first recess of the heat sink module receives at least one second protrusion of the second adjacent heat sink module.

21. The heat sink module of claim 20, wherein the at least one first protrusion at the first lateral side of the heat sink module comprises at least one light source panel mounting point;

such that upon arrangement of the heat sink module with the first adjacent heat sink module, the at least one light source panel mounting point on the at least one first protrusion of the heat sink module projects into a footprint of the first adjacent heat sink module.

22. The heat sink module of claim 15, wherein the heat sink module further defines a flange on the first lateral side, the flange extending between the first and second ends of the heat sink module, the flange configured to cover a corresponding edge of an adjacent heat sink module to prevent or reduce light flow through an intersection between the first lateral side and the corresponding edge of the adjacent heat sink module.

* * * * *